US012359382B2

(12) United States Patent
Roden et al.

(10) Patent No.: US 12,359,382 B2
(45) Date of Patent: Jul. 15, 2025

(54) GROUND TAPE APPLICATOR APPARATUS AND METHOD

(71) Applicant: Graco Minnesota Inc., Minneapolis, MN (US)

(72) Inventors: Joshua D. Roden, Dayton, MN (US); Dennis D. Kemmetmueller, Rogers, MN (US); August F. Legatt, Maple Lake, MN (US); James C. Schroeder, Ramsey, MN (US); Michael D. Vangstad, Zimmerman, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 18/386,815

(22) Filed: Nov. 3, 2023

(65) Prior Publication Data

US 2024/0060252 A1 Feb. 22, 2024

Related U.S. Application Data

(63) Continuation of application No. 17/854,628, filed on Jun. 30, 2022, now Pat. No. 11,821,154, which is a (Continued)

(51) Int. Cl.

| | |
|---|---|
| ***E01C 23/18*** | (2006.01) |
| ***B65H 35/00*** | (2006.01) |
| *E04D 5/00* | (2006.01) |
| *E04D 15/06* | (2006.01) |

(52) U.S. Cl.

CPC ..... *E01C 23/185* (2013.01); *B65H 35/0013* (2013.01); *B65H 2402/42* (2013.01); (Continued)

(58) Field of Classification Search

CPC ..... B65H 35/06; B65H 35/0006; B65H 35/0013; B65H 18/10; B65H 37/005; (Continued)

(56) References Cited

U.S. PATENT DOCUMENTS 3,350,256 A * 10/1967 Eckman ..... E01C 23/185 156/577
4,030,958 A 6/1977 Stenemann
(Continued)

FOREIGN PATENT DOCUMENTS

CA 2320861 A1 8/1999
CN 1943026 A 4/2007
(Continued)

OTHER PUBLICATIONS

International Preliminary Report on Patentability for PCT Application No. PCT/US2021/044141, Dated Feb. 7, 2023, pp. 13.
(Continued)

*Primary Examiner* — Alex B Efta
(74) *Attorney, Agent, or Firm* — Kinney & Lange, P.A.

(57) ABSTRACT

A ground tape applicator is configured to apply adhesive tape to ground surfacers. The ground tape applicator includes a plurality of rollers that guide the adhesive tape to the ground surface and apply the adhesive tape to the ground surface. The ground tape applicator includes a blade configured to engage with the adhesive tape to cut the adhesive tape to a desired length.

19 Claims, 37 Drawing Sheets

Related U.S. Application Data continuation of application No. PCT/US2021/044141, filed on Aug. 2, 2021.

(60) Provisional application No. 63/217,210, filed on Jun. 30, 2021, provisional application No. 63/155,795, filed on Mar. 3, 2021, provisional application No. 63/124,115, filed on Dec. 11, 2020, provisional application No. 63/060,311, filed on Aug. 3, 2020.

(52) U.S. Cl.
CPC ..... *B65H 2701/1922* (2013.01); *E04D 5/00* (2013.01); *E04D 15/06* (2013.01)

(58) Field of Classification Search
CPC ..... E01C 23/185; E01C 23/088; E04D 15/06; E04D 5/148
See application file for complete search history.

(56) References Cited

U.S. PATENT DOCUMENTS

| | | | | |
|---|---|---|---|---|
| 4,313,780 | A | 2/1982 | Ford | |
| 4,317,696 | A | 3/1982 | Hutchinson et al. | |
| 4,824,516 | A * | 4/1989 | Ishihara | E01C 23/185 156/577 |
| 5,030,958 | A * | 7/1991 | Schmalenberger | G01S 19/47 701/476 |
| 6,413,013 | B1 | 7/2002 | Requena | |
| 10,865,530 | B2 | 12/2020 | Wilkens et al. | |
| 2011/0229265 | A1 | 9/2011 | Schottka | |
| 2018/0274185 | A1* | 9/2018 | Rutherford | B65H 18/106 |
| 2019/0055702 | A1 | 2/2019 | Wilkens et al. | |
| 2019/0078276 | A1 | 3/2019 | Wilkens et al. | |
| 2020/0157750 | A1 | 5/2020 | Wilkens et al. | |
| 2022/0127801 | A1 | 4/2022 | Bedard et al. | |

FOREIGN PATENT DOCUMENTS

| | | | |
|---|---|---|---|
| CN | 101094958 | A | 12/2007 |
| KR | 20190002015 | A | 1/2019 |

OTHER PUBLICATIONS

International Search Report and Written Opinion for PCT Application No. PCT/US2021/044141, Dated Jan. 14, 2022, pp. 19.
Invitation to Pay Additional Fees for PCT Application No. PCT/US2021/044141, Dated Nov. 8, 2021, pp. 32.

* cited by examiner

GROUND TAPE APPLICATOR APPARATUS AND METHOD

CROSS-REFERENCE TO RELATED APPLICATION(S)

This application is a continuation of U.S. application Ser. No. 17/854,628 filed Jun. 30, 2022 entitled "GROUND TAPE APPLICATOR APPARATUS AND METHOD," which in turn is a continuation of International PCT Application No. PCT/US2021/44141 filed Aug. 2, 2021 and entitled "GROUND TAPE APPLICATOR APPARATUS AND METHOD," which in turn claims priority to U.S. Provisional Application No. 63/060,311 filed on Aug. 3, 2020, and entitled "ROAD TAPE APPLICATOR APPARATUS AND METHOD," and claims priority to U.S. Provisional Application No. 63/124,115, filed on Dec. 11, 2020, and entitled "ROAD TAPE APPLICATOR APPARATUS AND METHOD," and claims priority to U.S. Provisional Application No. 63/155,795, filed Mar. 3, 2021, and entitled "ROAD TAPE APPLICATOR APPARATUS AND METHOD," and claims priority to U.S. Provisional Application No. 63/217,210, filed Jun. 30, 2021, and entitled "ROAD TAPE APPLICATOR APPARATUS AND METHOD," the disclosures of which are hereby incorporated by reference in their entireties.

BACKGROUND

This disclosure relates generally to ground marking. More specifically, this disclosure relates to application of adhesive tapes to ground surfaces.

Ground surfaces, such as roads, require ground markings for guidance and navigation, such as stripes marked on the ground surface. Such markings have traditionally been painted on the ground surface, such as by a liquid spray. More recently, markings have been formed by the application of adhesive tape on the ground surface. Road tape can have superior reflectivity and other properties that make road tape an attractive option in some areas. However, road tape can be slower to apply than sprayed markings and the durability of each road tape line depends on the adhesion of the tape to the ground surface. The present disclosure concerns improvements for efficiently applying robust adhesive tape lines to ground surfaces, such as roadways.

SUMMARY

According to one aspect of the disclosure, a ground tape applicator includes an applicator frame; a plurality of wheels configured to support the applicator frame on a ground surface, the plurality of wheels including a pair of rear wheels and at least one front wheel; a tape spool support configured to support a spool of adhesive tape, the tape spool support supported by the applicator frame; and a plurality of rollers, the plurality of rollers configured to interface with the adhesive tape and positioned to guide the adhesive tape to the ground surface, the plurality of rollers including a first roller and a second roller. The adhesive tape interfaces with the first roller prior to interfacing with the second roller, and wherein the second roller is configured to press the adhesive tape onto the ground surface.

According to an additional or alternative aspect of the disclosure, a ground tape applicator includes an applicator frame; a plurality of wheels configured to support the applicator frame on a ground surface, the plurality of wheels including a pair of rear wheels and at least one front wheel; a tape spool support configured to support a spool of adhesive tape, the tape spool support supported by the applicator frame; a plurality of rollers, the plurality of rollers configured to interface with the adhesive tape and positioned to guide the adhesive tape to the ground surface; and a cutter supported by the applicator frame and configured to interface with the adhesive tape to cut the adhesive tape, the cutter including a blade. The blade is configured to be removed from the cutter by lateral sliding of the blade relative to the applicator frame.

According to another additional or alternative aspect of the disclosure, a ground tape applicator includes an applicator frame; a plurality of wheels configured to support the applicator frame on a ground surface, the plurality of wheels including a pair of rear wheels and at least one front wheel; a tape spool support configured to support a spool of adhesive tape, the tape spool support supported by the applicator frame; and a plurality of rollers, the plurality of rollers configured to interface with the adhesive tape and positioned to guide the adhesive tape to the ground surface, the plurality of rollers including a first roller having a cylindrical engagement surface configured to press the adhesive tape onto the ground surface, wherein the first roller is configurable to adjust a lateral width of the cylindrical engagement surface.

According to yet another additional or alternative aspect of the disclosure, a ground tape applicator includes an applicator frame; a plurality of wheels configured to support the applicator frame on a ground surface, the plurality of wheels including a pair of rear wheels and a pair of front wheels; a tape spool support configured to support a spool of adhesive tape, the tape spool support supported by the applicator frame; and a plurality of rollers, the plurality of rollers configured to interface with the adhesive tape and positioned to guide the adhesive tape to the ground surface. A first roller of the plurality of rollers is configured to press the adhesive tape into the ground surface by a first ground engaging surface of the first roller. The first roller is disposed longitudinally between the pair of rear wheels and the pair of front wheels. The first roller is disposed laterally between a first front wheel of the pair of front wheels and a second front wheel of the pair of front wheels.

DETAILED DESCRIPTION

The present disclosure relates generally to application of adhesive tapes to ground surfaces. The ground marking apparatus of the present disclosure applies adhesive tape to the ground surface in a manner that provides increased adhesion and improved application efficiency. The ground marking apparatus includes rollers that press the adhesive tape onto the ground surface to adhere the adhesive tape to the ground surface. In some examples, the ground marking apparatus applies the adhesive tape in a manner that avoids removal of the tape from the ground surface after adhering the tape to the ground surface. In some examples, the ground marking apparatus is configured to apply the adhesive tape to prepared surfaces that are undisturbed by the ground marking apparatus prior to, during, or after application. In some examples, the rollers of the ground marking apparatus are modular and can be configured to the specifications of the current job. In some examples, the cutting blade of the ground marking apparatus is a quick change blade that can be accessed, removed, and replaced from the exterior of the ground marking apparatus and without requiring manipulation of other components of the ground marking apparatus. While roadways and road tape are used herein as examples, it is understood that any desired adhesive marking tape can be applied to any desired ground surface by the apparatus and methods discussed herein.

Figure 1A:
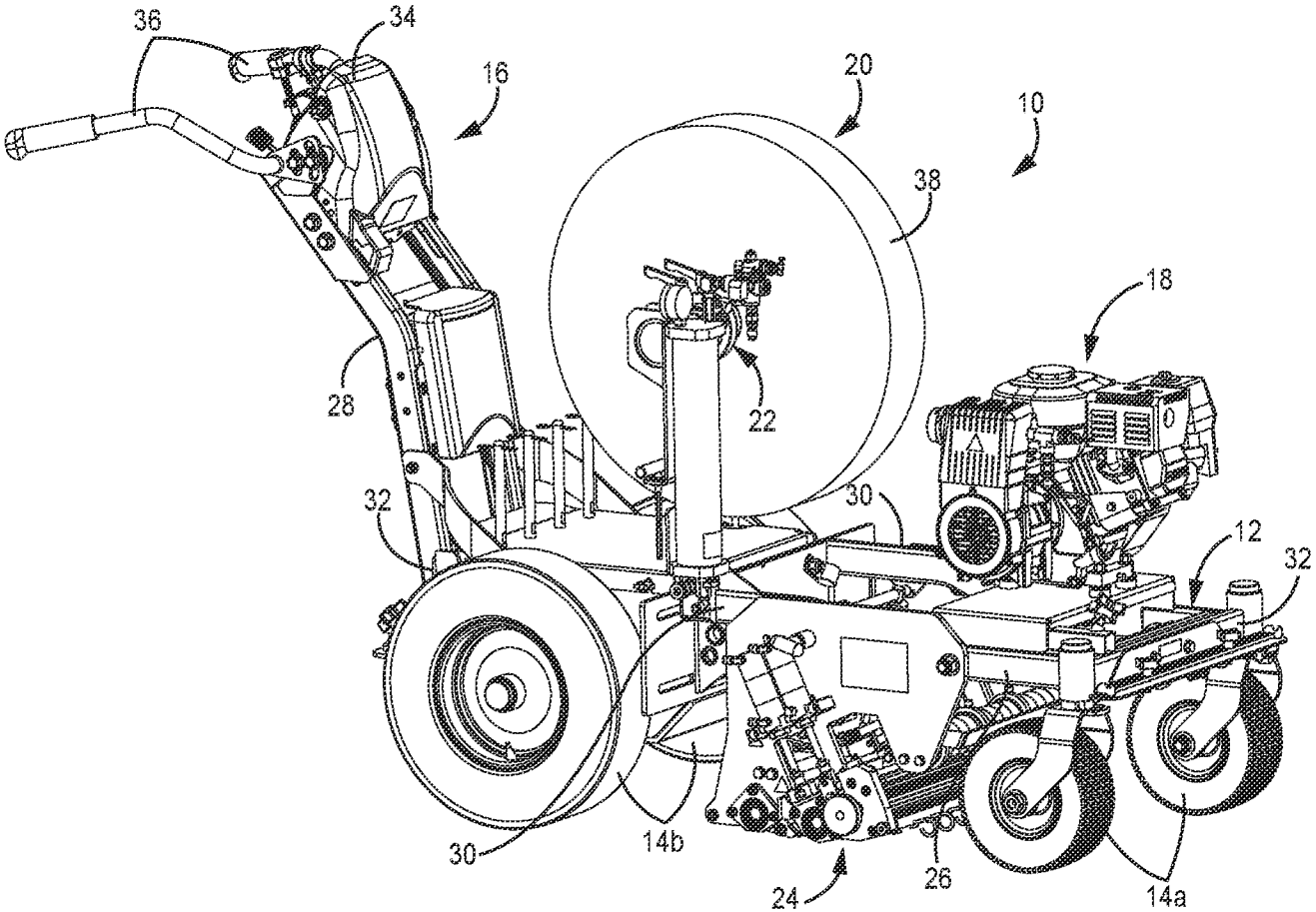
FIG. 1A is a first isometric view of a ground tape applicator.
Figure 1B:
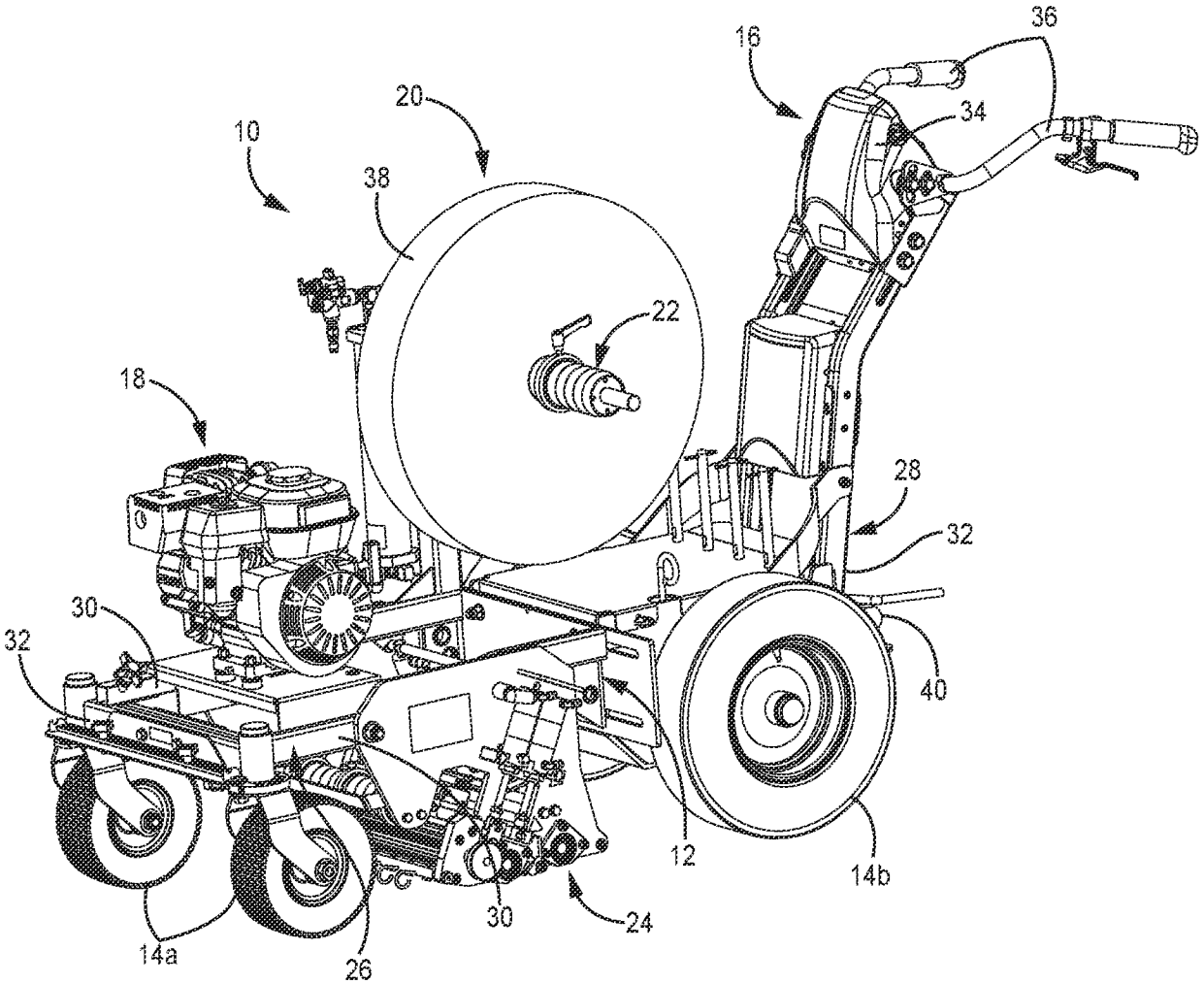
FIG. 1B is a second isometric view of the ground tape applicator taken from a different isometric perspective relative to FIG. 1A.
Figure 1C:
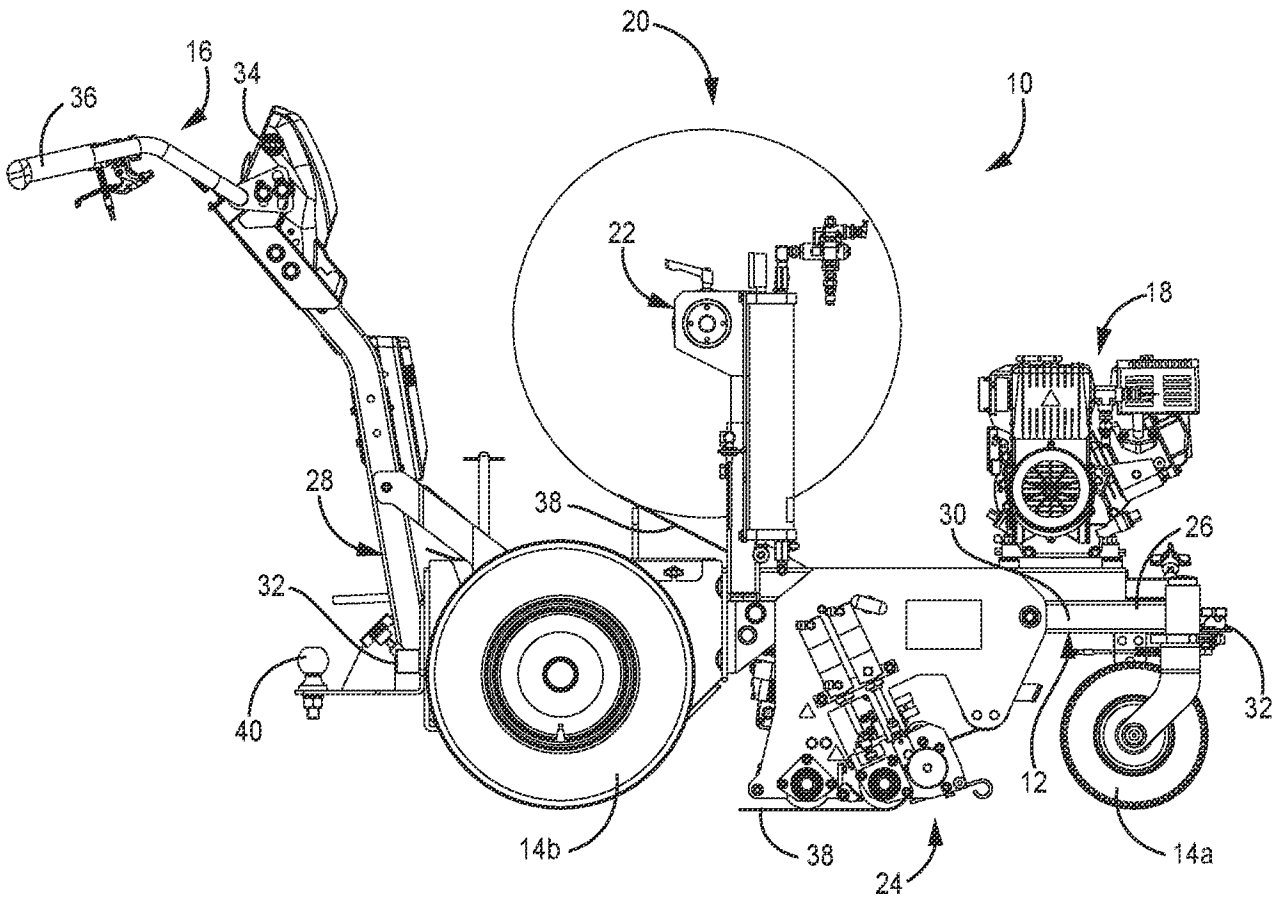
FIG. 1C is a side elevation view of the ground tape applicator.

FIG. 1A is a first isometric view of ground tape applicator 10. FIG. 1B is a second isometric view of ground tape applicator 10 from a different isometric perspective relative to FIG. 1A. FIG. 1C is a side elevation view of road tape applicator 10. FIGS. 1A-1C will be discussed together. Ground tape applicator 10 includes applicator frame 12, front wheels 14*a*, rear wheels 14*b*, user interface 16, power system 18, tape spool 20, spool support 22, and applicator module 24. Applicator frame 12 includes horizontal portion 26, vertical portion 26, lateral sides 30, and longitudinal ends 32. User interface 16 includes control module 34 and handlebars 36. Tape spool 20 is formed by a roll of adhesive tape 38.

The ground tape applicator 10 includes applicator frame 12 that is supported on wheels 14*a*, 14*b*. Front wheels 14*a* are disposed at a front longitudinal end 32 of applicator frame 12. Rear wheels 14*b* are disposed at a rear longitudinal end 32 of applicator frame 12. In some instances, ground tape applicator 10 is configured to travel towards the front longitudinal end 32 (to the right in FIG. 1C) during application of the adhesive tape 38.

Front wheels 14*a* are pivotable wheels that are each individually pivotable around vertical axes as well as being configured for rolling along the ground surface around horizontal axes. Front wheels 14*a* can also be referred to as swivel wheels or caster wheels. Rear wheels 14*b* can be fixed relative to any vertical axis such that rear wheels 14*b* are fixed to roll along the ground surface relative to a fixed horizontal axis. Rear wheels 14*b* can also be referred to as non-swivel wheels as rear wheels 14*b* are fixed to not pivot about vertical axes. In some examples, rear wheels 14*b* are connected together by a common axle. In some examples, rear wheels 14*b* are connected together for simultaneous rotation.

The applicator frame 12 can include a rectangular horizontal portion 26 having longitudinal ends 32 and lateral sides 30 and a vertical portion 26 that connects with user interface 16. Vertical portion 26 is disposed at the rear longitudinal end 32 of applicator frame 12. It is understood that horizontal portion 26 can have vertical displacement between sides and/or ends of horizontal portion 26, in some examples. It is understood that vertical portion 26 can have a top end laterally and/or longitudinally offset from a bottom end, in some examples.

The user interface 16 can include inputs for control of the ground tape applicator 10. In the example shown, user interface 16 includes handlebars 36 for steering of ground tape applicator 10. Handlebars 36 can be fixed relative to applicator frame 12. While ground tape applicator 10 is shown as including handlebars 36, it is understood that ground tape applicator 10 can include any desired user control mechanism, such as a steering wheel, among other options. In some examples, the user control mechanism can be connected to front wheels 14*a* to control an orientation of front wheels 14*a*. In some embodiments, the ground tape applicator 10 can be pushed by the user while the user walks or can be pushed by a motorized driver (e.g., when connected to the hitch 40 of the road tape applicator 10). The road tape applicator 10 can alternatively be pulled.

The user interface 16 can include one or more switches for inputting commands to ground tape applicator 10. For example, the input/output portion of the user interface 16 can be implemented as part of the control module 34. The user interface 16 can include a visual interface such as a screen, touchscreen, lights, or other visuals. In some examples, user interface 16 can include one or more of a sound card, a video graphics card, a speaker, a display device (such as a liquid crystal display (LCD), a light emitting diode (LED) display, an organic light emitting diode (OLED) display, etc.), a touchscreen, a keyboard, a mouse, a joystick, or other type of device for facilitating input and/or output of information in a form understandable to users and/or machines. Control module 34 can include one or more of a processor, a microprocessor, a controller, a digital signal processor (DSP), an application specific integrated circuit (ASIC), a field-programmable gate array (FPGA), or other equivalent discrete or integrated logic circuitry. Control module 34 can include memory configured to store information before, during, and/or after operation.

The ground tape applicator 10 includes a power system 18 for powering the functions referenced herein. Power system 18 can include an engine and a fuel reservoir. The engine can be an internal combustion engine, among other options. In some examples, the power system 18 can include a compressor or other source of compressed air (e.g., a tank) for providing pressurized air for operating pneumatic actuators, as discussed in more detail herein. The power system 18 can include a battery. The power system 18 can include one or more electric motors, such as for electric actuators, such as solenoids.

The ground tape applicator 10 includes tape spool support 22. The tape spool support 22 extends from the applicator frame 12 and support a tape spool 20. In the example shown, tape spool support 22 is disposed vertically above applicator frame 12 such that horizontal portion 26 of applicator frame 12 is disposed vertically between tape spool support 22 and the ground surface. Road tape is typically shipped in a tape spool 20. A top side of the adhesive tape, which is the side exposed after application to the ground surface, is made to be reflective and durable, while the bottom side of the adhesive tape, which is the side contacting the ground surface, contains an adhesive for adhering to the ground surface. The top side typically does not include adhesive. The top side can include reflective material embedded in the adhesive tape 38. The tape spool 20 is formed by a roll of adhesive tape 38 to be applied to the ground surface. The adhesive tape 38 is rolled into the tape spool 20 such that the top side of the adhesive tape 38 faces outward and forms the exterior of the tape spool 20. As such, the bottom side of the adhesive tape 38 is not exposed until that portion of the adhesive tape 38 is unspooled from the tape spool 20.

The ground tape applicator 10 applies the adhesive tape 38 to the ground surface by the applicator module 24. The applicator module 24 can be attached to, and be supported at least in part by, the applicator frame 12. Applicator module 24 is movable between various operational states. As further discussed herein, the applicator module 24 can be entirely supported by the applicator frame 12 in some states but in some other states the applicator module 24 can roll on the ground surface to support itself partially or fully on the ground surface. In some states, the applicator module 24 bears part of the weight of the applicator frame 12 and other components attached to the applicator frame 12 (e.g., the power system 18, tape spool 20, etc.) when one or more rollers of the applicator module 24 are engaged with the ground surface to roll on the ground surface.

During operation, ground tape applicator 10 applies strips of adhesive tape 38 to a ground surface. Adhesive tape 38 is fed to applicator module 24 from tape spool 20. Applicator module 24 applies the adhesive tape 38 directly to the ground surface. The applicator module 24 can be positioned mostly or entirely below the applicator frame 12. The applicator module 24 can be positioned mostly or entirely laterally between the two rear wheels 14*b*, and in front of the two rear wheels 14*b* and behind the front wheels 14*a*. The applicator module 24 can be positioned mostly or entirely laterally between the two front wheels 14*a*. As discussed in more detail below, ground tape applicator 10 is configured to apply the adhesive tape 38 at a location disposed laterally between front wheels 14*a* and rear wheels 14*b*. As such, the location where the adhesive tape 38 is applied to the ground surface is positioned such that neither the front wheels 14*a* nor the rear wheels 14 roll over that location during the application process.

Figure 2:
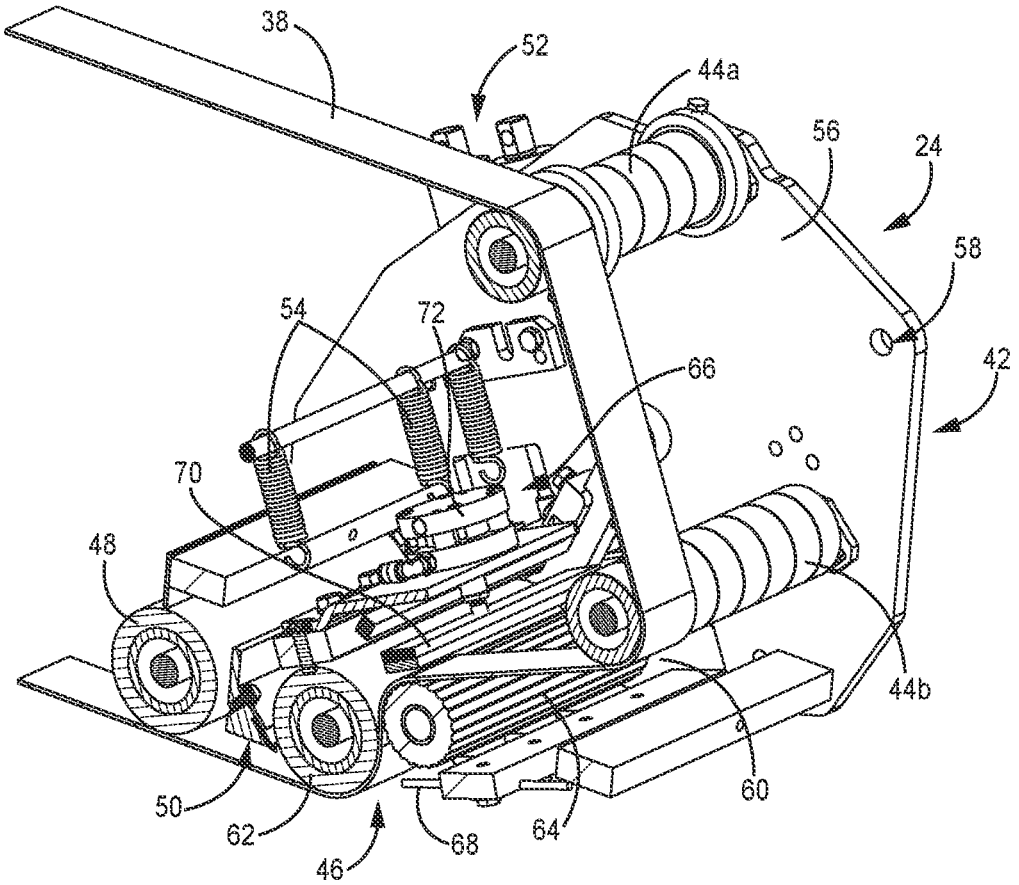
FIG. 2 is an isometric cross-sectional view of an applicator module.

FIG. 2 is a cross-sectional view of applicator module 24 with other portions of ground tape applicator 10 removed for clarity. Applicator module 24 includes module frame 42, guide roller 44*a*, guide roller 44*b*, lead roller assembly 46, tamper roller 48, cutter 50, roller actuator 52, and lifts 54. Module frame 42 includes side plates 56 (only one of which is shown), and each side plate 56 includes pivot 58. Applicator roller assembly 46 includes roller frame 60, applicator roller 62, adhesive-side roller 64, brake assembly 66, and guides 68. Brake assembly 66 includes brake 70 and brake actuator 72.

Applicator module 24 is configured to receive adhesive tape 38 from tape spool 20 and apply the adhesive tape 38 directly to the ground surface. Applicator module 24 is connected to applicator frame 12 (FIGS. 1A-1C) such that applicator module 24 forms a portion of ground tape applicator 10. Applicator module 24 is movably connected to applicator frame 12 such that applicator module 24 can be actuated relative to applicator frame 12 between various operating states.

The applicator module 24 receives adhesive tape 38 from tape spool 20. The applicator module 24 includes a plurality of rollers which guide the passage of the adhesive tape 38 through the applicator module 24 to the ground surface. The applicator module 24 includes a module frame 42. In the example shown, module frame 42 includes a pair of parallel side plates 56 between which the rollers of the applicator module 24 are disposed. In this way, the module frame 42 can support, directly or indirectly, the rollers of the applicator module 24.

In the example shown, applicator module 24 is connected to applicator frame 12 at pivots 58. Pivots 58 are formed by one or more holes through applicator module 24 (e.g., through both side plate 56). For example, a rod, dowel, bar, bolt, or other bearing can extend through side plates 56 and a portion of applicator frame 12 to form pivots 58 and connect applicator module 24 to applicator frame 12. It is understood that, in the example shown, applicator module 24 is connected to applicator frame 12 by a pair of pivots 58 connecting each side plate 56 of module frame 42 to the lateral sides 30 of applicator frame 12. In the example shown, applicator module 24 is configured to pivot between various states, as discussed in more detail herein. It is understood, however, that applicator module 24 can be configured to move in any desired manner relative to applicator frame 12. For example, applicator module 24 can be configured to move linearly between operational states.

Guide rollers 44*a*, 44*b* are supported by module frame 42. Guide rollers 44*a*, 44*b* extends laterally between side plates 56 of module frame 42. Guide rollers 44*a*, 44*b* change a direction of travel of adhesive tape 38 between tape spool 20 and tamper roller 48. The top side of adhesive tape 38 (i.e., the side of adhesive tape 38 facing upwards when adhesive tape 38 is applied to the ground surface) contacts guide rollers 44*a*, 44*b* as the adhesive tape 38 passes over guide rollers 44*a*, 44*b*. While applicator module 24 is shown as including multiple guide rollers 44*a*, 44*b*, it is understood that some examples include a single guide roller 44*a*, 44*b* for changing the direction of the adhesive tape 38. For example, applicator module 24 may include only one of guide rollers 44*a*, 44*b* and not the other one of guide rollers 44*a*, 44*b*.

Roller assembly 46 is supported by module frame 42. In the example shown, lead roller assembly 46 is movable relative to module frame 42, as discussed in more detail below. Roller frame 60 interfaces with module frame 42. Applicator roller 62 is supported by roller frame 60. Adhesive-side roller 64 is supported by roller frame 60. The bottom side of adhesive tape 38, which is the side of adhesive tape 38 that includes the adhesive and contacts the ground surface when applied to the ground surface, contacts adhesive-side roller 64. Adhesive-side roller 64 is textured to minimize the surface area of adhesive-side roller 64 in direct contact with the adhesive side of the adhesive tape 38, while still directing the passage of the adhesive tape 38. In the example shown, the texture of the adhesive-side roller 64 is formed by ribbing. It is understood, however, that the texture of the adhesive-side roller 64 can be formed in any desired manner that reduces the contact area between adhesive-side roller 64 and adhesive tape 38, such as by lugs extending from adhesive-side roller 64, non-linear ribs, etc.

Brake assembly 66 is supported by lead roller assembly 46. Brake assembly 66 is supported by roller frame 60 and is configured to brace the adhesive tape 38 against adhesive-side roller 64 to stop rolling of adhesive tape 38, as discussed in more detail below. Brake actuator 72 is supported by roller frame 60. Brake 70 is connected to brake actuator 72 to be actuated by brake actuator 72. In the example shown, brake actuator 72 is a pneumatic actuator, but it is understood that brake actuator 72 can be of any desired configuration suitable for actuating brake 70 to engage adhesive tape 38 against adhesive-side roller 64, such as an electric actuator or hydraulic actuator, among other options.

Applicator roller 62 is supported by roller frame 60. Applicator roller 62 extends laterally between and is supported by the side plates of roller frame 60. Applicator roller 62 can form the first part of applicator module 24 that directly engages adhesive tape 38 with the ground surface. Applicator roller 62 can be formed by rubber or other compliant material. The compliant material forming applicator roller 62 facilitates pressing adhesive tape 38 onto the ground surface, preventing damage to adhesive tape 38 while improving adhesion. As discussed further herein, the applicator roller 62 can be the first part of the applicator module 24 that directly forces the adhesive tape 38 firmly against the ground surface. In this way, the applicator roller 62 rolls on the ground surface and compresses the adhesive tape 38 against the ground surface. Applicator roller 62 can thereby apply pressure to the adhesive tape 38 to cause the adhesive side (i.e., bottom side) of the adhesive tape 38 to adhere to the ground surface. As discussed further herein, applicator module 24 can be configured such that applicator roller 62 only presses part of the adhesive tape 38 forming each stripe directly against the ground surface, such as the leading end of the stripe, while not pressing another part (e.g., the remainder) of the adhesive tape 38 forming the stripe directly against the ground surface, such as the middle and trailing ends of the stripe. Roller actuator 52 is operably connected to roller assembly 46 to actuate roller assembly 46 relative to module frame 42 and relative to the ground surface.

Guides 68 extend below adhesive-side roller 64 towards applicator roller 62. Guides 68 are configured to maintain adhesive tape 38 in a desired position for application of a stripe of the adhesive tape 38. Guides 68 can prevent the adhesive tape 38 from bunching or otherwise adhering to itself after a cut. Guides 68 can be formed by projecting pins, among other options.

Tamper roller 48 is the rearmost roller of applicator module 24 along the path of the adhesive tape 38. In the example shown, tamper roller 48 is the last portion of ground tape applicator 10 to contact adhesive tape 38 during the application process. Tamper roller 48 can be configured similarly to the applicator roller 62. For example, the tamper roller 48 can be formed from a rubber material or can otherwise be formed from a compliant material. The softness of the material of the applicator roller 62 and the tamper roller 48 allows the rollers to adapt to small variation in the ground surface while still applying consistent and firm pressure to the adhesive tape 38 to adhere the adhesive tape 38 to the ground surface. When applying tape in some cases, the tamper roller 48 is always rolled against the adhesive tape 38 for the entirety of a line, to thereby firmly adhere the adhesive tape 38 forming the line to the ground surface. In contrast to the tamper roller 48, the applicator roller 62 may be rolled against the adhesive tape 38 for only part of the line. The applicator roller 62 can move vertically up and down relative to the tamper roller 48 to engage and disengage from the ground surface, as further discussed herein.

Cutter 50 is supported by module frame 42. Cutter 50 is disposed longitudinally between applicator roller 62 and tamper roller 48. Cutter 50 is configured to engage the adhesive tape 38 to cut a stripe formed by the adhesive tape 38 to a desired length.

Lifts 54 are connected to roller assembly 46 and are connected to module frame 42. Lifts 54 are configured to pull roller assembly 46 generally vertically upward away from the ground surface. Lifts 54 can thus be considered to form a part of a roller actuation module along with the roller actuator 52. Lifts 54 pull the roller assembly 46, which includes the applicator roller 62, upwards for when the tamper roller 48 is used to roll the adhesive tape 38 against the ground surface while the applicator roller 62 is displaced upward to not roll the adhesive tape 38 against the ground surface, as discussed in more detail below. In the example shown, lifts 54 are formed by a plurality of springs. It is understood, however, that lifts 54 can be of any configuration suitable for pulling roller assembly 46 away from the ground surface. For example, lifts 54 can be formed by pneumatic actuators, electric actuators, hydraulic actuators, etc. In some examples, lifts 54 can be formed by pneumatic cylinders or electric solenoids. In the example shown, one end of each lift 54 is attached to roller assembly 46 while the other end of each lift 54 is attached to applicator module frame 42, such that lifts 54 can move roller assembly 46 relative to the module frame 42. In the example shown, the ends of the lifts 54 connected to applicator module frame 42 are connected to a bar extending between side plates 56. It is understood that, in some examples, lifts 54 can be directly connected to side plates 56.

Figure 3A:
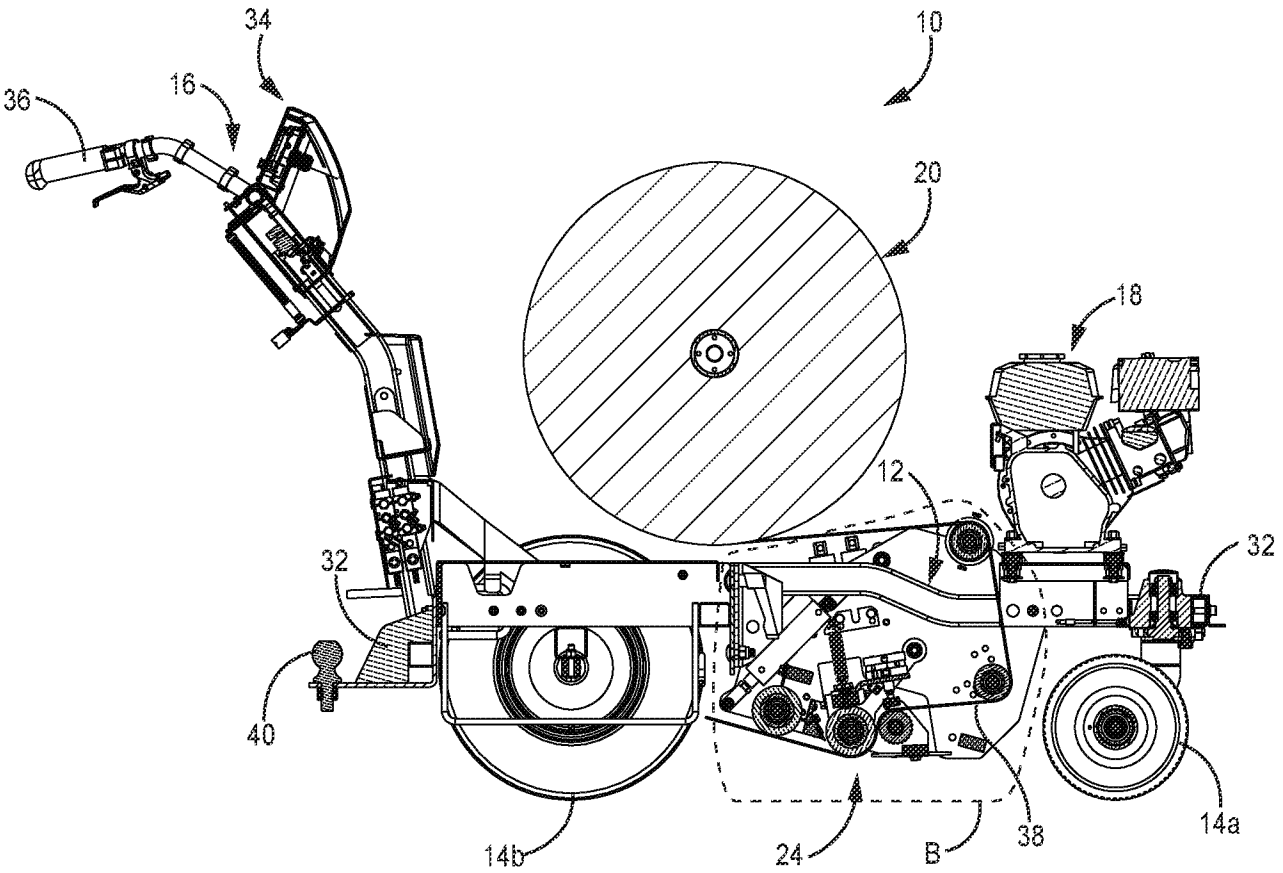
FIG. 3A is a cross-sectional view of the ground tape applicator showing the applicator module in a first state.
Figure 3B:
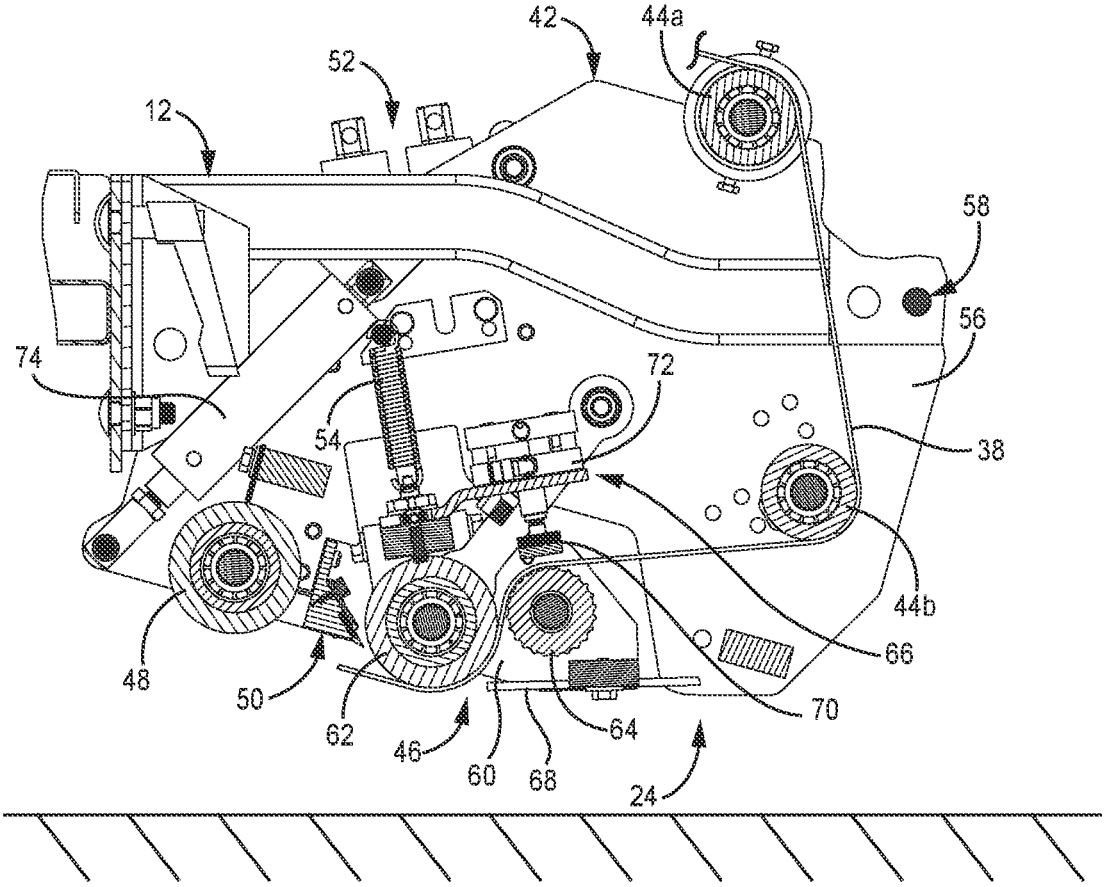
FIG. 3B is an enlarged view of detail B in FIG. 3A showing the applicator module in the first state.
Figure 4A:
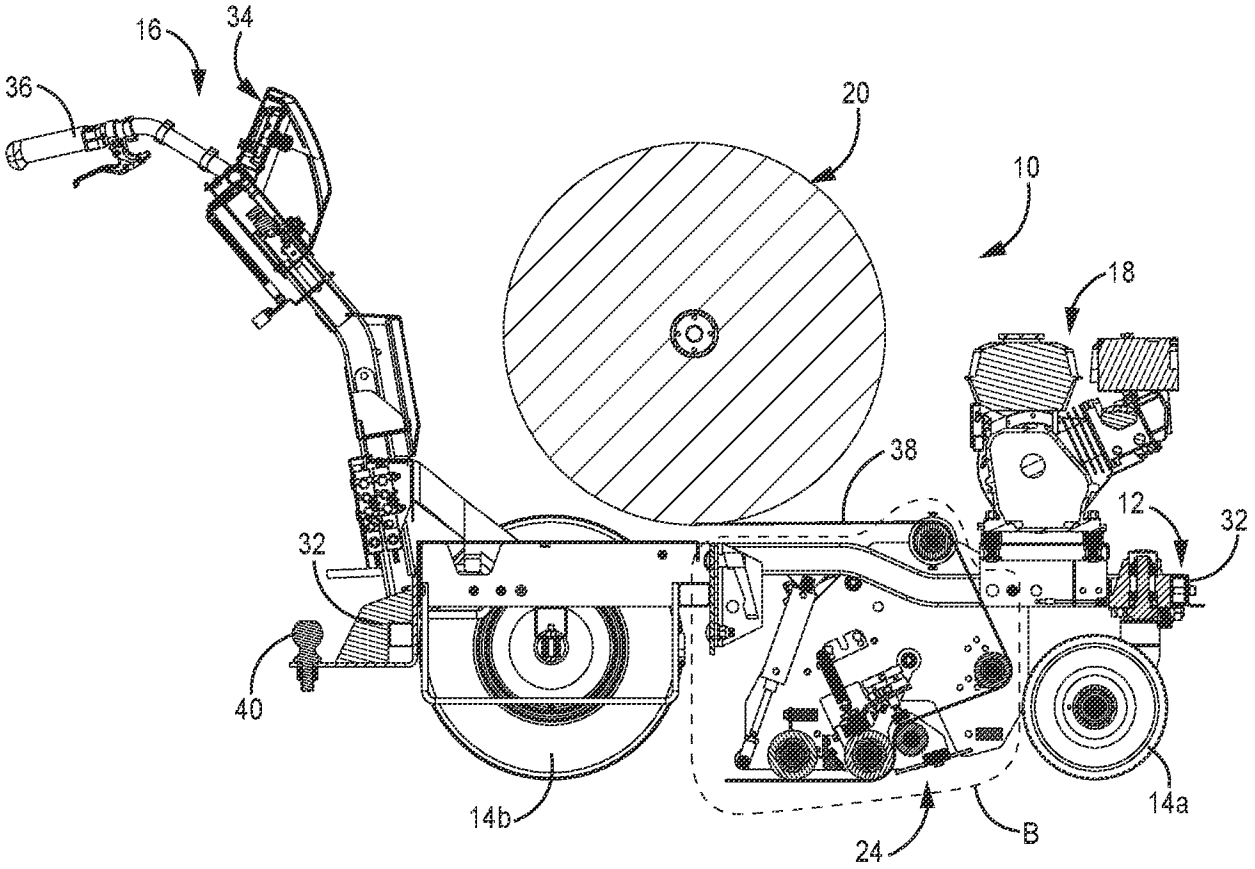
FIG. 4A is a cross-sectional view of the ground tape applicator showing the applicator module in a second state.
Figure 4B:
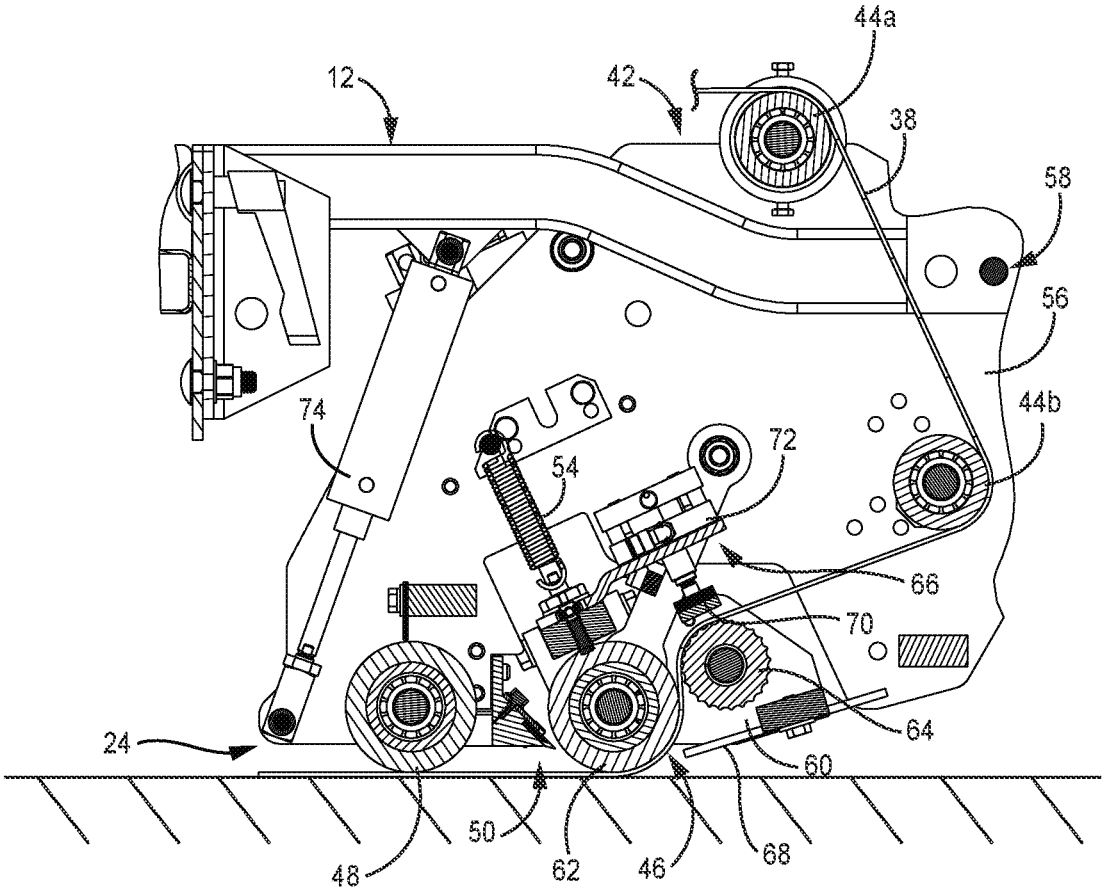
FIG. 4B is an enlarged view of detail B in FIG. 4A showing the applicator module in the second state.

FIG. 3A is a cross-sectional view of ground tape applicator 10 showing applicator module 24 in a first state. FIG. 3B is an enlarged view of detail B in FIG. 3A showing applicator module 24 in the first state. FIG. 4A is a cross-sectional view of ground tape applicator 10 showing applicator module 24 in a second state. FIG. 4B is an enlarged view of detail B in FIG. 4A showing applicator module 24 in the second state. FIGS. 3A-4B will be discussed together.

In the first state, which can also be referred to as the stowed state or upper state, applicator module 24 is retracted such that no rollers of applicator module 24 contact the ground surface. The applicator module 24 is in a stowed position for transport of ground tape applicator 10 when in the first state. With applicator module 24 in the first state, neither applicator roller 62 nor tamper roller 48 contact the ground surface. In some examples, no part of applicator module 24 contacts the ground surface with applicator module 24 in the first state.

In the second state, which can also be referred to as the deployed state or lower state, applicator module 24 is situated to apply the adhesive tape 38 to the ground surface. Applicator module 24 is in the deployed position for application of the adhesive tape 38. With applicator module 24 in the second state, ground tape applicator 10 is still mobile relative to the ground surface, but tamper roller 48 and/or other parts of applicator module 24 may be engaged with the ground surface. Such engagement is not ideal for maneuvering of ground tape applicator 10 and can adversely affect the life of the rollers while transporting ground tape applicator 10, while such engagement facilitates adhesion of the adhesive tape 38 on the ground surface by the rollers rolling over and pressing the adhesive tape 38 onto the ground surface.

With applicator module 24 in the second state, applicator module 24 is positioned to allow the tamper roller 48, and in some cases the applicator roller 62, to contact the ground surface and/or directly press the adhesive tape 38 against the ground surface. The proximity of the tamper roller 48, and in some cases the applicator roller 62, to the ground surface facilitates the roller(s) pressing the adhesive tape 38 into the ground surface to firmly adhere the adhesive tape 38 to the ground surface.

When the ground tape applicator 10 is moved around between line series, it is not desirable to have either the tamper roller 48 or the applicator roller 62 rolling along the ground surface, which may unnecessarily wear the soft exterior surfaces of these rollers. As such, applicator module 24 can be actuated to the first state for transport to prevent undesirable wear to the ground-engaging rollers of ground tape applicator 10 (e.g., applicator module 24 and tamper roller 48). More specifically, the applicator module 24 can be moved upwards away from the ground surface to the first state so that the tamper roller 48 and the applicator roller 62 do not contact the ground surface during transport.

Applicator module 24 is movable relative to applicator frame 12 to shift between the first state and the second state. In the example shown, applicator module 24 is configured to pivot between the first state and the second state. Applicator module 24 is connected to applicator frame 12 at pivot 58. It is at the pivot 58 that the applicator module 24 can be supported by the applicator frame 12. Pivot 58 can include bearings extending through the apertures in the applicator frame 12 and the module frame 42 to allow the applicator module 24 to move relative to the applicator frame 12.

Module actuator 74 is connected to applicator module 24 to actuate applicator module 24 between the first state and the second state. Module actuator 74 connects applicator module 24 to applicator frame 12, or to another portion of ground tape applicator 10 that is braced to applicator frame 12. It is understood that ground tape applicator 10 can include multiple module actuators 74 to transition applicator module 24 between the first state and the second state. It is understood that module actuator 74 can be formed by one or more components operating together. In the example shown, module actuator 74 includes a pair of individual actuators disposed on opposite lateral sides of applicator module 24. In some examples, the components forming module actuator 74 can be evenly spaced relative to a longitudinal centerline of ground tape applicator 10. The longitudinal centerline can pass through a midpoint of each longitudinal end 32 of applicator frame 12. The longitudinal centerline can be orthogonal to the axis of rotation of at least one of tamper roller 48, applicator roller 62, adhesive-side roller 64, first guide roller 44*a*, and second guide roller 44*b*.

A first end of the module actuator 74 is connected to the applicator module 24 and a second end of the module actuator 74 is connected to the applicator frame 12. Module actuator 74 can be a linear actuator. For example, module actuator can be a pneumatic actuator, electric actuator, or hydraulic actuator, among other actuation types. In the example shown, module actuator 74 includes pneumatic cylinders, but it is understood that module actuator 74 can additionally or alternatively include an electric solenoid, among other actuator types. Each pneumatic cylinder includes a piston operatively connected to applicator module 24 to shift applicator module 24 between the various states. Module actuator 74 moves the applicator module 24 between the stowed position for transport and to the lower position for application of adhesive tape 38 to the ground surface. Module actuator 74 can be controlled by an interface component of user interface 16. For example, a switch, button, toggle, graphical user interface, etc. can be formed on user interface 16 and used to control module actuator 74 to actuate applicator module 24 between the first state and the second state.

Figure 5A:
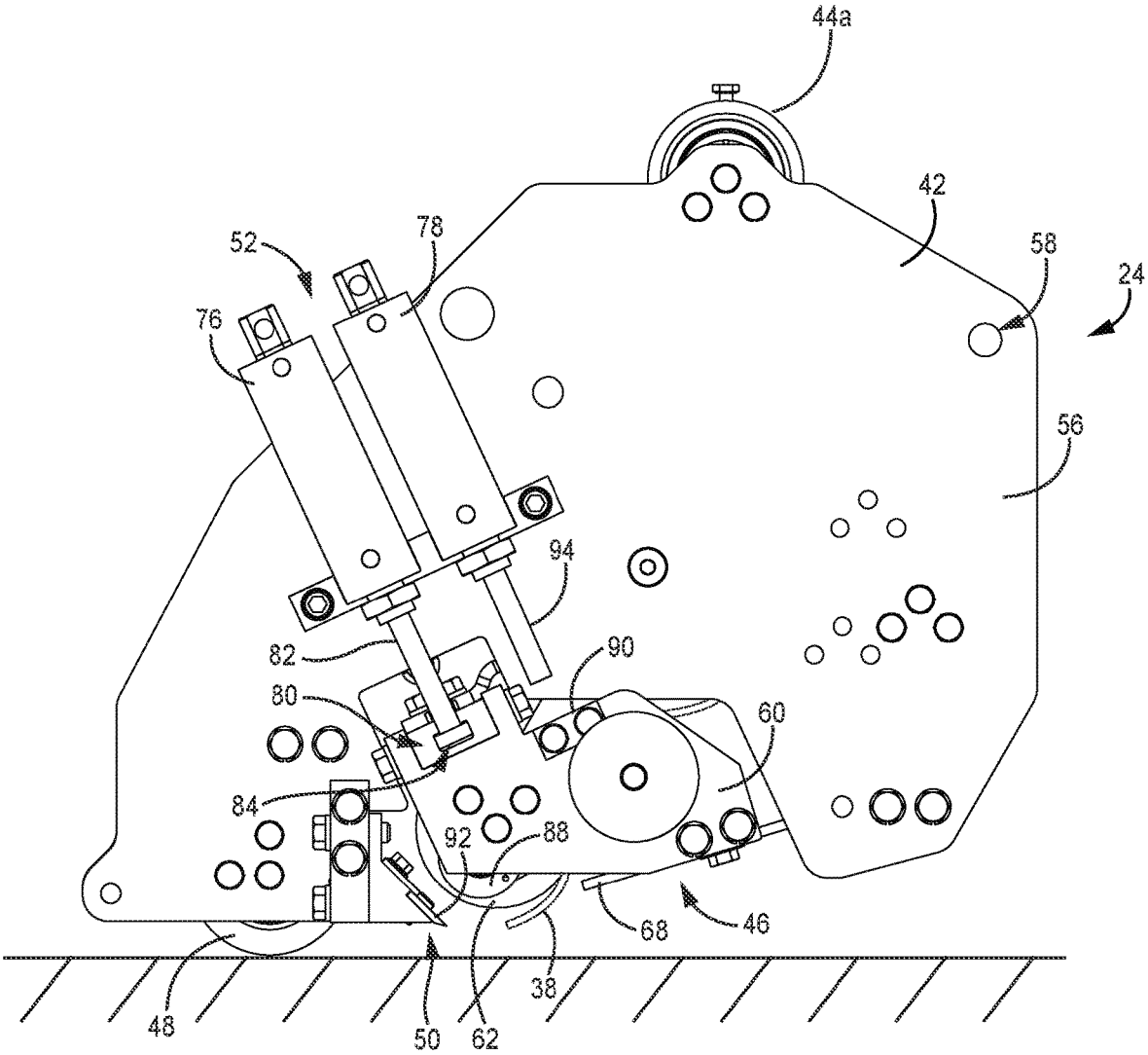
FIG. 5A is a side elevation view showing the applicator module with the roller assembly in a first position.
Figure 5B:
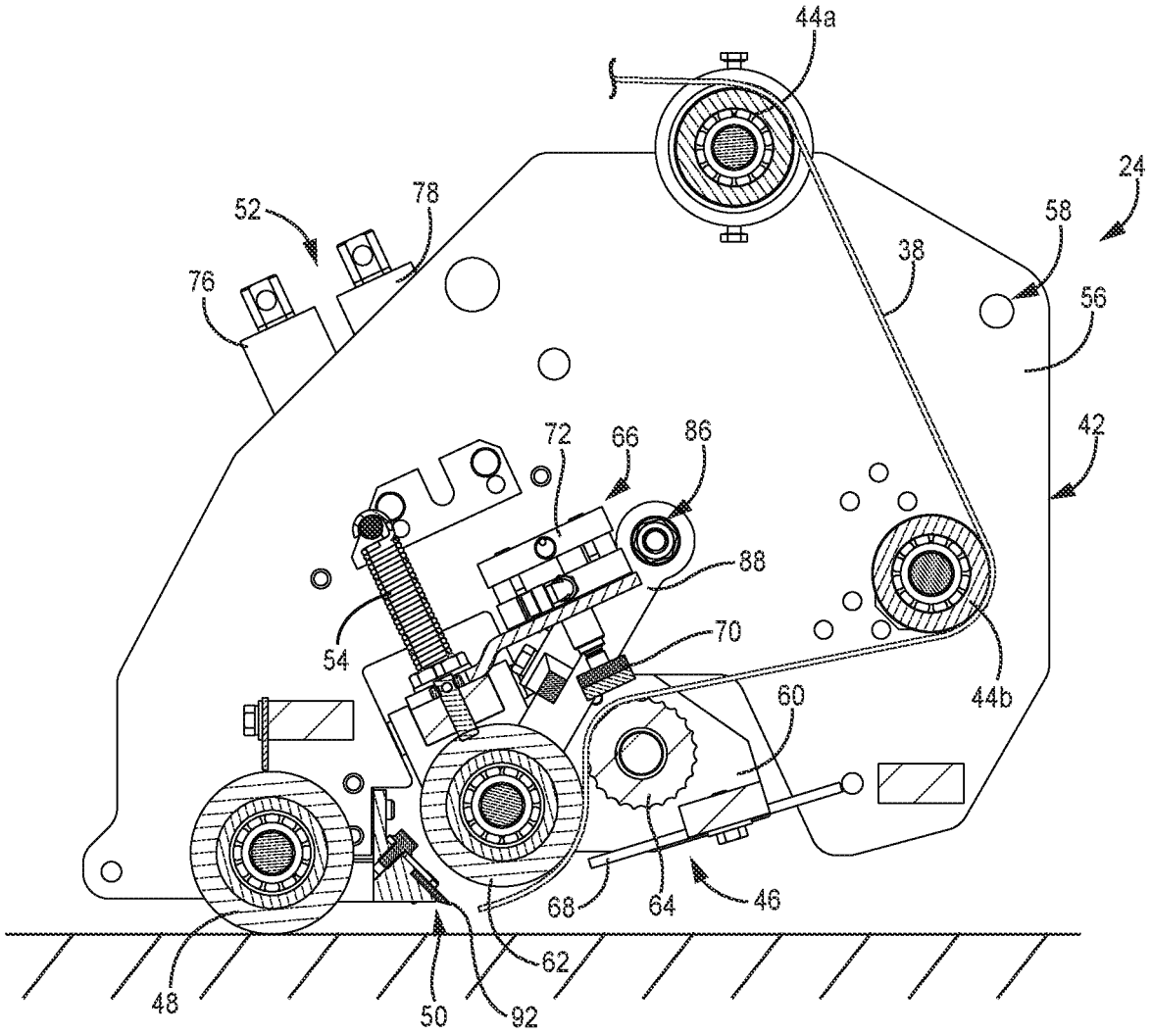
FIG. 5B is a cross-sectional side view of the applicator module with the roller assembly in the first position shown in FIG. 5A.
Figure 6A:
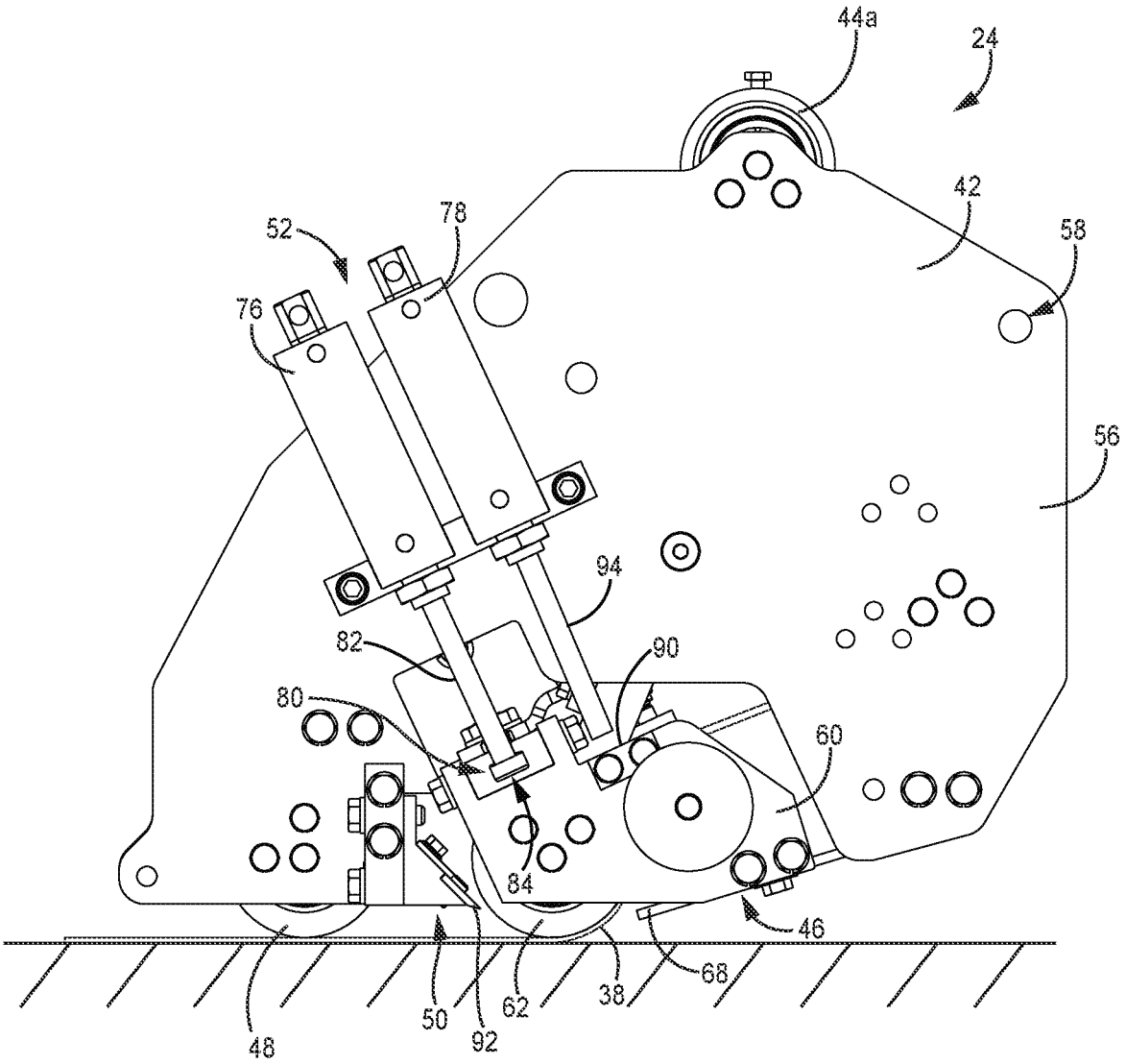
FIG. 6A is a side elevation view showing the applicator module with the roller assembly in a second position.
Figure 6B:
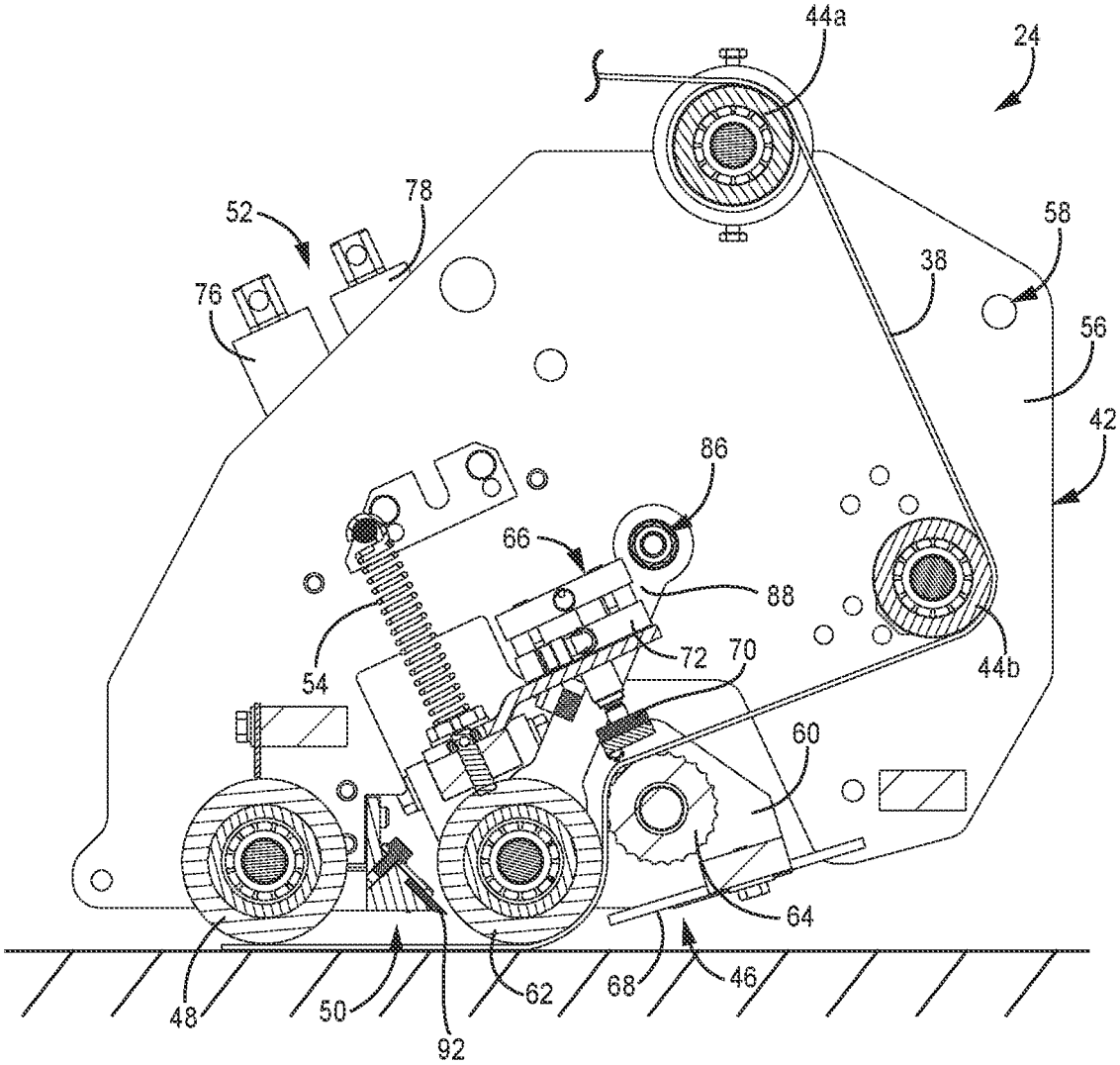
FIG. 6B is a cross-sectional side view of the applicator module with the roller assembly in the second position shown in FIG. 6A.
Figure 7A:
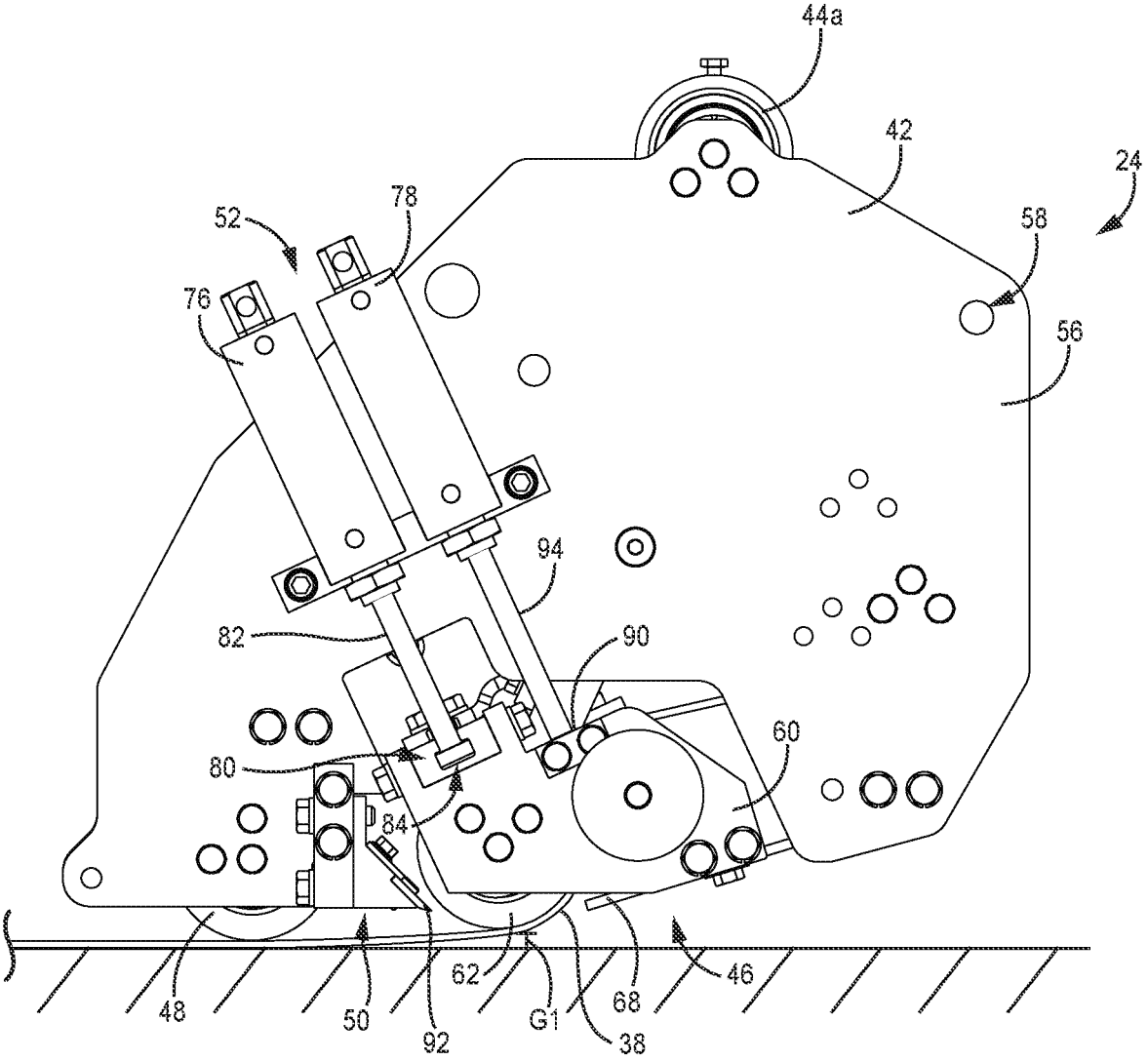
FIG. 7A is a side elevation view showing the applicator module with the roller assembly in a third position.
Figure 7B:
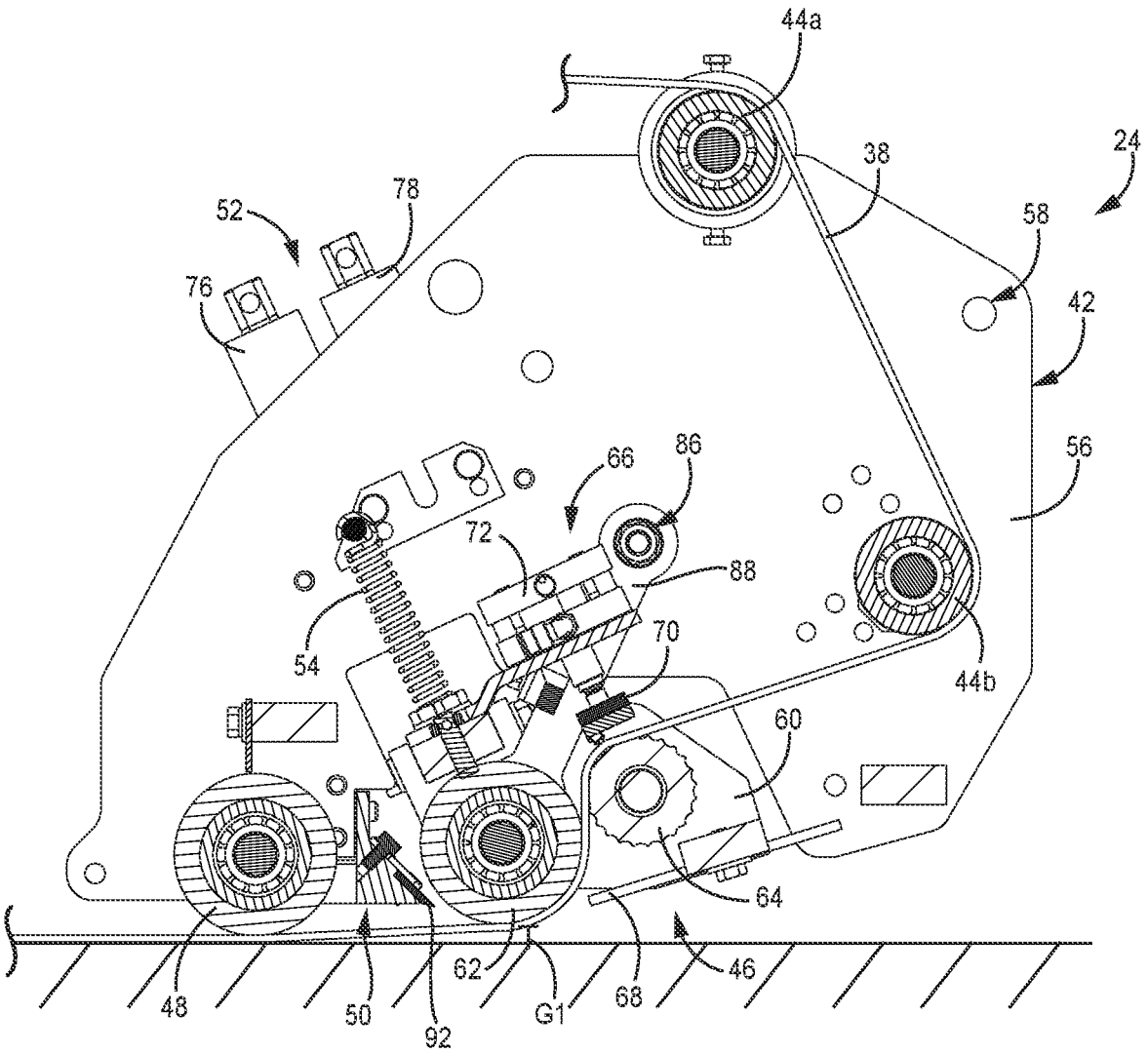
FIG. 7B is a cross-sectional side view of the applicator module with the roller assembly in the third position shown in FIG. 7A.
Figure 8A:
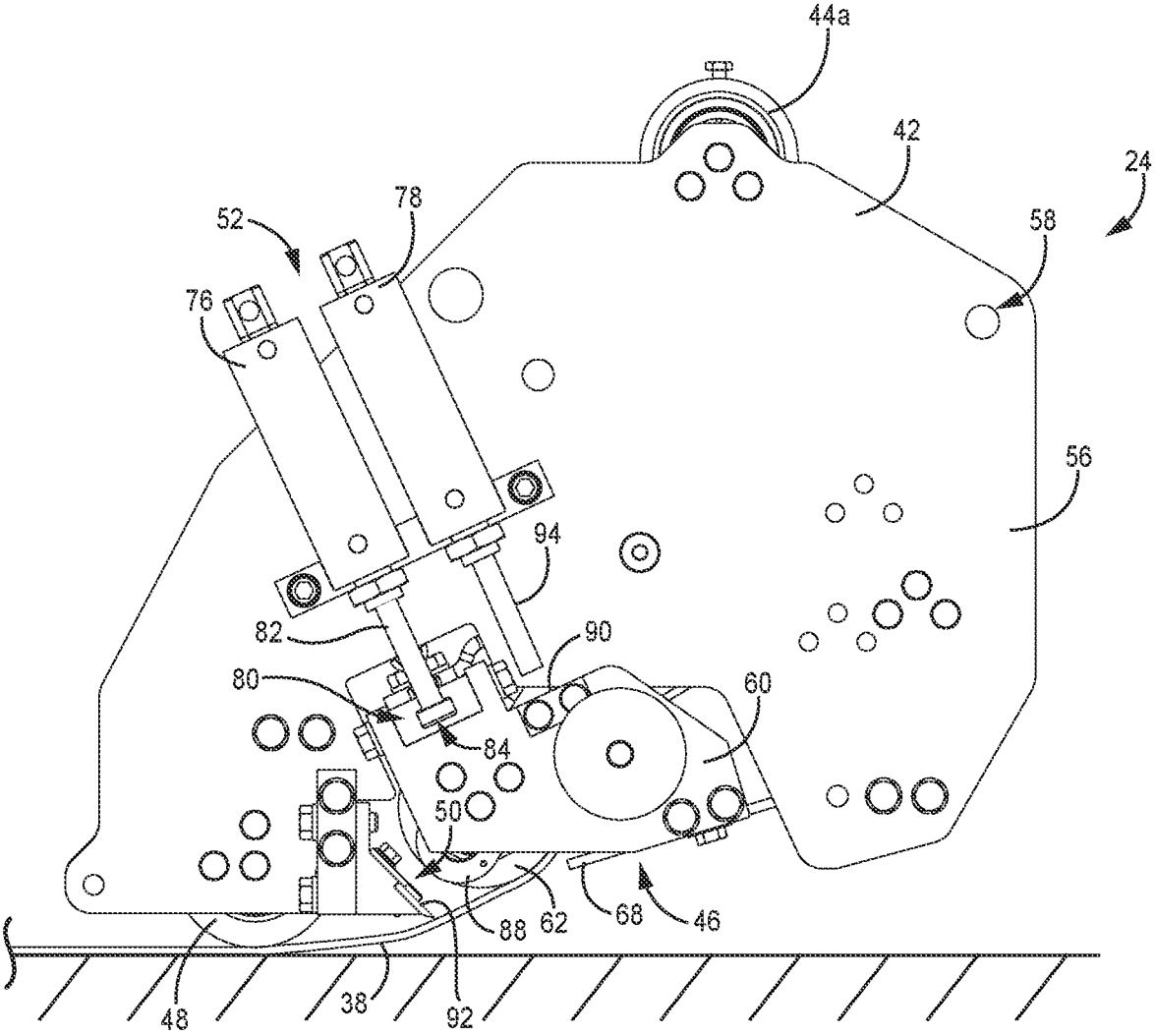
FIG. 8A is a side elevation view showing the applicator module with the roller assembly intermediate the third position and a fourth position.
Figure 8B:
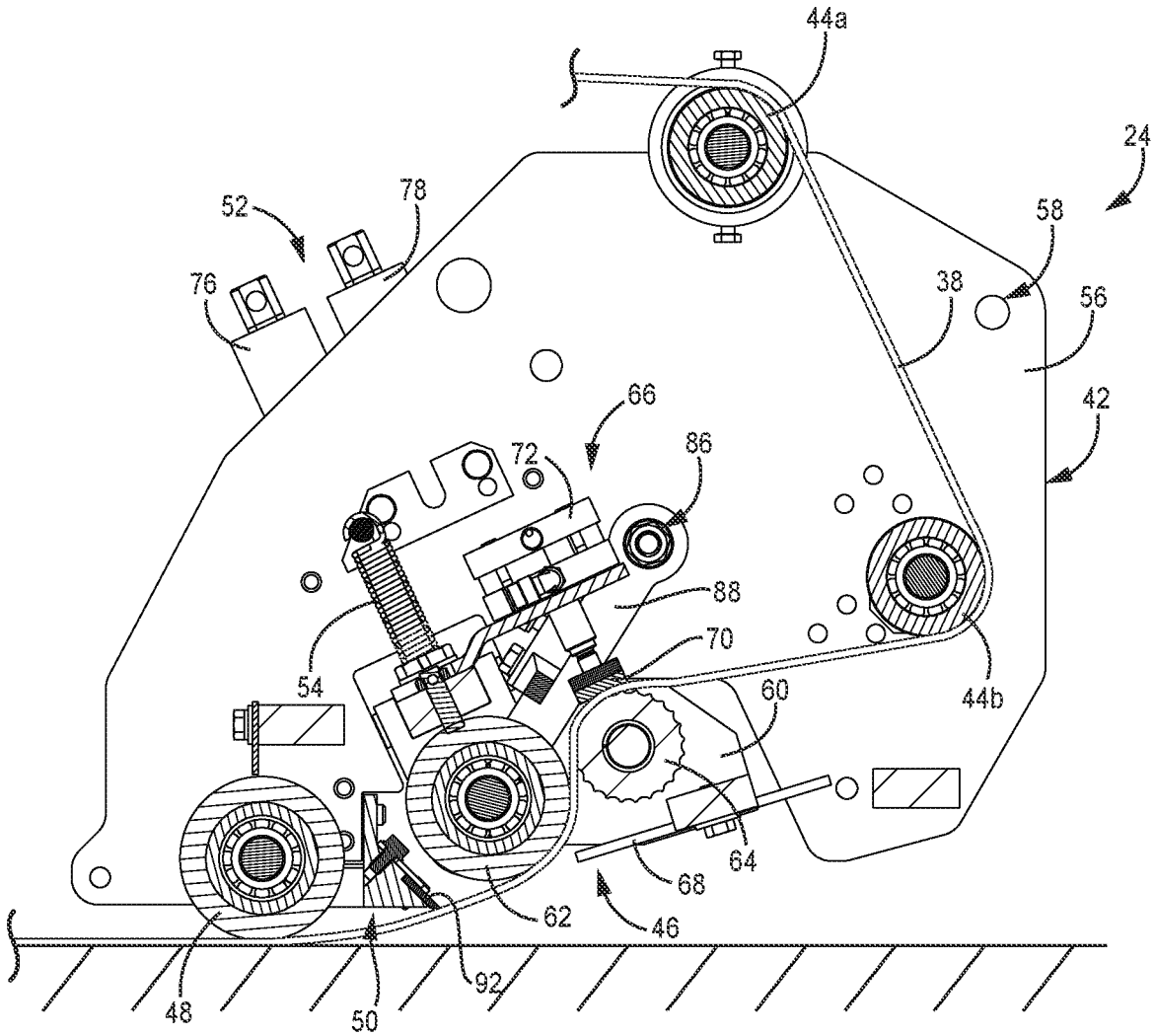
FIG. 8B is a cross-sectional side view of the applicator module with the roller assembly in the position shown in FIG. 8A.
Figure 9A:
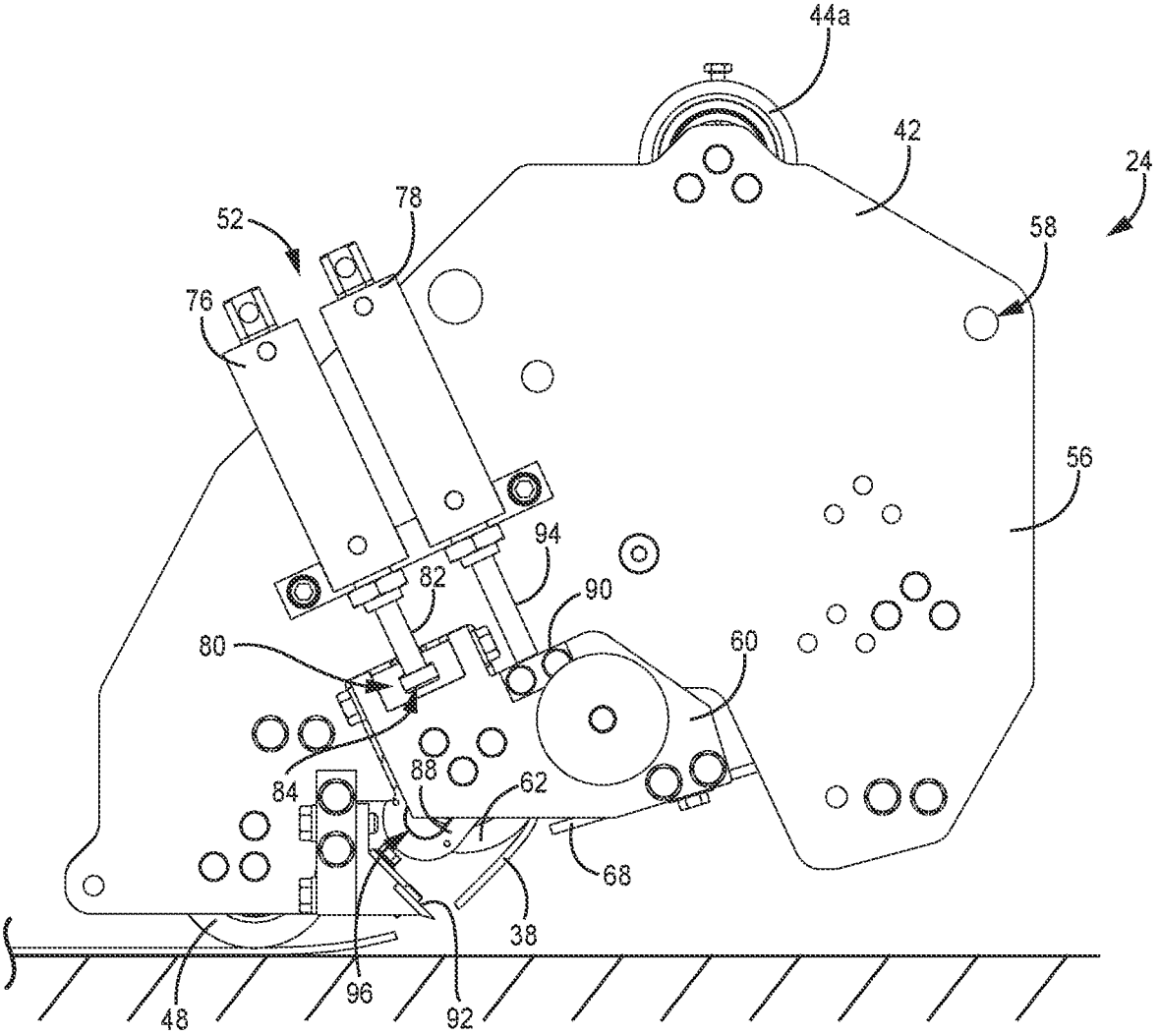
FIG. 9A is a side elevation view showing the applicator module with the roller assembly fully transitioned to the fourth position.
Figure 9B:
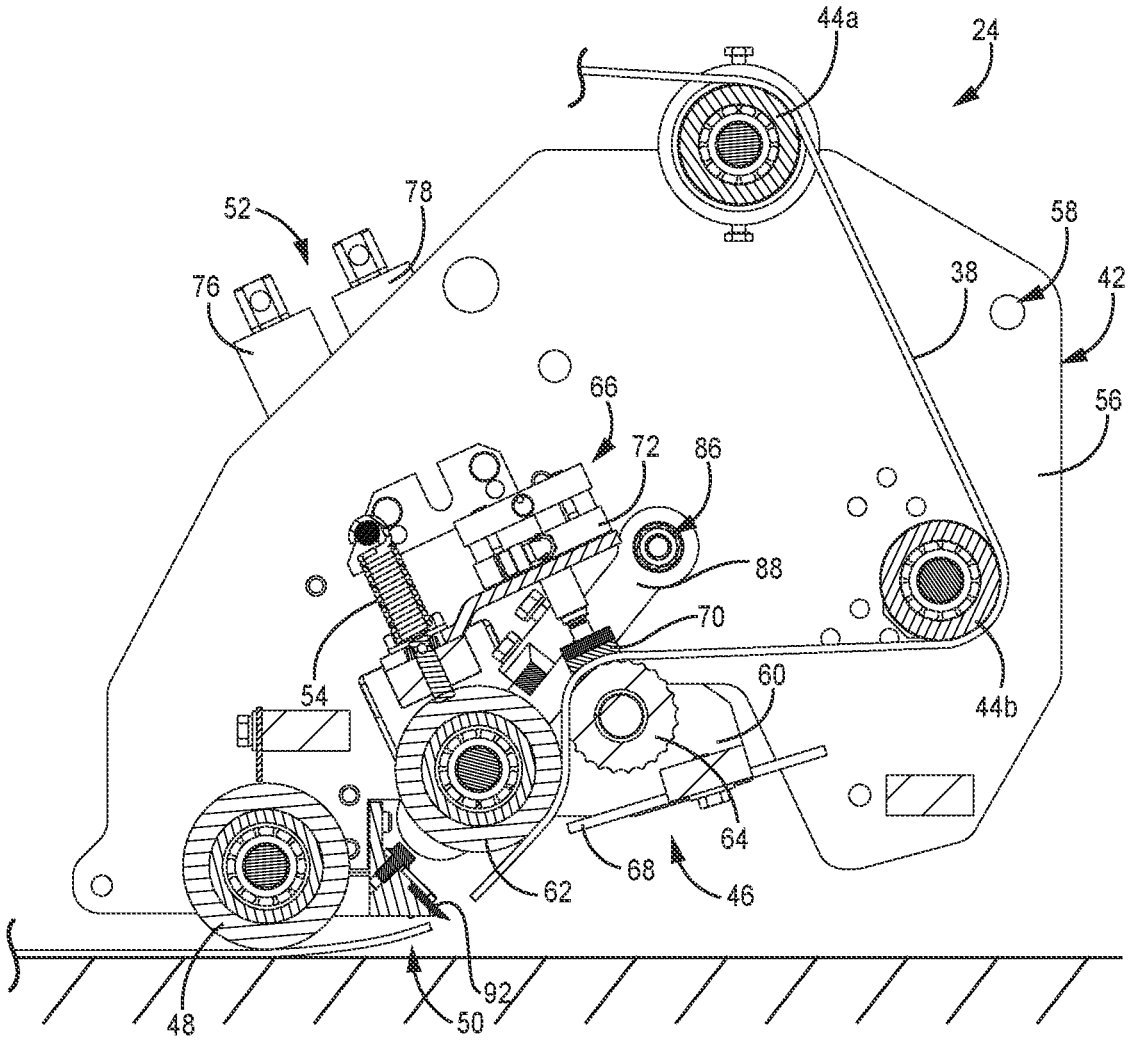
FIG. 9B is a cross-sectional side view of the applicator module with the roller assembly fully transitioned to the fourth position shown in FIG. 9A.

Roller assembly 46 can be controlled between various substates associated with various operational phases while applicator module 24 is in the second state (FIGS. 4A and 4B). Applicator module 24 is shown in the second state in each of FIGS. 5A-9B. FIGS. 5A-9B show applicator module 24 in the phases of applying stripes of adhesive tape 38 on the ground surface. FIG. 5A is a side elevation view showing applicator module 24 with roller assembly 46 in a first position. FIG. 5B is a cross-sectional side view of applicator module 24 with roller assembly 46 in the first position shown in FIG. 5A. FIG. 6A is a side elevation view showing applicator module 24 with roller assembly 46 in a second position. FIG. 6B is a cross-sectional side view of applicator module 24 with roller assembly 46 in the second position shown in FIG. 6A. FIG. 7A is a side elevation view showing applicator module 24 with roller assembly 46 in a third position. FIG. 7B is a cross-sectional side view of applicator module 24 with roller assembly 46 in the third position shown in FIG. 7A. FIG. 8A is a side elevation view showing applicator module 24 with roller assembly 46 intermediate the third position and a fourth position. FIG. 8B is a cross-sectional side view of applicator module 24 with roller assembly 46 in the position shown in FIG. 8A. FIG. 9A is a side elevation view showing applicator module 24 with roller assembly 46 fully transitioned to the fourth position. FIG. 9B is a cross-sectional side view of applicator module 24 with roller assembly 46 fully transitioned to the fourth position shown in FIG. 9A. FIGS. 5A-9B will be discussed together. In each of FIGS. 5A-9B, the "A" figure shows an exterior of the applicator module 24 while the "B" figure shows a cross-sectional view of the applicator module 24. The "A" and "B" figure of each set represents the same point in time during the application process.

Ground tape applicator 10 proceeds through a striping cycle to apply each stripe. Each stripe can be short, such as less than a foot, or long, such as ten feet or longer, or can apply stripes of any intermediate length therebetween. The stripe cycle includes a plurality of phases. The phases are shown in FIGS. 5A-9B. The stripe cycle includes a first phase, which can also be referred to as a dwell phase and is shown in FIGS. 5A-5B; a second phase, which can also be referred to as an initial tape application phase and is shown in FIGS. 6A-6B; a third phase, which can also be referred to as a float phase and is shown in FIGS. 7A-7B); and a fourth phase, which can also be referred to as a cutting phase and is shown in FIGS. 8A-9B).

Adhesive tape 38 is not applied to the ground surface during the dwell phase. The dwell phase can correspond to a period of travel during which ground tape applicator 10 transitions between the trailing end of a previous stripe and the leading end of a next stripe. The initial tape application phase sticks the leading end of the adhesive tape 38 to the ground surface to start a stripe. The middle of the stripe of adhesive tape 38 is applied to the ground surface in the float phase. In the cutting phase, the adhesive tape 38 is cut to the desired length and the trailing end of the stripe is applied to the ground surface. The stripe is formed by the continuous rolling of adhesive tape 38 on the ground surface. The striping cycle returns to the dwell phase after the cutting phase to reset for the next striping cycle. As such, the first position that corresponds with the dwell phase and the fourth position that corresponds with the cutting phase can be the same position.

Roller actuator 52 is operably connected to roller assembly 46 to actuate roller assembly 46 between the various positions and phases. Roller actuator 52 is connected to roller frame 60 and module frame 42. Lifts 54 further assist in transitioning roller assembly 46 between at least some of the positions. As such, lifts 54 can be considered to form a portion of a roller actuation module including roller actuator 52 and lifts 54. In the example shown, roller actuator 52 is formed by a first actuator 76 and a second actuator 78. The first actuator 76 and the second actuator 78 can actuate between various positions to shift the applicator roller assembly 46 between the phases. The first actuator 76 and second actuator 78 can move the applicator roller assembly 46 relative to the rest of the applicator module 24, and even more specifically, relative to the module frame 42. The first actuator 76 and the second actuator 78 can be pneumatic, electric, hydraulic, or of any desired configuration suitable for displacing roller assembly 46. For example, first actuator 76 and second actuator 78 can be pneumatic pistons, electronic solenoids, or another type of actuator. First actuator 76 and second actuator 78 are configured to cooperatively actuate roller assembly 46 between the various phases.

It is noted that, while roller actuator 52 is shown as including two actuators 76, 78 for moving the roller assembly 46 between the phases, and thus applicator roller 62 between the phases, in some embodiments only a single actuator is used. Regardless of whether single or multiple individual actuating components are used, one or more of the actuating components can be a multistage actuator that can move to and maintain three or more different positions of the applicator roller 62. For example, roller actuator 52 can include single actuators configured to move to and maintain different positions associated with each of the dwell phase, the initial tape application phase, and the float phase, and can move between each of the positions.

Applicator roller 62 is mounted to the applicator roller assembly 46 and is movable with roller assembly 46 relative to applicator module 24. In the example shown, first actuator 76, which can also be referred to as the aft actuator or rear actuator, is connected to roller assembly at coupling 80. Coupling 80 is formed between the first piston 82 of first actuator 76 and roller assembly 46. More specifically, coupling 80 is formed between the distal end of first piston 82 and a receiver 84 formed on roller assembly 46. A head formed by a radial projection at the distal end of first piston 82 is disposed in a slot forming the receiver 84 on roller assembly 46. Coupling 80 is configured to facilitate first actuator 76 being able to exert a pushing force on roller assembly 46 (e.g., to drive roller assembly 46 towards the ground surface) and to facilitate first actuator 76 being able to exert a pulling force on roller assembly 46 (e.g., to drive roller assembly 46 away from and out of engagement with the ground surface). While coupling 80 is shown as a slotted engagement, it is understood that coupling 80 can be formed in any desired manner such that first piston 82 can exert both pushing and pulling forces on roller assembly 46, such as a pinned connection, a threaded connection, etc.

Second actuator 78, which can also be referred to as the fore actuator or front actuator, is not directly couped to the roller assembly 46, in the example shown. Second actuator 78 is configured such that the movable component of second actuator 78 can only brace and/or push the roller assembly 46 without pulling the roller assembly 46 upwards. In the example shown, the second piston 94 of second actuator 78 can interface with roller assembly 46 to prevent upward movement or to push roller assembly 46 downward, but is not able to pull roller assembly 46 upward. As such, first actuator 76 can be considered to be a two-way or bidirectional actuator and second actuator 78 can be considered to be a one-way or unidirectional actuator. It is understood, however, that in some examples second actuator 78 can be a bidirectional actuator movable relative to roller assembly 46. For example, the distal end of second piston 94 can be connected to roller assembly 46 at a slotted interface (shown in FIG. 13A) that permits relative movement along the reciprocation axis of second piston 94 for part of the reciprocation range. In such an example, the slot can allow relative movement to facilitate connection but also use of multiple actuating components.

Module frame 42 interfaces with roller frame 60 at interface 86. In the example shown, support 88 interfaces with side plate 56 of module frame 42 at interface 86. Support 88 can be of any desired configuration for guiding roller actuator 52 between the various phases as roller actuator 52 moves relative to module frame 42. In some examples, support 88 is formed by one or more arms pivotably connected to module frame 42. In some examples, support 88 is formed by a bracket interfacing with a portion of module frame 42, such as a bracket interfacing with a projection extending relative to or formed by module frame 42, as discussed in more detail below. The bracket can interface with the portion of the module frame 42 to secure roller assembly 46 relative to module frame 42.

Support 88 guides roller assembly 46 between the various positions shown in FIGS. 5A-9B. Support 88 limits motion of roller assembly 46 along a predetermined pathway. In some examples, support 88 can limit motion of roller assembly 46 to linear motion as roller assembly 46 moves between the various positions. In some examples, roller assembly 46 is configured to move linearly along a displacement axis, which can be aligned with (e.g., parallel with) an axis along which one or more components of roller actuator 52 displace. For example, the displacement axis can be parallel with the axis along which the first piston 82 of first actuator 76 reciprocates and/or parallel with the axis along which the second piston 94 of second actuator 78 reciprocates. In the example shown, a pair of arms are pivotably connected to the side plates 56 of module frame 42 and are connected to roller frame 60. The arms each include slots 96 (best seen in FIG. 9A) that allows for relative movement between the arms forming support 88 and roller assembly 46. The slots 96 allow for relative movement to facilitate linear motion of roller assembly 46 between the various phases rather than roller assembly 46 moving in a non-linear manner. The linear movement reduces side loading on the components of roller actuator 52, decreasing wear and increasing operational life. In some examples, support 88 can limits movement of roller assembly 46 such that roller assembly 46 pivots between the various positions shown in FIGS. 5A-9B.

During operation, applicator module 24 is placed in the second (e.g., deployed) state. Roller assembly 46 is controlled between various positions to transition through the phases shown in FIGS. 5A-9B to apply full length stripes of adhesive tape 38 to the ground surface. A sample application event including a striping cycle is discussed in more detail below, by way of example.

Applicator module 24 is placed in the second state and is initially in the dwell phase shown in FIGS. 5A and 5B. With applicator module 24 in the dwell phase, tamper roller 48 is disposed to engage the ground surface (e.g. rolling along the ground surface) while the applicator roller 62 is in an up, retracted position. Applicator roller 62 is disengaged from the ground surface and spaced vertically above the ground surface. As such, applicator roller 62 is isolated from the ground surface such that applicator roller 62 does not experience any wear caused by rolling along the ground surface.

Applicator roller 62 is in the first position during the dwell phase. The first position can be spaced vertically and longitudinally from the positions associated with one or more other phases of the second state. Spacing the first position both vertically and longitudinally relative to the second position facilitates module frame 42 supporting at least some of the weight of roller assembly 46, such as at interface 86 and, in some examples via support 88, thereby reducing the work required by roller actuator 52, increasing the life of roller actuator 52, and decreasing maintenance costs. Linearly shifting roller assembly 46 between the phases aligns forces along the actuation axis of roller actuator 52 (e.g., along the reciprocation axis of one or both of first piston 82 and second piston 94) preventing side loading on the actuating components of roller actuator 52 (e.g., first actuator 76 and second actuator 78). Linearly aligning the reciprocation axis of roller assembly 46 with the reciprocation axis of roller actuator 52 to be parallel thereby reduces wear on first actuator 76 and second actuator 78.

Adhesive tape 38 partially wraps around applicator roller 62 between tape spool 20 and tamper roller 48. Guides 68 are disposed to maintain the adhesive tape 38 in a desired position within roller assembly 46 after cutting and prior to beginning the next stripe. Guides 68 are positioned to prevent the free end of adhesive tape 38 from wrapping over onto itself or under adhesive-side roller 64. The ground tape applicator 10 may be moved around to line up with the next stripe while in the state shown in FIGS. 5A and 5B. In this state, the first actuator 76 holds the applicator roller assembly 46 in the first position relative to the applicator module frame 42. In some cases, the first actuator 76 can be activated to exert a pulling, upward force on the applicator roller assembly 46, to maintain the applicator roller assembly 46 in the first position. In some examples, one or both of first piston 82 and second piston 94 can be in a passive state (e.g., deenergized) while applicator roller assembly 46 is maintained in the first position. For example, lifts 54 can be configured to maintain applicator roller assembly 46 in the first position.

Ground tape applicator 10 is maneuvered to a start position for applying a stripe of adhesive tape 38 to the ground surface. FIGS. 6A and 6B show a state in which the applicator roller assembly 46 is displaced vertically downward relative to the first position shown in FIGS. 5A and 5B. Roller actuator 52 displaces roller assembly 46 to the second position in which applicator roller 62 presses adhesive tape 38 onto the ground surface. Applicator module 24 is in the initial tape application phase while in the state shown in FIGS. 6A and 6B.

In the example shown, first actuator 76 drives roller assembly 46 to the second position. In some cases, the second actuator 78 can also push the roller assembly 46 downward for at least part of the displacement range between the first position and the second position. For example, second piston 94 can engage with stop 90 to exert the downward force. As shown in FIG. 6A, applicator roller assembly 46 is configured such that applicator roller assembly 46 is disposed further downward and beyond the reach of the second actuator 78 with applicator roller assembly 46 in the second position. As such, roller assembly 46 can be spaced vertically relative to the distal end of second piston 94. At least as driven by the first actuator 76, this moves the applicator roller 62 and the adhesive-side roller 64 vertically downward. With roller assembly 46 in the second position, the applicator roller 62 moves the adhesive tape 38 downward towards the ground surface to cause the adhesive side of the leading end of the adhesive tape 38 to engage with and adhere to the ground surface.

Before or at the same time that the adhesive tape 38 engages the ground surface due to the applicator roller 62 moving downward, the ground tape applicator 10 moves forward, which is toward the right in FIGS. 5A-9B. The adhesive tape 38 adheres to the ground surface and the adhesion and forward motion of the ground tape applicator 10 cause the adhesive tape 38 adhered to the ground surface to pull more adhesive tape 38 through the rollers of the applicator module 24 from the tape spool 20. The adhesive tape 38 pushed onto the ground surface by the applicator roller 62 is soon run over by the tamper roller 48 which also presses the adhesive side of the adhesive tape 38 against the ground surface to ensure adhesion therebetween. The cooperative application by applicator roller 62 and tamper roller 48 can be used to start a stripe of adhesive tape 38. More specifically, the initial tape application phase sticks and adheres the leading end of the stripe formed by the adhesive tape 38 to the ground surface.

After applying the leading end of the stripe, roller assembly 46 is actuated to the third position intermediate the first position and the second position. In the third position, applicator roller 62 is disengaged from the ground surface while tamper roller 48 remains engaged with and continues to roll along the ground surface. FIGS. 7A and 7B show the roller assembly 46 in the third position during the float phase of the adhesive tape application process. The phase of operation shown in FIGS. 7A and 7B can be referred to as the float phase because the applicator roller 62 floats above the ground surface near the ground surface to guide the adhesive tape 38 near the ground surface but without directly applying the tape 38 to the ground surface.

Roller actuator 52 actuates roller assembly 46 to the third position. In the example shown, first actuator 76 ceases pushing downward on the applicator roller assembly 46 during the transition to the float phase. For example, first actuator 76 can be deenergized (e.g., compressed air is vented from the cylinder in examples where first actuator 76 is pneumatic). In this state, the lifts 54 exert an upward force on roller assembly 46 to displace roller assembly 46 vertically upward relative to module frame 42, thus moving applicator roller 62 upwards and away from the ground surface. Roller assembly 46 displaces vertically away from the ground surface until stop 90 engages with second actuator 78, which is still in its actuated state. Second actuator 78 can remain energized with applicator roller 62 in the position associated with the float phase to maintain applicator roller 62 in that desired position.

Second actuator 78 engaging stop 90 prevents further relative upward movement of roller assembly 46, such that roller actuator 52 maintains roller assembly 46 in the third position. With roller assembly 46 in the third position, the applicator roller 62 does not press the adhesive tape 38 that is moving past the applicator roller 62 (e.g., in contact with the applicator roller 62) against the ground surface. Instead, the applicator roller 62 positions the adhesive tape 38 proximate to, but disengaged from, the ground surface. A gap G1 is formed between the ground surface and applicator roller 62 with roller assembly 46 in the position associated with the float phase. The gap G1 can be, in some examples, about 0.5 inches, though it is understood that the gap G1 can be of any desired distance. While first actuator 76 is described as being deenergized, it is understood that roller actuator 52 can be of any configuration suitable for actuating roller assembly 46. In some examples, first piston 82 can be powered to actively displace roller assembly 46 to the third position, in addition to or alternatively to lifts 54 displacing roller assembly 46.

Applicator roller 62 guides the adhesive tape 38 to the ground surface, but the adhesive side of the part of the adhesive tape 38 that is directly contacting the applicator roller 62 does not contact the ground surface until that part of the adhesive tape 38 has moved away from the applicator roller 62 (leftward in this view). As such, no portion of the adhesive tape 38 is concurrently in direct contact with both the applicator roller 62 (on the top, non-adhesive side of the adhesive tape 38) and the ground surface (on the bottom, adhesive side of the adhesive tape 38). While the applicator roller 62 does not directly apply the adhesive tape 38 to the ground surface in the float phase, the tamper roller 48 does. The tamper roller 48 contacts the top side of the adhesive tape 38 and firmly presses against the adhesive tape 38 to press the adhesive side against the ground surface as the adhesive tape 38 moves directly between the tamper roller 48 and the ground surface.

While the initial application phase may dispense the first part of a stripe of adhesive tape 38 to the ground surface, it is anticipated that most of the length of the stripe of adhesive tape 38 will be applied with roller assembly 46 in the float phase. For example, the initial application phase can be completed based on a threshold. In some examples, the threshold can be a temporal threshold that extends for only a limited time (e.g., less than 5 seconds, or less than 10 seconds, or some other amount of time). In some examples, the threshold can be a distance threshold that extends for only a limited distance of travel corresponding to the amount of adhesive tape 38 laid (e.g., five inches or less, six inches or less, ten inches or less, a foot or less, etc.). In some examples, a controller (e.g., control module 34) can be configured to automatically transition roller assembly 46 between the various positions and operational phases. The controller can transition roller assembly 46 based, at least in part, on one or more of inputs from the user (e.g., when to start a stripe, how long the stripe should be, when to stop a stripe, etc.).

After applying the main body portion of the stripe (e.g., the portion between the leading end portion and trailing end portion) during the float phase, ground tape applicator 10 transitions to applying the trailing end portion. FIGS. 8A-9B show a cutting phase of the stripe application cycle. The cutting phase corresponds with the trailing edge of a stripe of adhesive tape 38 being applied to the ground surface. The adhesive tape 38 is cut to form the trailing edge and define the length of the stripe. FIGS. 8A-8B show a first part of the cutting phase in which the applicator roller assembly 46 is moved upwards. FIGS. 9A-9B show a second part of the cutting phase in which the adhesive tape 38 is brought against and cut by cutter 50.

The movement of the applicator roller assembly 46 through the cutting phase can be due to release of the second actuator 78, which had been engaging the stop 90 to brace the applicator roller assembly 46 in position associated with the float phase, and due to the lifts 54 pulling the applicator roller assembly 46 upwards. For example, second actuator 78 can be deenergized such that neither first piston 82 nor second piston 94 exert a downward force and/or resist upward movement of roller assembly 46. Additionally or alternatively, the first actuator 76 can be engaged (e.g., energized) to displace the roller assembly 46 vertically upwards. In either case, the retraction can be a partial or full retraction of the applicator roller assembly 46 to the starting position of the applicator roller assembly 46 shown in FIGS.

5A and 5B, the starting position associated with the dwell phase. In the view of FIGS. 8A and 8B, the actuator roller assembly 46 is moving upwards between the third position associated with the float phase and the fourth position associated with the end of the cutting phase, which fourth position can be the same as the first position in some examples. In some examples, roller assembly 46 does not stop in the position shown in FIGS. 8A and 8B but instead continuously displaces from the third position to the fourth position. The upward movement of roller assembly 46 brings the adhesive tape 38 towards cutter 50.

Cutter 50 is part of the applicator module 24. Cutter 50 can be and/or include a cutting blade 92. The blade 92 can be a serrated blade, among other options. The blade 92 of cutter 50 can be configured to span wider than the adhesive tape 38 so that the entire width of the adhesive tape 38 is cut. FIGS. 8A and 8B shows the adhesive tape 38 just before it is cut by engagement with the cutter 50.

In the example shown, cutter 50 stays stationary while the adhesive tape 38 is moved to engage cutter 50 by movement of the roller assembly 46. In particular, the adhesive tape 38 wraps around the applicator roller 62 and the adhesive-side roller 64 so that the adhesive tape 38 moves upward with the applicator roller assembly 46. The tamper roller 48 stays stationary relative to the applicator module 24, except for potential rolling along the ground surface, so that the path along which the adhesive tape 38 extends moves to intersect the cutter 50.

Applicator module 24 is configured to secure the adhesive tape 38 during the cutting process. Portions of adhesive tape 38 on either side of cutter 50 are braced to secure the position of the adhesive tape 38. In the example shown, a first potion of the adhesive tape 38 is clamped between tamper roller 48 and the ground surface and a second portion of the adhesive tape 38 is clamped between the adhesive-side roller 64 and brake assembly 66.

Brake assembly 66 is configured to brace the second portion of the adhesive tape 38 against the adhesive-side roller 64. More specifically, brake 70 engages the top side of the adhesive tape 38 and presses the bottom side of the adhesive tape 38 into the adhesive-side roller 64. Brake 70 can extend laterally within roller assembly 46. Brake 70 can be sized to span a width equal to or greater than a maximum width of adhesive tape 38. Brake 70 can, in some examples, be formed by multiple components connected together. Brake 70 can be and/or include a rubberized surface that moves toward the adhesive-side roller 64 to pinch the adhesive tape 38 between the brake 70 and the adhesive-side roller 64. The brake 70 is moved between the engaged state, during which brake 70 pinches the adhesive tape 38 against adhesive-side roller 64, and the disengaged state, during which brake 70 is spaced from adhesive-side roller.

Brake actuator 72 is operably connected to brake 70. Brake actuator 72 is configured to interface with brake 70 to drive brake 70 between the engaged and disengaged states. Brake actuator 72 can be a pneumatic piston, electronic solenoid, or other type of controlled actuator. Brake actuator 72 can push brake 70 to the engaged state and maintain brake 70 in the engaged state. Brake actuator 72 can pull brake 70 to the disengaged state and maintain brake 70 in the disengaged state.

The pinching of the adhesive tape 38 between the brake 70 and the adhesive-side roller 64 stops further adhesive tape 38 from being moved past the adhesive-side roller 64, which helps create tension in the span of adhesive tape 38 between applicator roller 62 and tamper roller 48 to facilitate cutting of the adhesive tape 38 by the cutter 50. The brake actuator 72 can be disengaged from the adhesive tape 38 during each of the other operating phases while being engaged to pinch the adhesive tape 38 during the cutting phase. Brake actuator 72 can be deactivated or otherwise released after the cutting phase such that brake 70 disengages from the adhesive tape 38 and from the adhesive-side roller 64. Brake 70 disengaging allows movement of the adhesive tape 38 over and past the adhesive-side roller 64 after the cut is made.

FIGS. 9A and 9B show point later in time during the cutting phase relative to the first part of the cutting phase shown in FIGS. 8A and 8B. In the later part of the cutting phase shown in FIGS. 9A and 9B, the applicator roller assembly 46 has been moved further vertically upward by the roller actuator 52 (e.g., by first actuator 76 and/or lifts 54) while the adhesive tape 38 is kept in tension between the brake 70 and the tamper roller 48 as the adhesive tape 38 is pulled against blade 92. Pulling the tensed adhesive tape 38 over blade 92 causes the adhesive tape 38 to be cut by the blade 92 of cutter 50. The clamping of adhesive tape 38 on opposite relative sides of cutter 50 facilitates efficient and clean cutting of the adhesive tape 38. The clamping prevents additional length of adhesive tape 38 from being pulled into the region between applicator roller 62 and tamper roller 48, thereby facilitating pulling the adhesive tape 38 against blade 92 to cut the adhesive tape 38. Roller assembly 46 can be configured to increase the tension in adhesive tape 38 as roller assembly 46 transitions through the cutting phase. The increased tension facilitates cutting of the adhesive tape 38, making for a more efficient cutting process and a clean cut at the end of the stripe. A clean cut provides a uniform end surface of the stripe, facilitating adhesion and providing structural integrity. The clean cut prevents fraying and other damage at the end of the stripe, which can be visually unappealing and harms the integrity of the stripe. The tensed adhesive tape 38 further facilitates ease of cutting by blade 92, increasing the operational life of blade 92 and reducing maintenance costs.

In the example shown, only the top (i.e., non-adhesive) side of adhesive tape 38 directly engages the cutter 50. Each cut is initiated by contact between blade 92 and the top side of the adhesive tape 38. Such a cutting configuration prevents the cutter 50 from being gummed up or otherwise clogged by the adhesive from the adhesive tape 38, which clogged condition could occur if some or all of the cutter 50 engaged from the bottom, adhesive side of the adhesive tape 38. The cutting arrangement increases the operational life of blade 92 and increases the interval length between servicing, thereby reducing downtime and increasing job efficiency.

After the cut, the ground tape applicator 10 continues moving forward to move the tamper roller 48 over the entirety of the strip of adhesive tape 38 being applied. The other end of the adhesive tape 38 that is still attached to the rest of the tape spool 20 will terminate at a position along the applicator roller 62. That terminal end of the adhesive tape 38 extending from tape spool 20 is positioned to form the leading end of the next stripe to be initiated and applied by ground tape applicator 10. In other words, following the cutting phase of FIGS. 8A-9B, the ground tape applicator 10 will be at the position shown in FIGS. 5A and 5B and in the dwell phase. The terminal end of the adhesive tape 38 is positioned relative to and along the applicator roller 62 so that the end of the adhesive tape 38 becomes the leading end of the next stripe when the stripe application cycle exits the dwell phase and enters the initial tape application phase. Applicator module 24 is thus in the dwell phase and prepared to apply another stripe of adhesive tape 38.

Applicator roller 62 does not directly apply the adhesive tape 38 to the ground surface during various of the operational phases, including during application of the intermediate and end portions of the adhesive tape. Instead, tamper roller 48 applies the adhesive tape 38 directly to the ground surface. With applicator roller 62 elevated, roller assembly 46 is configured such that a gap is disposed between the adhesive, bottom side of the adhesive tape 38 and the ground surface along the length of adhesive tape 38 extending between applicator roller 62 and tamper roller 48. The gap facilitates clean cutting of adhesive tape 38 and facilitates adhesion on the ground surface.

The configuration of applicator roller 62 and tamper roller 48 allows the adhesive tape 38 to be pulled upwards through the cutting phase without unsticking any portion of the adhesive tape 38 from the ground surface to make the cut in the adhesive tape 38. For example, in an alternative embodiment the applicator roller 62 rolls against the adhesive tape 38 and directly applies the adhesive tape 38 to the ground surface until the cutting phase when applicator roller 62 moves upward. The upward movement of the applicator roller 62 (e.g., in addition to engagement of the brake assembly 66 to clamp the adhesive tape 38) would cause at least a portion of the adhesive tape 38 between applicator roller 62 and tamper roller 48 that had not already been run over by the tamper roller 48, but had been pressed against the ground surface by the applicator roller 62, to be unstuck from the ground surface. The adhesive of the adhesive tape 38, which would have already been driven into the ground surface by applicator roller 62, would be pulled away from and unstuck from the ground surface to allow the adhesive tape 38 to be moved upwards to engage the cutter 50. The trailing end would then be reapplied to the ground surface by the tamper roller 48.

The gap between adhesive tape 38 and ground surface avoids the weakened adhesion caused by sticking, and unsticking, and then re-sticking part of the adhesive tape 38 to the ground surface. The reapplication process can lead to premature failure of the adhesive tape 38. Elevating applicator roller 62 during the application process (e.g., during the float phase) prevents weakened adhesion and associated premature failure by holding the adhesive tape 38 close to the ground surface to help guide the adhesive tape 38 to the tamper roller 48 but not touch the adhesive tape 38 to the ground surface before the tamper roller 48. The adhesive tape 38 can thus still move upward to engage the cutter 50 without having to be unstuck from the ground surface after having previously been stuck to the ground surface.

The applicator roller 62 being movable to engage the ground surface during the initial application phase facilitates accurate, uniform stripe placement. Applicator roller 62 moves downward to press the adhesive tape 38 against the ground surface to stick the leading end of the stripe, thereby accurately placing the leading end of the stripe at the precise spot that the stripe is intended to start. Applicator roller 62 directly presses the leading end into the ground surface such that there is little to no free length of adhesive tape 38 between applicator roller 62 and tamper roller 48 during the initial application phase. Eliminating the free, unpressed length prevents the adhesive tape 38 from wrinkling or otherwise folding on itself and prevents the leading end from being misaligned relative to the remainder of the stripe. Applicator roller 62 directly pressing the leading end thereby prevents misapplication, prevents folds that form weak points that can lead to failures, and provides a visually appealing and aligned leading end of the stripe.

A controller (e.g., control module 34 or other logic circuitry) can control one or more of the actuators referenced herein. The controller can be responsive to an input of the user interface 16. For example, a switch or other type of input can be selected by a user to initiate the initial tape application phase, transitioning roller assembly 46 out of the dwell phase. Based on a timer or distance sensor (e.g., hall sensor or encoder measuring wheel rotation (e.g., rotation of wheel 14*a* or wheel 14*b*) or rotation of a roller (e.g., a guide roller 44, adhesive-side roller 64, applicator roller 62, and/or tamper roller 48)), among other options, the controller can automatically cause roller actuator 52 to transition roller assembly 46 to the float phase. For example, the initial application threshold associated with a duration of the initial application phase can be temporal (e.g., one second) or distance-based (e.g., six inches of travel), amongst other options. The controller of the ground tape applicator 10 can be programmed, such as via the user interface 16, with an application parameter (e.g., a duration of application or length, of application) for each stripe. Based on the application parameter, and the length of the leading end of the stripe from the initiation stripe application phase (e.g., also programmable by the user), the duration or distance traveled during the float period can be monitored (e.g., by a timer and/or by an encoder measuring rotation (e.g., of a wheel and/or roller)) to transition the operation of the ground tape applicator 10 to the cutting phase. The controller can automatically transition ground tape applicator 10 to and through the cutting phase based on the application parameter and the travel data (e.g., the time or distance). Alternatively, a switch or other type of input, such as formed on or by user interface 16, can be selected by a user to initiate the cutting phase. Ground tape applicator 10 can thus be configured to allow the user to manually select the length of each stripe during application.

In some examples, the movement of the applicator roller assembly 46, and the applicator roller 62, can be linear between the phases. The first actuator 76 can move the applicator roller assembly 46, and thus the applicator roller 62, linearly from being disengaged from the ground surface during the dwell phase to being engaged with the ground surface during the initial application phase. The first actuator 76 and/or lifts 54 move the applicator roller assembly 46, and thus the applicator roller 62, linearly through the cutting phase. Such linear movement can minimize the overall travel, such as compared to the pivoting, arching, or sweeping motion of the applicator roller assembly 46 and the applicator roller 62. Such linear motion quickly applies and releases the adhesive tape 38, as compared to more complicated motions. Such linear motion avoids any scraping motion of the adhesive tape 38 on and relative to the ground surface when applied by the applicator roller 62, which would otherwise degrade the adhesion of the adhesive tape 38 on the ground surface. Such motion is also able to make a crisper, cleaner cut to the adhesive tape 38 as compared to a less direct, non-linear motion. The applicator roller assembly 46 and the applicator roller 62 are moved at an angle relative to a vertical axis, so while the motion is linear, it is not purely up-and-down vertical motion but rather is angled to have an up-and-down vertical component and a forward-backward longitudinal component to the overall linear motion. The motion is thus non-orthogonal to the ground surface.

It is noted that during the initial application phase, the float phase, and the cutting phase the module actuator 74 (shown in FIGS. 4A and 4B) is in an actuated state such that applicator module 24 is deployed to apply the adhesive tape 38. In the example shown, the pistons of the module actuator 74 are lengthened to press the applicator module 24 downward so that the tamper roller 48 (and the applicator roller 62 in the case of the initial application phase) rolls on the ground surface, and, at times, on the adhesive tape 38. Being that the module actuator 74 is bracing off of the applicator frame 12 to push the applicator module 24 downward, at least some of the weight of the applicator frame 12 and the other components supported by the applicator frame 12 are applied to applicator module 24 by module actuator 74. The weight of the applicator frame 12 and other components is transmitted to the tamper roller 48 (and the applicator roller 62 in the case of the initial application phase) to firmly press the adhesive side of the adhesive tape 38 to the ground surface to ensure adhesion. The module actuator 74 can be maintained in an activated state during the stripe application cycle to transmit the weight, which weight assists in firmly pressing the adhesive tape 38 onto the ground surface to facilitate and ensure adhesion. If the module actuator 74 were to release, then only the weight of the applicator module 24 would be resting on the tamper roller 48 which may be inadequate pressure for proper adhesion.

Figure 10:
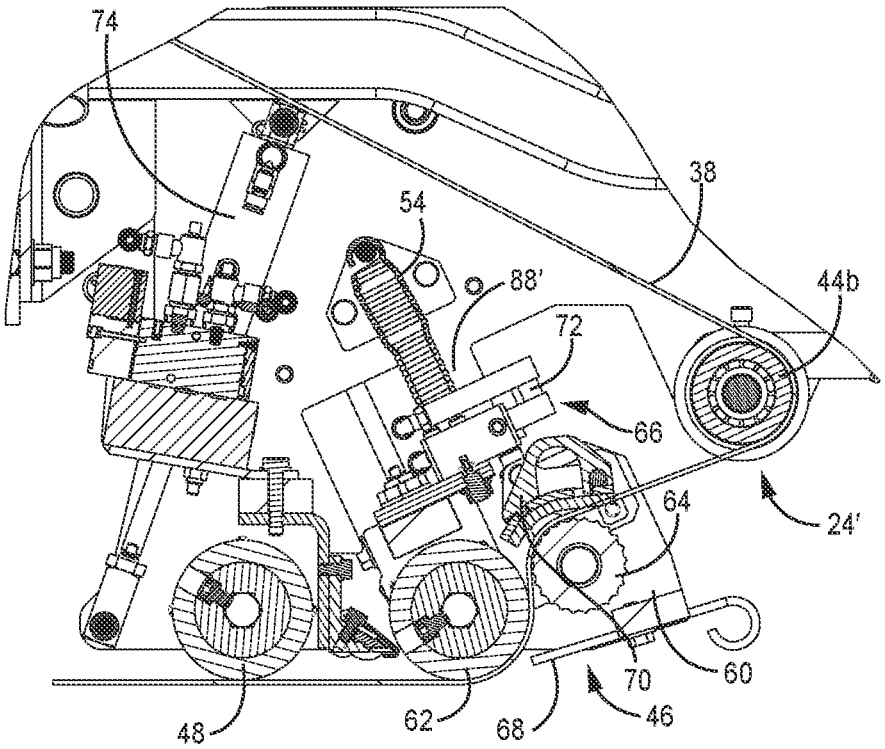
FIG. 10 is a cross-sectional view of an applicator module.

FIG. 10 is a cross-sectional view of applicator module 24'. Applicator module 24' is substantially similar to applicator module 24, except that applicator module 24' includes only a single guide roller 44*b* and in that support 88' is formed by a portion of module frame 42. Applicator module 24' is shown in the second, deployed state in FIG. 10 with roller assembly 46 in the initial tape application phase such that both applicator roller 62 and tamper roller 48 are pressing the tape 38 into the ground surface. The single guide roller 44*b* redirects the tape 38 from off of the tape spool 20 to the roller assembly 46.

Support 88' is formed as a projection extending from and, in some examples, integrally formed with module frame 42. More specifically, support 88' is formed as a flat plate extending from a portion of side panel 56. A linear bearing can interface with support 88' to connect roller assembly 46 to applicator module 24'. The linear bearing allows roller assembly 46 to slide linearly along the flat plate forming support 88' while support 88' prevents undesired movement relative to the displacement axis. Support 88' thereby restricts movement of roller assembly 46 to linear movement. Support 88' extends both vertically and longitudinally such that a part of the weight of roller assembly 46 is supported by module frame 42 at the interface between the bearing and support 88'.

Figure 11A:
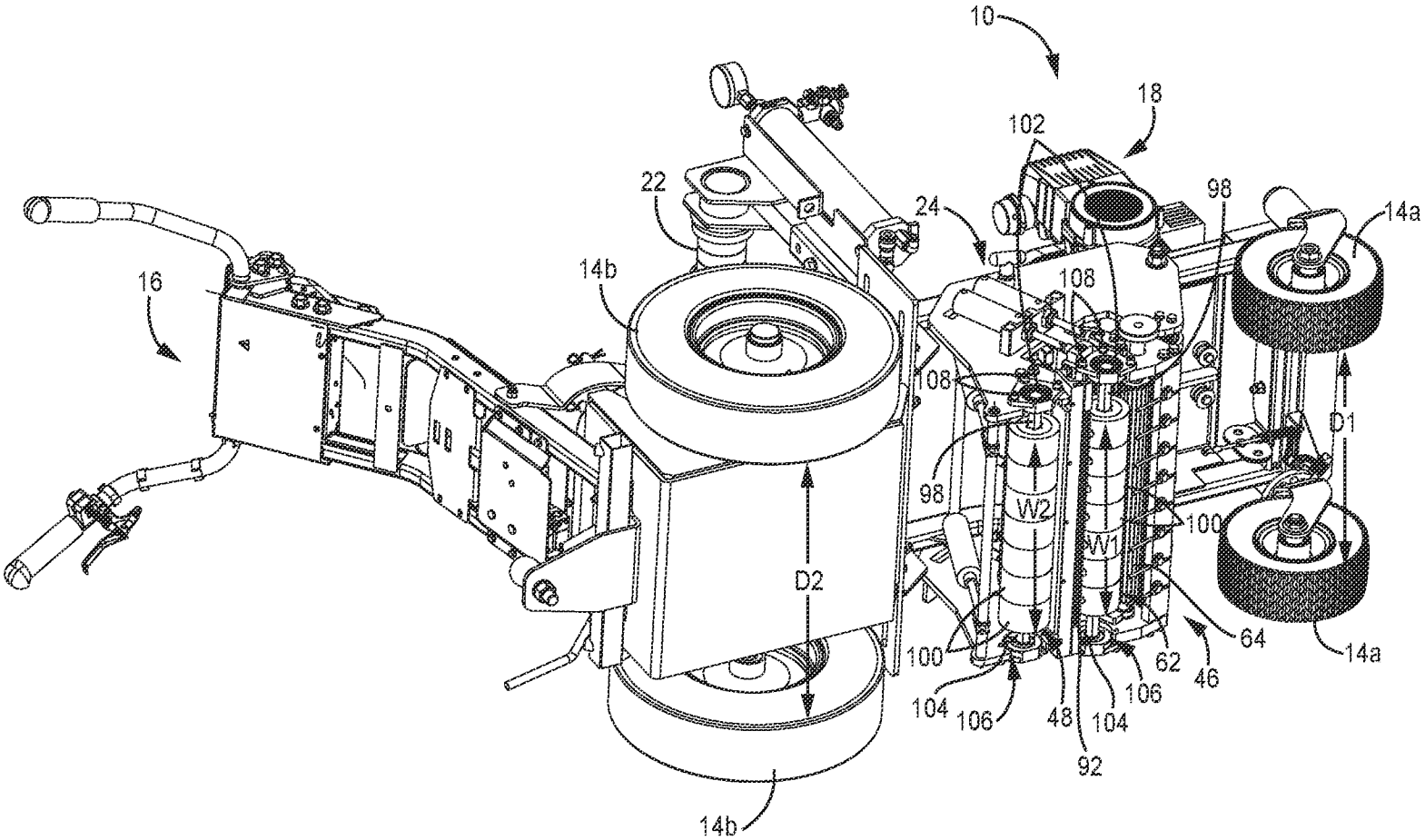
FIG. 11A is an isometric view showing a bottom side of the ground tape applicator with the ground engaging rollers in respective first configurations.
Figure 11B:
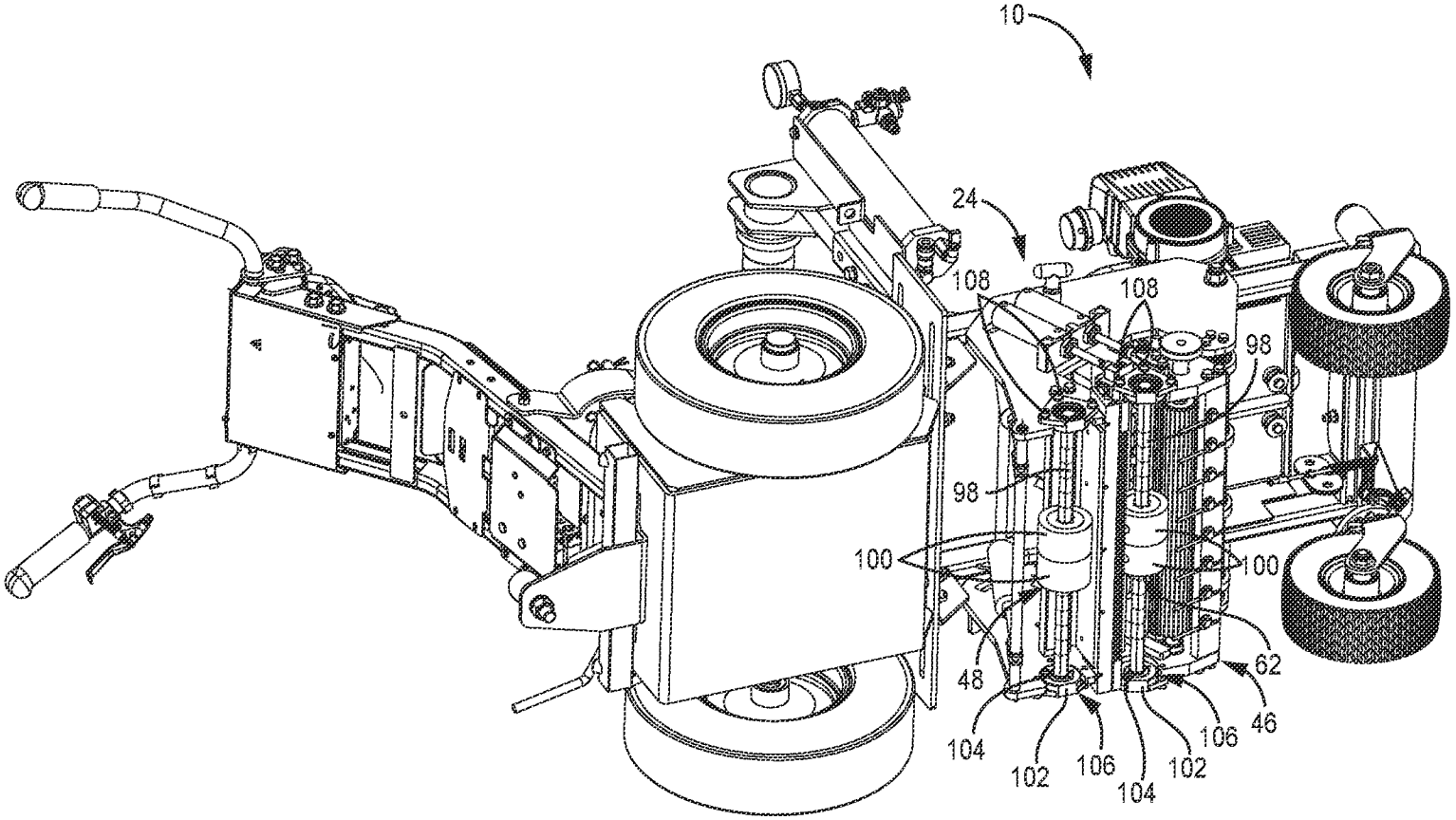
FIG. 11B is an isometric view showing the bottom side of the ground tape applicator with the ground engaging rollers in respective second configurations.
Figure 11C:
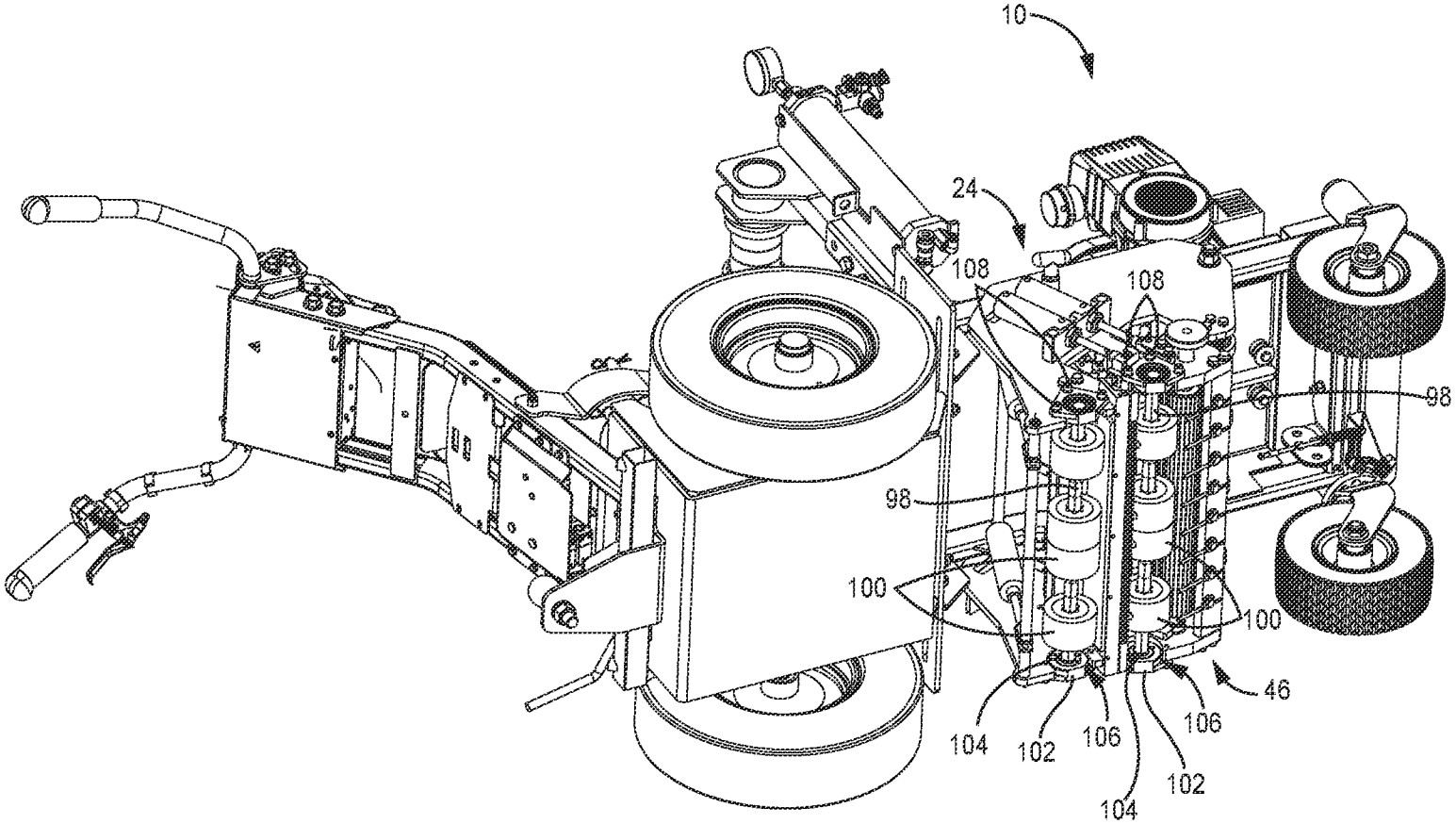
FIG. 11C is an isometric view showing the bottom side of the ground tape applicator with the ground engaging rollers in respective third configurations.

FIG. 11A is an isometric view showing a bottom side of ground tape applicator 10 with the ground engaging rollers 48, 62 in a first configuration. FIG. 11B is an isometric view showing the bottom side of ground tape applicator 10 and with the ground engaging rollers 48, 62 configured in respective second configurations. FIG. 11C is an isometric view showing the bottom side of ground tape applicator 10 and with the ground engaging rollers 48, 62 in respective third configurations. FIGS. 11A-11C will be discussed together.

In the example shown, the ground tape applicator 10 includes four wheels, including two front wheels 14*a* and two rear wheels 14*b*. The wheels 14*a*, 14*b* connect with and support the applicator frame 12. The pair of rear wheels 14*b* rotate relative to the applicator frame 12 but do not swivel (e.g., change direction) relative to the applicator frame 12. The pair of front wheels 14*a* rotate relative to the applicator frame 12 and can swivel (e.g., change direction) relative to the applicator frame 12. The pair of front wheels 14*a* can be swivel casters. The pair of rear wheels 14*b* can have larger diameters than the pair of front wheels 14*a*. The front wheels 14*a* are intended to maneuver and point the ground tape applicator 10 in a desired travel direction and thus are able to swivel. The pair of rear wheels 14*b* are configured to follow the lead direction of the pair of front wheels 14*a* and do not need to be as maneuverable and thus do not swivel in the example shown.

The pair of front wheels 14*a* are located ahead of the applicator roller 62 and tamper roller 48. The pair of rear wheels 14*b* are located behind the applicator roller 62 and the tamper roller 48. The applicator roller 62 and the tamper roller 48 are located between (laterally, not directly) the pair of front wheels 14*a*. The applicator roller 62 and the tamper roller 48 are located between (laterally, not directly) the pair of rear wheels 14*b*. The lateral distance D1 between the inner edges of the pair of front wheels 14*a* is greater than the respective width W1 of the ground engagement surface of the applicator roller 62 and is greater than the respective width W2 of the ground engagement surface of the tamper roller 48. In some examples, widths W1, W2 are the same. The distance D2 between the inner edges of the pair of rear wheels 14*b* is greater than the respective widths W1, W2 of the ground engagement surfaces of the applicator roller 62 and the tamper roller 48. The applicator roller 62 and tamper roller 48 are thus narrower than the wheelbases such that each fits laterally between the front wheels 14*a* and separately between the rear wheels 14*b*. The distances D1, D2 are larger than the maximum widths W1, W2 of the ground engaging surfaces of rollers 48, 62.

The adhesive tape 38 is applied to the ground surface at a location laterally between the front wheels 14*a* and laterally between the rear wheels 14. For example, the adhesive tape 38 is not applied to the side of the ground tape applicator 10 but is instead applied at a location directly beneath the ground tape applicator 10. The ground surface is typically prepared prior to the adhesive tape 38 being applied. For example, the ground surface may be cleaned of debris (e.g., plant matter or rocks) to facilitate adhesion of the adhesive tape 38. In some examples, the ground surface can be treated, such as with cleaner or additional adhesive, prior to applying the adhesive tape 38 to the ground surface. The lateral positioning of the stripe application location, which is the location where the adhesive tape 38 is pressed onto the ground surface, prevents wheels 14*a*, 14*b* from marring or otherwise contaminating the pathway of the stripe. Positioning the stripe application location laterally between front wheels 14*a* and rear wheels 14*b* ensures that those wheels do not run in the stripe pathway, thereby preserving the surface integrity of the pretreated ground surface to facilitate desired adhesion.

The stripe application location is in front of the rear wheels 14*b* but behind the front wheels 14*a*, longitudinally. This positioning allows the tamper roller 48 to be positioned laterally between the rear wheels 14*b* and front wheels 14*a* and underneath the applicator frame 12. Such positioning allows the weight of the applicator frame 12 and other components to be rested at least partially on the tamper roller 48. If the tamper roller 48 were to the side of the applicator frame 12, the ground tape applicator 10 could be unbalanced.

Ground tape applicator 10 is configured such that front wheels 14*a* do not pass over the pretreated ground surface prior to application of the adhesive tape 38 and such that rear wheels 14*b* do not pass over the adhesive tape 38 after application of the adhesive tape 38. Applicator module 24 is disposed longitudinally between front wheels 14*a* and rear wheels 14*b*. Applicator module 24 is configured such that the adhesive tape 38 is applied to portions of the ground surface located laterally between front wheels 14*a* and located laterally between rear wheels 14*b*. Applying the adhesive tape 38 in such locations relative to the front wheels 14*a* and rear wheels 14*b* provides improved adhesion and structural integrity to the adhesive tape 38. For example, if a wheel passes over the treated ground surface prior to the adhesive tape 38 being applied, then contaminants can be placed in the pathway of the adhesive tape 38, which contaminants adversely affect the adhesive properties of the tape 38. In addition, another worker may need to follow behind the applied tape 38 to remove the already applied tape 38 from the ground surface to access and remove the contaminants from between the adhesive tape 38 and the ground surface. For example, the adhesive tape 38 may need to be cut to access and remove the contaminant. Removing the adhesive tape 38 after application or marring the treated ground surface before adhesion decreases the adhesive properties of the adhesive tape 38 and creates a less robust marking. In addition, having to follow behind to cut the tape and remove contaminants adversely affects the aesthetics of the adhesive tape 38 and requires additional manpower and time.

As the ground tape applicator 10 moves forward the front wheels 14*a* and the rear wheels 14*b* do not roll over the same portion of the ground surface engaged by the tamper roller 48 and, in some phases of the striping cycle, the applicator roller 62. Being that the tape is applied by the applicator roller 62 and/or tamper roller 48, not having lateral overlap between the wheels 14*a*, 14*b* and the applicator roller 62 and tamper roller 48 means that the pair of front wheels 14*a* and the pair of rear wheels 14*b* will not run over the particular ground surface on which the tape is being placed (e.g., which may have been pretreated and/or cleaned) or run over the tape itself after being applied. The relative arrangement of roller assembly 46 and wheels 14*a*, 14*b* thereby preserves the integrity of the ground surface, enhancing adhesion of the tape to the ground surface. The relative arrangement of roller assembly 46 and wheels 14*a*, 14*b* further increases operational efficiency and reduces job time as the tape is directly applied to the undisturbed, prepared surface and not run over or otherwise contacted immediately after application.

Applicator roller 62 and tamper roller 48 can be of the same or similar configurations. In the example shown, applicator roller 62 and tamper roller 48 are modular rollers that are configurable to apply tape according to any desired configuration and width. Applicator roller 62 and tamper roller 48 are configured to facilitate easy access to the rollers and quick changing of the rollers. Applicator roller 62 and tamper roller 48 are segmented such that the widths of the cylindrical ground engaging portions of applicator roller 62 and tamper roller 48 can be increased or decreased as desired.

In the example shown, both applicator roller 62 and tamper roller 48 include a roller axle 98 and roller segments 100. Roller segments 100 can form the ground engaging portions of applicator roller 62 and/or tamper roller 48. The roller segments 100 can be added to or removed from roller axle 98 to change the widths of the ground engaging portions. As shown in FIG. 11A, the roller segments 100 can be arranged to sit adjacent to one another, thereby forming a continuous full-width roller 48, 62. The roller segments 100 can be disposed adjacent to one another such that there is no gap between the individual roller segments 100. The roller segments 100 can also be spaced to provide gaps, as needed for the particular tape application job.

Roller axle 98 is mounted to a pair of bearing brackets 102. Each bearing bracket 102 can include a rotational bearing and a stationary housing. The rotational bearing allows roller axle 98 to rotate relative to the stationary housing, which forms the outer periphery of bearing bracket 102. For example, the rotational bearing can include a shaped opening within which an end of the axle 98 can be inserted. In the example shown, pin 104 is connected to axle 98 to secure axle 98 to bearing bracket 102. Pin 104 can be a cotter pin that extends around axle 98 or can be a pin configured to extend through a cross-hole in axle 98, among other options. A pin 104 is disposed at each lateral end of axle 98 to prevent axle 98 from shifting laterally relative to each bearing bracket 102. The bearing brackets 102 themselves are mounted to applicator module 24 (e.g., to module frame 42 or roller frame 60), securing the positions of bearing brackets 102, and thus securing rollers 48, 62.

Module frame 42 includes a pair of mount slots 106 formed in side plates 56 of module frame 42. Roller frame 60 similarly includes a pair of mount slots 106 formed in roller frame 60. Each mount slot 106 is formed on a lateral side of the respective frame. Applicator roller 62 is mountable to roller frame 60 by bearing brackets 102 being disposed within mount slots 106 and connected to roller frame 60. Tamper roller 48 is mountable to module frame 42 by bearing brackets 102 being disposed within mount slots 106 and connected to module frame 42. Applicator roller 62 and tamper roller 48 are similarly configured and mounted, such that a single roller configuration can be used to form either applicator roller 62 or tamper roller 48. For example, the same roller can be mounted at either the location of tamper roller 48, such that that roller forms the tamper roller 48, or mounted at the location of applicator roller 62, such that that roller forms the applicator roller 62. Tamper roller 48 and applicator roller 62 being swappable and having the same mounting configuration reduces part count as the user requires fewer spares, and increases the operational life of the rollers. For example, the rollers can be rotated such that one roller forms the tamper roller 48 during part of operation and the same roller can be shifted to form the applicator roller 62 during other parts of operation. For example, the rollers can be repositioned after a certain period of operation, length of tape laid, etc.

The mount slots 106 are each open on a lower end to allow bearing brackets 102 to be dismounted from ground tape applicator 10 by a sliding motion. Each bearing bracket 102 can be connected to the supporting portion of the respective frame. For example, each bearing bracket 102 can includes a first portion that extends into the slot to position the bearing bracket 102 and can further include a flange or other projection that interfaces with the support frame to secure the bearing bracket 102 to the supporting frame. In the example shown, fasteners 108 extend through the bearing brackets 102 of applicator roller 62 and into roller frame 60 to secure applicator roller 62 relative to roller frame 60. Similarly, fasteners 108 extend through bearing brackets 102 of tamper roller 48 and into module frame 42 to secure tamper roller 48 relative to module frame 42. The fasteners 108 can be threaded into bearing brackets 102 and module frame 42 to secure tamper roller 48 and applicator roller 62 for taping.

Ground tape applicator 10 is configured such that applicator roller 62 and tamper roller 48 can be easily accessed and replaced or reconfigured during operation. Adhesive tape 38 is often applied in grooves formed in the ground surface such that the top (i.e., non-adhesive) side of the adhesive tape 38 is flush with or recessed relative to the ground surface. Positioning the adhesive tape 38 in grooves on the ground surface protects the adhesive tape 38 once applied to the ground surface. Recessing the adhesive tape 38 protects the edges of the adhesive tape 38 and prevents peeling or other contact damage to those sides. For example, adhesive tape 38 can be used to form stripes on roadways in cold climates. In such environments, snowplows and/or other heavy machinery are used to scrape ice and snow from the roadway. Recessing the adhesive tape from the ground surface protects the tape stripe from contact damage.

As discussed in more detail below, the individual roller segments 100 can be removed from or added to the axle 98 to adjust an operational configuration and width of each of tamper roller 48 and applicator roller 62. For example, FIG. 11B shows the applicator roller 62 and tamper roller 48 configured with fewer roller segments 100 as compared to the state shown in FIG. 11A. The state shown in FIG. 11B corresponds to a narrower configuration of each of tamper roller 48 and applicator roller 62. Such as configuration can correspond with narrower tape being applied to the ground surface. The narrower roller configuration facilitates the width of the ground engaging portion of the roller fitting within the tape-receiving groove formed in the ground surface. A wider configuration of tamper roller 48 or applicator roller 62 would ride on the ground surface outside of the groove and would rely on the weight of the ground tape applicator 10 and the material forming the roller to sufficiently press the adhesive tape into the groove.

FIG. 11C shows the applicator roller 62 and tamper roller 48 configured with roller segments 100 having lateral spaces or gaps therebetween. The configuration shown in FIG. 11C can be used to apply three parallel lines of adhesive tape 38 to the ground surface. As shown in FIG. 11C, lateral gaps are located between the individual roller segments 100. The lateral gaps can correspond with areas where the adhesive tape 38 is not being applied while the exterior cylindrical surfaces of the roller segments 100 correspond with locations where the adhesive tape 38 is being applied. As such, multiple stripes of adhesive tape 38 can be applied in separate grooves in the ground surface by a single roller during a single pass, providing improved efficiency to save time and costs.

A user can transition the ground engaging rollers 48, 62 between the roller configurations shown in FIGS. 11A-11C by removing applicator roller 62 and tamper roller 48 and either removing or adding roller segments 100. As an example, with regard to tamper roller 48, fasteners 108 are removed and the bearing brackets 102 are slid down, out of the mount slots 106 of the lower module frame 42. The pins 104 are removed. Roller segments 100 are decoupled from axle 98, such as by loosening set screws, as discussed in more detail below. The roller segments 100 can then be removed from the axle 98 and/or repositioned on the axle 98 and/or more roller segments 100 can be added on the axle 98. The roller segments 100 are recoupled to the axle 98 when in the desired positions, such as by the set screws. The bearing brackets 102 and pins 104 can be placed back on the ends of the axle 98 and the bearing brackets 102 slid into the mount slots 106. Fasteners 108 can resecure bearing brackets 102 to module frame 42.

Figure 12A:
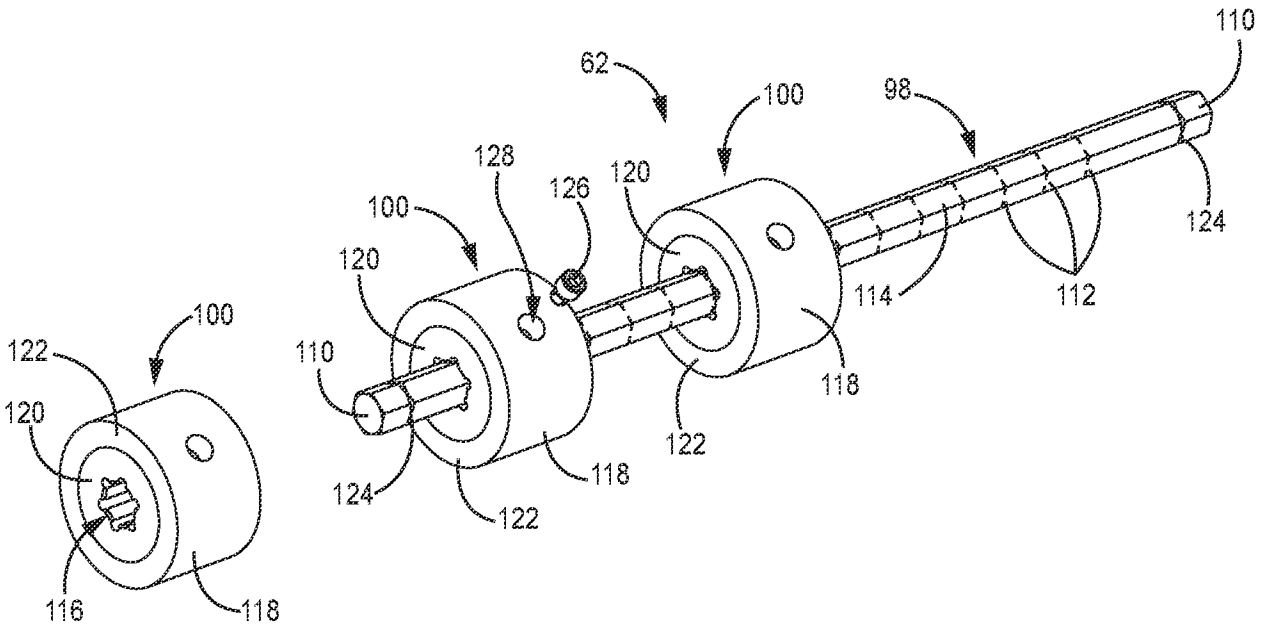
FIG. 12A is an isometric, partially exploded view of applicator roller.
Figure 12B:
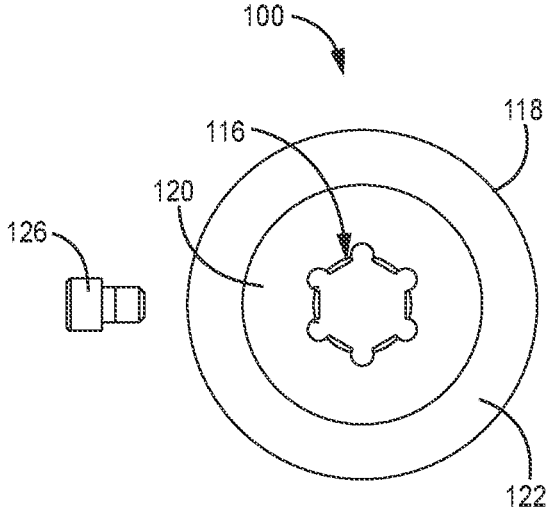
FIG. 12B is a side elevation view of a roller segment.

FIG. 12A is an isometric, partially exploded view of applicator roller 62. FIG. 12B is a side elevation view of a roller segment 100. It is understood that tamper roller 48 can be identically configured relative to applicator roller 62 such that, while applicator roller 62 is discussed in more detail, the discussion equally applies to tamper roller 48. Axle 98 and roller segments 100 of roller 62 are shown. Axle 98 includes axle ends 110, notches 112, and exterior surface 114. Each roller segment 100 includes mount aperture 116 and ground engaging surface 118. In the example shown, each roller segment 100 is formed by hub 120 and exterior portion 122.

Roller segments 100 are mounted on axle 98 to form a roller of any desired configuration and width. As shown, roller segments 100 are located on different parts of axle 98. Roller segments 100 can be located at different lateral locations along axle 98 such that the roller 62 can include one or more ground engaging portions.

Mount aperture 116 extends through roller segment 100. Roller segments 100 are configured to mount to axle 98 by axle 98 extending through mount aperture 116. Roller segments 100 are mounted to the body of axle 98 between the axle ends 110. Notches 112 are formed along the body of axle 98. The notches 112 can be and/or represent index points for positioning of the roller segments 100 on axle 98. For example, each roller segment 100 can be positioned to overlap, or be directly between, two adjacent notches 112. In some examples, roller segments 100 can be configured to include one or more detents configured to engage with notches 112 to resist lateral movement of that roller segment 100 along the axle 98.

Notches 112 can be evenly arrayed along the axle 98. The distance between adjacent notches 112 can be the same as the width of a roller segment 100. Evenly spacing the roller segments 100 along axle 98 (e.g., by the notches 112) uniformly positions the roller segments 100 into a continuous roller and/or provides standard size gaps between the roller segments 100, such as gaps corresponding to the sizes between tape-receiving grooves in the ground surface. Two end notches 124 are configured to interface with pins 104 with axle 98 mounted to bearing brackets 102. In the example shown, the interface between pin 104 and end notch 124 prevents axle 98 from sliding laterally outward when mounted. But axle 98 is not fixed to bearing bracket 102, allowing bearing bracket 102 to easily be pulled off of axle 98 when dismounted for ease of assembling and configuring the roller. It is understood, however, that in some examples axle 98 can be fixed to bearing bracket 102, such as by pins mounted to axle end 110 on both lateral sides of bearing bracket 102, among other options.

At least a portion of the exterior surface 114 of axle 98 is multifaceted. The exterior surface 114 can have a non-circular cross-section taken orthogonal to the axis of rotation of axle 98. The non-circular cross-section can be continuous between axle ends 110, and can be considered as continuous even with the inclusion of notches 112 and end notches 124. The interior surface of mount aperture 116 is configured to mate with exterior surface 114. The interface between mount aperture 116 and exterior surface 114 forms an anti-rotation interface that prevents roller segment 100 from rotating relative to axle 98. As such, all of the roller segments 100 mounted on a common axle 98 roll together and not independently of one another, which prevents shearing of the adhesive tape 38 that can occur with uneven rolling.

Mount aperture 116 can be multifaceted in a complimentary manner to exterior surface 114 of axle 98. In the example shown, exterior surface 114 is hexagonal while the mount aperture 116 is similarly hexagonal. It is understood, however, that mount aperture 116 and exterior surface 114 can be configured in any suitable manner for mating and preventing relative rotation. For example, both exterior surface 114 and mount aperture 116 can be of geometric configurations other than hexagonal, such as triangular, oval, rectangular, square, octagonal, among other options. It is further understood that mount aperture 116 and exterior surface 114 can have different numbers of facets or faces but can still interface together, such as a rectangular mount aperture 116 interfacing with a hexagonal exterior surface 114, among other options.

In the example shown, each roller segment 100 is formed from a metallic hub 120 and polymer exterior portion 122. The ground engaging surface 118 is formed by the outermost surface of exterior portion 122 relative to the axis of rotation of roller segment 100. Hub 120 can be formed from steel or aluminum, among other material options. Exterior portion 122 is formed from a compliant material to roll along the ground surface and conform to irregularities in the rolling path while exerting balanced pressure on the adhesive tape 38. The exterior portion 122 can be formed from an elastomer. In some examples, exterior portion can be formed from rubber, among other options. In some examples, exterior portion 122 can be formed from silicone rubber. The metallic hub 120 and compliant exterior portion 122 provide a robust roller segment 100 configuration that can rotationally lock with axle 98, such as at the metallic interface of hub 120 and axle 98, and can roll along the ground surface while conforming to the surface, such as at the polymer interface between exterior portion 122 and ground surface.

Radial hole 128 extends radially through roller segment 100. The radial hole 128 extends through exterior portion 122 and hub 120. Radial hole 128 can be threaded in the portion extending through hub 120. Radial hole 128 can extend fully through roller segment 100 between ground engaging surface 118 and mount aperture 116. When the axle 98 is within the mount aperture 116, set screw 126 can be inserted through the radial hole 128 and then threaded into the threading of the metal hub 120 to engage the exterior, faceted surface 114 of the axle 98. Such engagement secures a roller segment 100 in place on the axle 98. Radial hole 128 and set screw 126 are configured such that the head of set screw 126 is countersunk within exterior portion 122 such that set screw 126 sits flush with or below ground engaging surface 118. In some examples, set screw 126 can be recessed such that no portion of set screw 126 is disposed within exterior portion 122.

Roller segments 100 and axle 98 facilitate simple and quick assembly, disassembly, and configuring of rollers (e.g., tamper roller 48 and/or applicator roller 62). Roller segments 100 are installed by aligning axle 98 with mount aperture 116 and sliding roller segment 100 onto axle 98. Roller segment 100 is slid to a desired location along axle 98, which can be indicated by notches 112. Set screw 126 is tightened to engage with axle 98 and secure roller segment 100 on axle 98. Roller segments 100 can be shifted to a new lateral position or removed from axle 98 by loosening set screw 126 and sliding roller segment 100 along axle 98. Roller segments 100 facilitate reconfiguring rollers to efficiently apply adhesive tape 38 within tape-receiving grooves on the ground surface. A single roller can be reconfigured to fit the needs of a particular job, allowing the user to have fewer parts while being able to apply stripes of any desired width and apply multiple lines simultaneously.

Figure 13A:
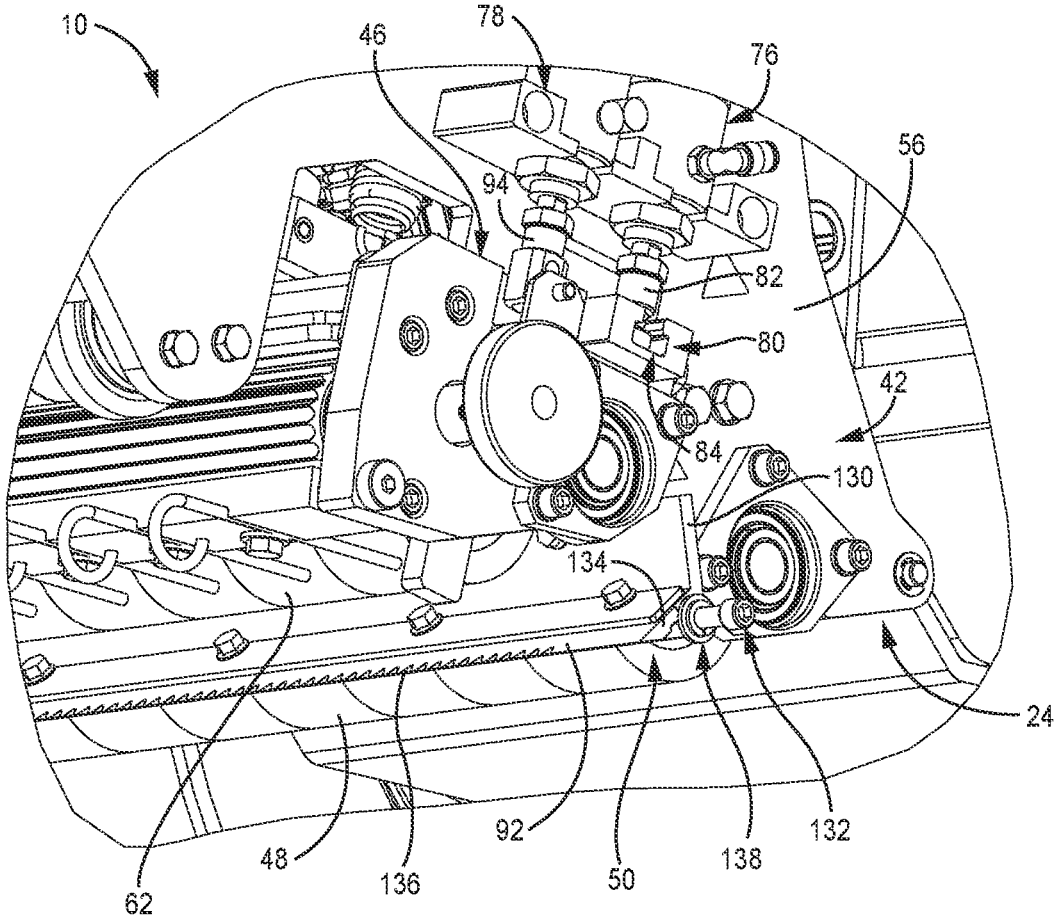
FIG. 13A is an enlarged, partially exploded, isometric view showing a portion of the ground tape applicator.
Figure 13B:
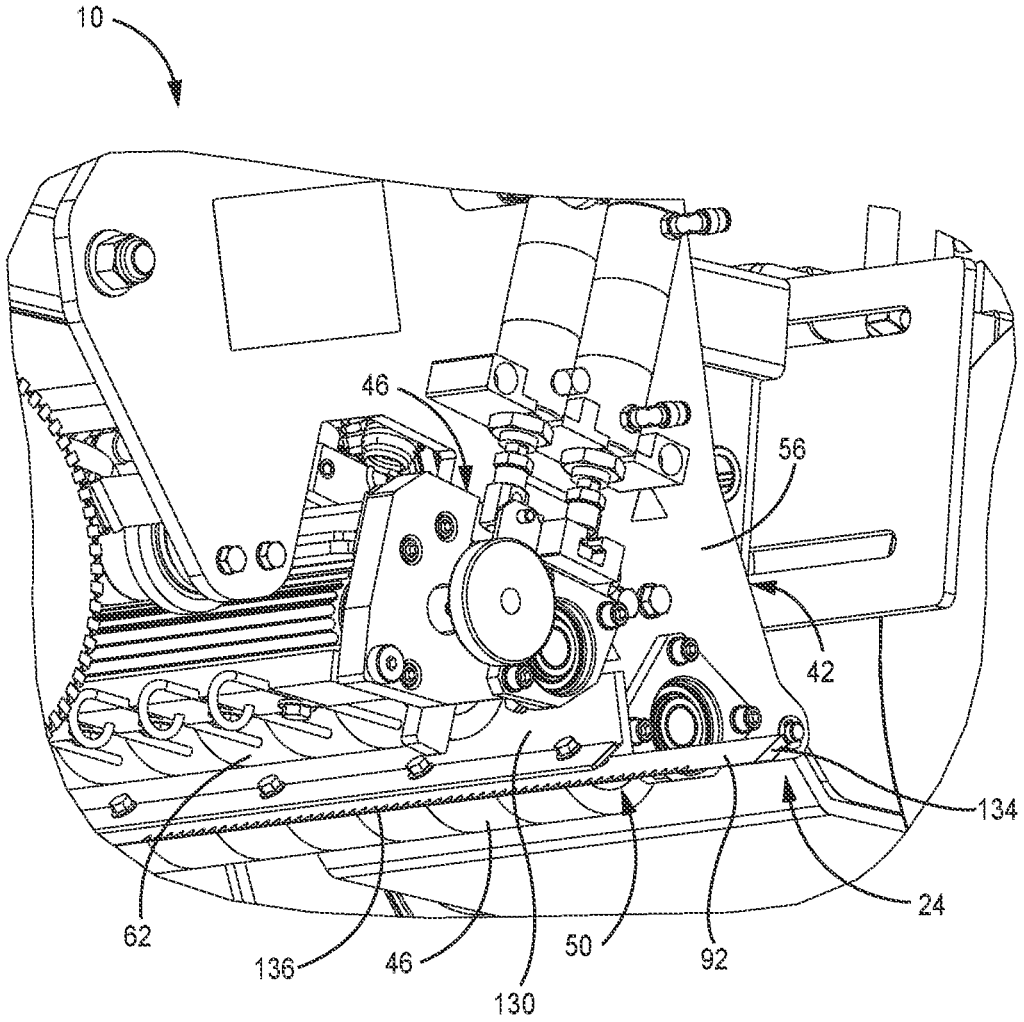
FIG. 13B is an enlarged isometric view similar to FIG. 13A showing the blade partially removed from a blade frame.
Figure 13C:
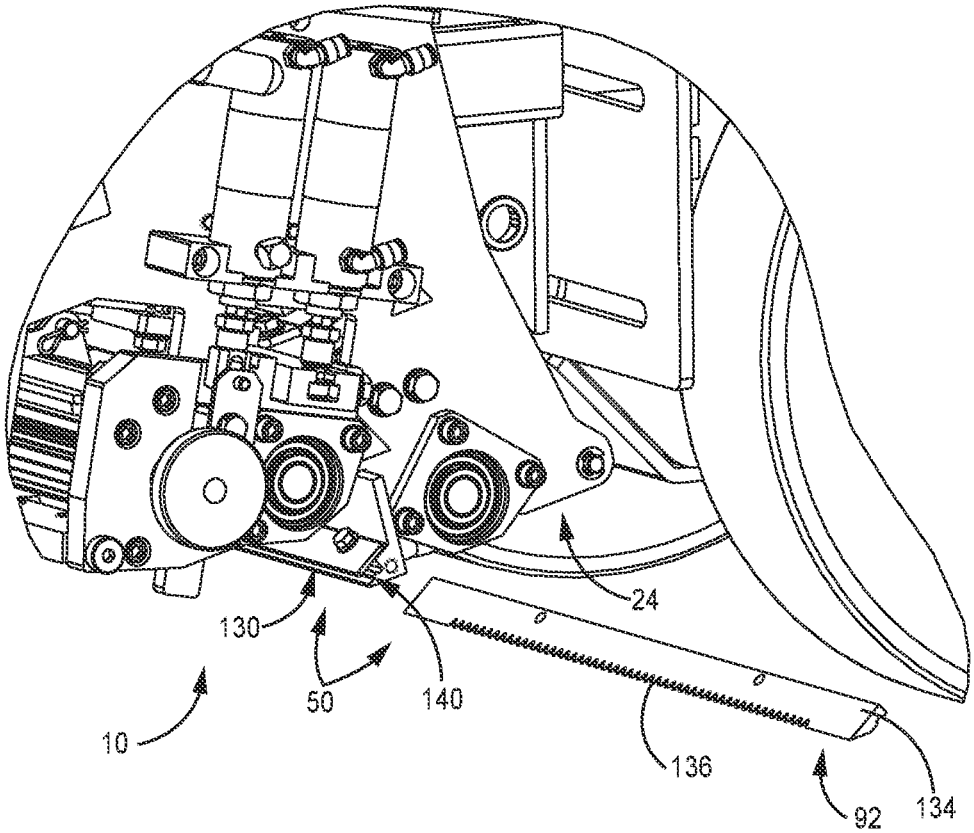
FIG. 13C is an enlarged isometric view similar to FIGS. 13A and 13B showing the blade fully removed.

FIG. 13A is an enlarged, partially exploded, isometric view showing a portion of ground tape applicator 10. FIG. 13B is an enlarged isometric view similar to FIG. 13A showing blade 92 partially removed from cutter 50. FIG. 13C is an enlarged isometric view similar to FIGS. 13A and 13B showing blade 92 fully removed from cutter 50. Cutter 50 is formed as a portion of applicator module 24. Blade 92, blade frame 130, and blade lock 132 of cutter 50 are shown. Blade 92 includes blade body 134 and cutting edge 136.

Blade frame 130 is mounted to applicator module 24. Blade frame 130 is mounted such that cutter 50 moves with applicator module 24 between the stowed, transport state (FIGS. 3A and 3B) and the deployed, applicating state (FIGS. 4A and 4B). For example, blade frame 130 can be connected to side plates 56 of module frame 42. Blade 92 is configured to cut the adhesive tape 38 when cutting edge 136 encounters the adhesive tape 38. Blade frame 130 is mounted such that blade 92 remains stationary during cutting, in the example shown. It is understood, however, that blade 92 can be movable during cutting, in some examples. For example, blade 92 can be moved towards the adhesive tape 38 to engage with the adhesive tape 38. Cutting edge 136 is formed as a serrated edge, in the example shown. It is understood that, in some examples, cutting edge 136 can be a straight edge of blade 92. Blade 92 can be formed from steel, among other metallic options.

Cutter 50 is configured to facilitate quick access to blade 92 for servicing and replacement. Blade lock 132 secures blade 92 within blade frame 130. A radial projection 138 (e.g., an integral flange or a washer, among other options) forms a portion of blade lock 132 that overlaps with blade 92 to prevent blade 92 from moving laterally out of blade frame 130. Blade lock 132 prevents lateral movement of blade 92 relative to blade frame 130 with lock in the engaged state. In the example shown, blade lock 132 includes a fastener (e.g., a threaded bolt) that attaches to blade frame 130. For example, the shaft of blade lock 132 can thread into a threaded hole formed in blade frame 130. The radial projection 138 of the blade lock 132 can engage the lateral side of the blade 92 to prevent lateral movement of the blade 92. In some examples, cutter 50 can include a pair of blade locks 132 disposed on opposite lateral sides of cutter 50. In such a configuration, blade 92 can be accessed from and removed/replaced from either lateral side of ground tape applicator 10.

Blade lock 132 is disposed at a location accessible from the exterior or ground tape applicator 10. Removal of blade lock 132 allows for removal of blade 92 from blade frame 130. Blade 92 can be slid laterally off of blade frame 130 to dismount blade 92 from blade frame 130. Blade 92 can be mounted to blade frame 130 by sliding blade laterally onto blade frame 130.

FIG. 13B shows blade lock 132 having been removed and the blade 92 partially slid out laterally from blade frame 130. For example, the shaft of blade lock 132 can be unthreaded from the opening in blade frame 130 to remove blade lock 132. FIG. 13C shows the blade 92 having been entirely removed from blade frame 130. As seen in FIG. 13C, blade frame 130 defines blade slot 140 within which blade 92 is mounted. Blade slot 140 is open on a lower end towards ground surface. Blade slot 140 is configured to retain blade 92 within blade slot 140, such as by preventing blade 92 from moving through the opening of blade slot 140, while allowing lateral sliding of blade 92 within blade slot 140. The blade 92 can be removed to be cleaned, sharpened, or replaced, and then reinserted into the blade slot 140, and the blade lock 132 replaced to secure the blade 92 within the blade frame 130 for subsequent cutting of adhesive tape 38.

Figure 14:
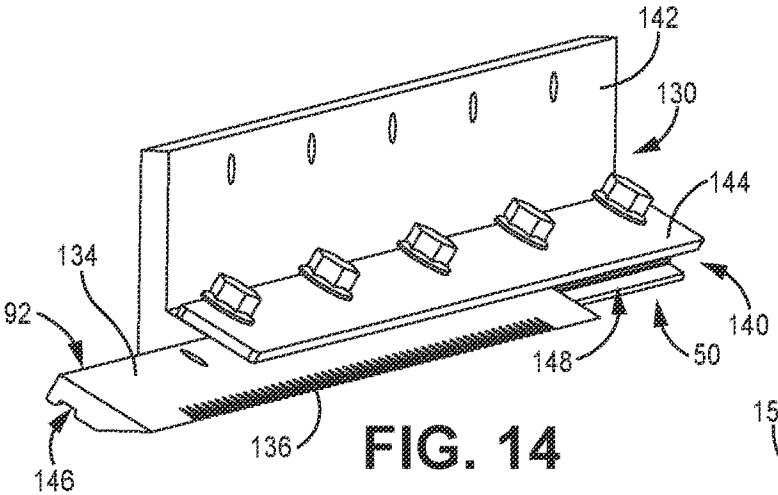
FIG. 14 is a partially exploded view of a cutter.

FIG. 14 is a partially exploded view of cutter 50. Blade frame 130 and blade 92 of cutter 50 are shown. Blade frame 130 includes frame body 142 and retaining plate 144. Blade 92 includes cutting edge 136 and blade body 134. Locating groove 146 is formed in blade body 134.

Blade 92 is supported by blade frame 130. Frame body 142 forms a main body portion of blade frame 130. Frame body 142 is configured to mount to applicator module 24.

Frame body 142 can be connected to applicator module by one or more fasteners extending through apertures in frame body 142.

Retaining plate 144 is connected to frame body 142 to define blade slot 140. In the example shown, blade slot 140 is open at each lateral end to facilitate insertion of blade 92 into blade slot 140 from either lateral end of blade slot 140. Blade slot 140 includes an elongate lower opening 148 through which cutting edge 136 projects from blade slot 140. The elongate lower opening 148 is oriented longitudinally and vertically and extends laterally between the lateral openings at the ends of blade slot 140. In the example shown, blade 92 is configured such that the full depth of each serration is disposed outside of blade slot 140. Retaining plate 144 is removably connected to frame body 142 in the example shown. Retaining plate 144 is connected to frame body 142 by removable fasteners, such as bolts. In the example shown, retaining plate 144 can be removed to facilitate removal of a blade 92 if the blade has become jammed and cannot be removed by lateral sliding. It is understood, however, that not all examples are so configured. For example, retaining plate 144 can be integrally formed with frame body 142 of blade frame 130.

Locating groove 146 is formed in a lower side of blade 92. Locating groove 146 is configured to interface with a projection of blade frame 130, as discussed in more detail below. The interface between locating blade slot 140 and the projection of blade frame 130 prevents blade 92 from sliding out through the elongate opening 148 of blade slot 140.

Blade frame 130 can be configured such that blade slot 140 restrains vertical movement of blade 92 but allows blade 92 to freely float laterally. In the example shown, blade slot 140 is configured to have a uniform height at the rear end of slot (proximate the back wall of blade slot 140) and at the front end of slot (proximate the elongate lower opening 148). The uniform height allows the blade 92 to freely move longitudinally within blade slot 140, except for the interface with locating groove 146 preventing such movement. The uniform height prevents the blade 92 from becoming jammed or otherwise stuck within blade slot 140, which could occur with a tapered slot. It is understood, however, that some examples include a tapered slot that reduces in height from the rear to the front of blade slot 140, such reduction preventing longitudinal movement of blade 92 out of blade slot 140.

Figure 15A:
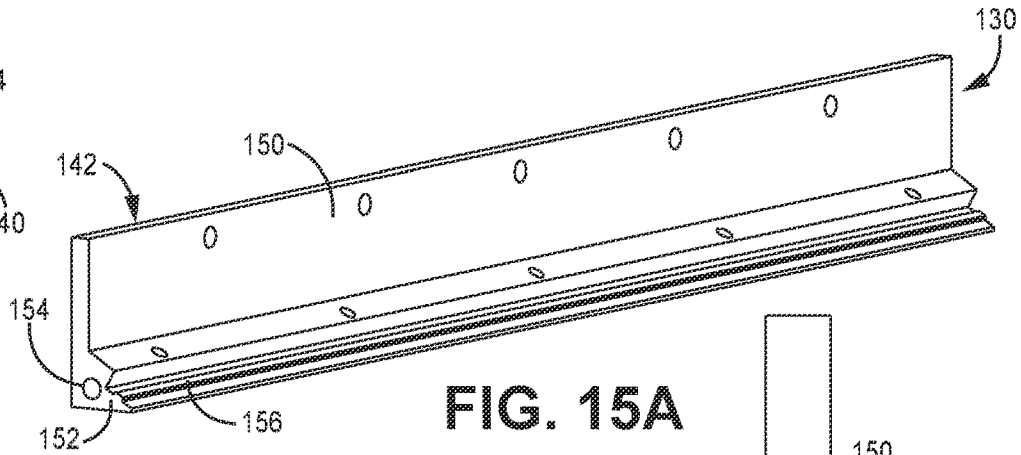
FIG. 15A is an isometric view of a blade frame with a retaining plate removed.
Figure 15B:
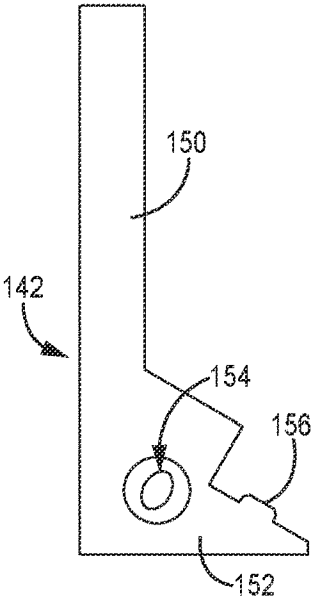
FIG. 15B is a side elevation view of a frame body of a blade frame.

FIG. 15A is an isometric view of blade frame 130 with retaining plate 144 removed. FIG. 15B is a side elevation view of frame body 142 of blade frame 130. FIGS. 15A and 15B will be discussed together. Frame body 142 includes mount plate 150, lower portion 152, and lock receiver 154. Projection 156 is formed on lower portion 152.

Blade frame 130 is configured to receive and support blade 92 during operation of ground tape applicator 10. Frame body 142 connects to ground tape applicator 10, such as to applicator module 24, and directly interfaces with blade 92 to support blade 92. Mount plate 150 can be fixed to a portion of ground tape applicator 10, such as to module frame 42, to secure cutter 50 to ground tape applicator 10. Lower portion 152 receives and supports blade 92. Lock receivers 154 are disposed on the lateral ends of blade frame 130. Lock receiver 154 provides a location for a blade lock 132 to interface with and connect to blade frame 130. In this particular embodiment, the receiver 154 is a threaded hole to threadedly interface with a threaded shaft of blade lock 132.

Projection 156 is formed on lower portion 152 and configured to interface with blade 92. Projection 156 is configured to extend into the locating groove 146 formed on blade 92. Projection 156 can slide within locating groove 146 as the blade 92 is moved laterally within blade slot 140. Interfacing between the locating groove 146 and the projection 156 limits relative movement of the blade 92 relative to the blade frame 130 and ensures only lateral sliding movement of the blade 92 when engaged with the blade frame 130. While projection 156 is shown as formed on blade frame 130, it is understood that in some examples locating groove 146 is formed on blade frame 130 and configured to interface with a projection 156 formed on blade.

Figure 16B:
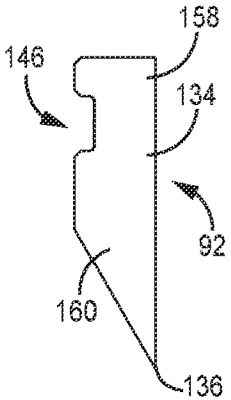
FIG. 16B is a side elevation view of the blade.
Figure 16A:
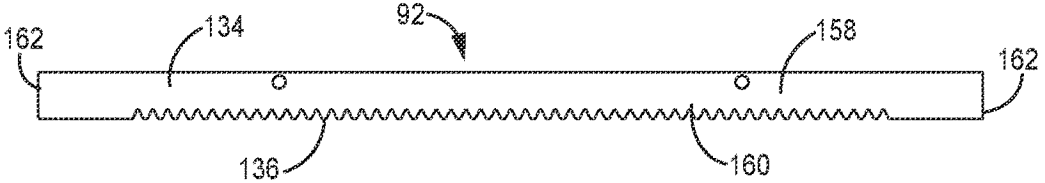
FIG. 16A is a bottom plan view of a blade.
Figure 16D:
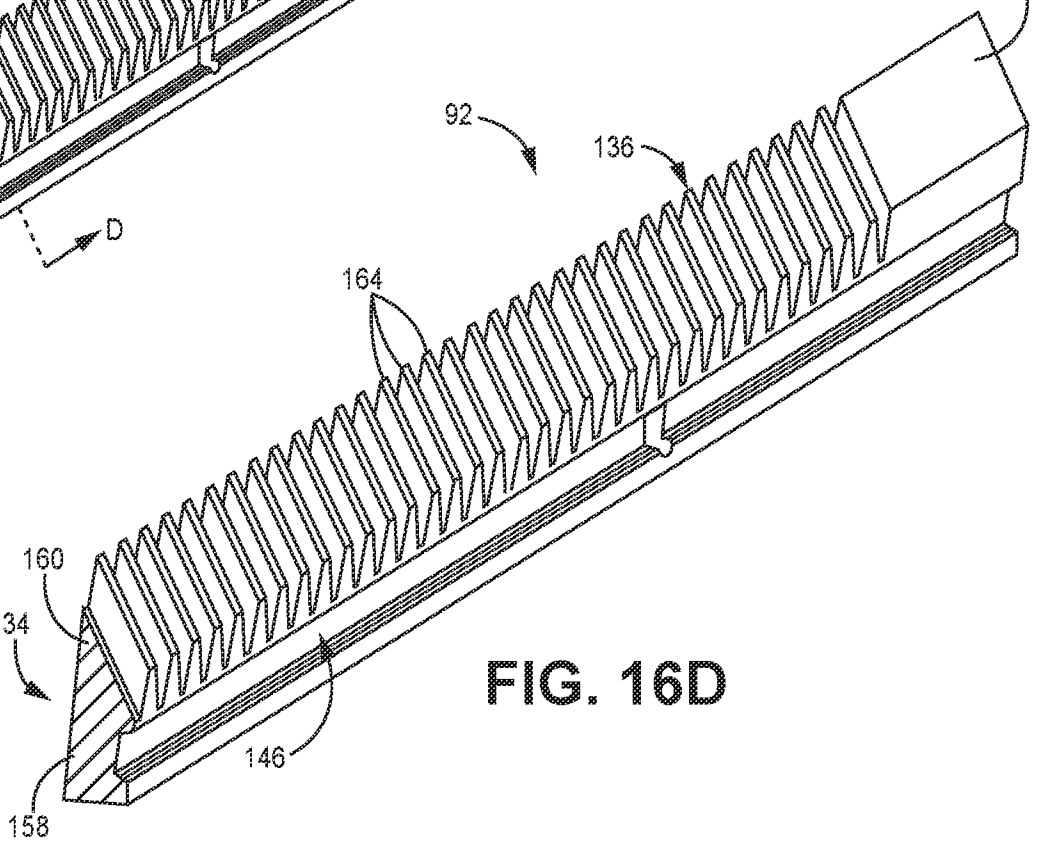
FIG. 16D is an enlarged isometric cross-sectional view of the blade taken along line D-D in FIG. 16C.
Figure 16C:
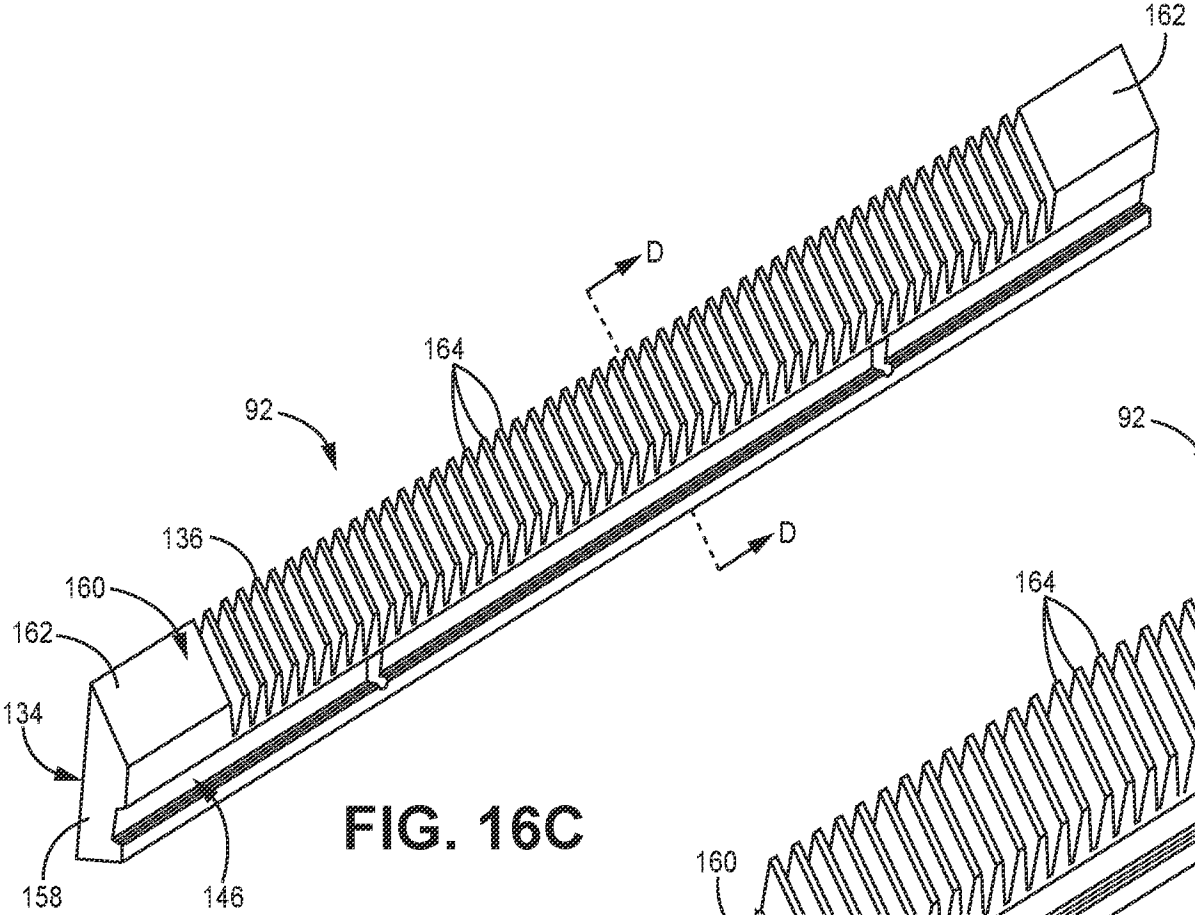
FIG. 16C is an isometric view of the blade.

FIG. 16A is a bottom plan view of blade 92. FIG. 16B is a side elevation view of blade 92. FIG. 16C is an isometric view of blade 92. FIG. 16D is an enlarged isometric cross-sectional view of blade 92 taken along line D-D in FIG. 16C. FIGS. 16A-16D will be discussed together. Blade 92 includes blade body 134 and cutting edge 136. Blade body 134 includes locating groove 146, main body portion 158, and ramped portion 160. Blade body 134 extends laterally between lateral blade ends 162.

Blade 92 is configured to contact and cut the adhesive tape 38. Cutting edge 136 is serrated in the example shown. The serrated portion of cutting edge 136 does not span the full lateral width of blade 92, in the example shown. Instead, each lateral blade end 162 includes a non-serrated, flat portion along the cutting edge 136. Ramped portion 160 of blade 92 is configured to be disposed outside of blade slot 140 in blade frame 130. Ramped portion 160 reduces the thickness of blade 92 between main body portion 158 and cutting edge 136. In some examples, the serrated portion of blade 92 can extend a full longitudinal length of ramped portion 160. As such, teeth 164 can extend from cutting edge 136 to main body portion 158. Teeth 164 cab be formed by and/or on the ramped portion 160.

Main body portion 158 is configured to be disposed with in blade slot 140. Locating groove 146 is formed in main body portion 158 and runs the width of blade 92 between the lateral blade ends 162. Locating groove 146 is configured to interface with projection 156 to retain blade 92 on blade frame 130. While locating groove 146 is shown as formed on blade 92 and projection 156 is shown as formed on blade frame 130, it is understood that other examples have projection 156 extending from blade 92 and locating groove 146 formed in blade frame 130.

Figure 17A:
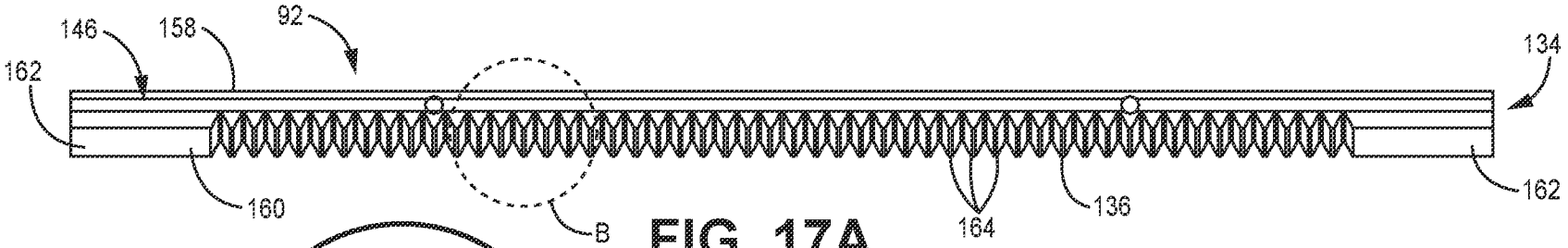
FIG. 17A is an overhead view of the blade.
Figure 17B:
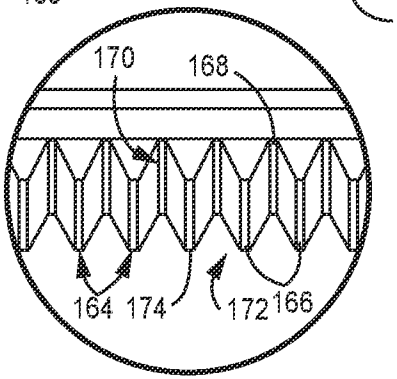
FIG. 17B is an enlarged view of detail B in FIG. 17A.
Figure 17C:
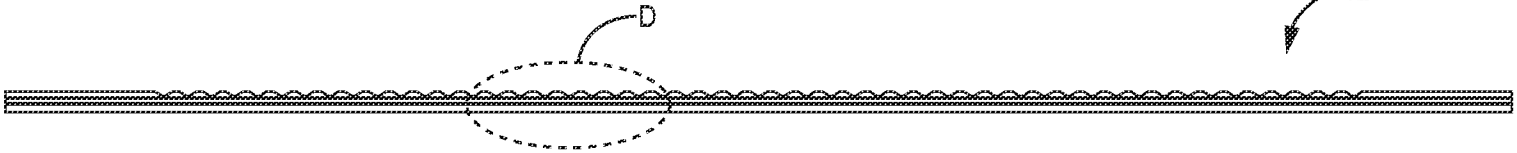
FIG. 17C is a rear view of the blade such that the cutting edge cannot be seen in the view of FIG. 17C.
Figure 17D:
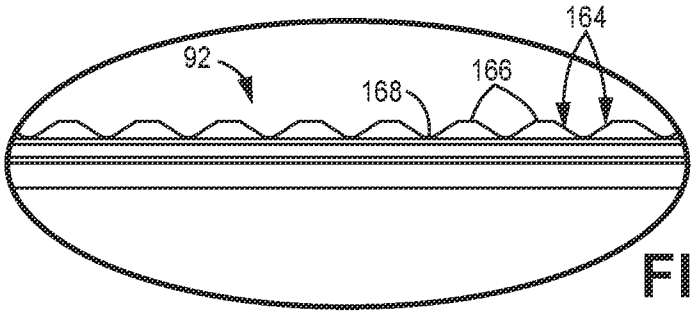
FIG. 17D is an enlarged view of detail D in FIG. 17C.
Figure 17E:
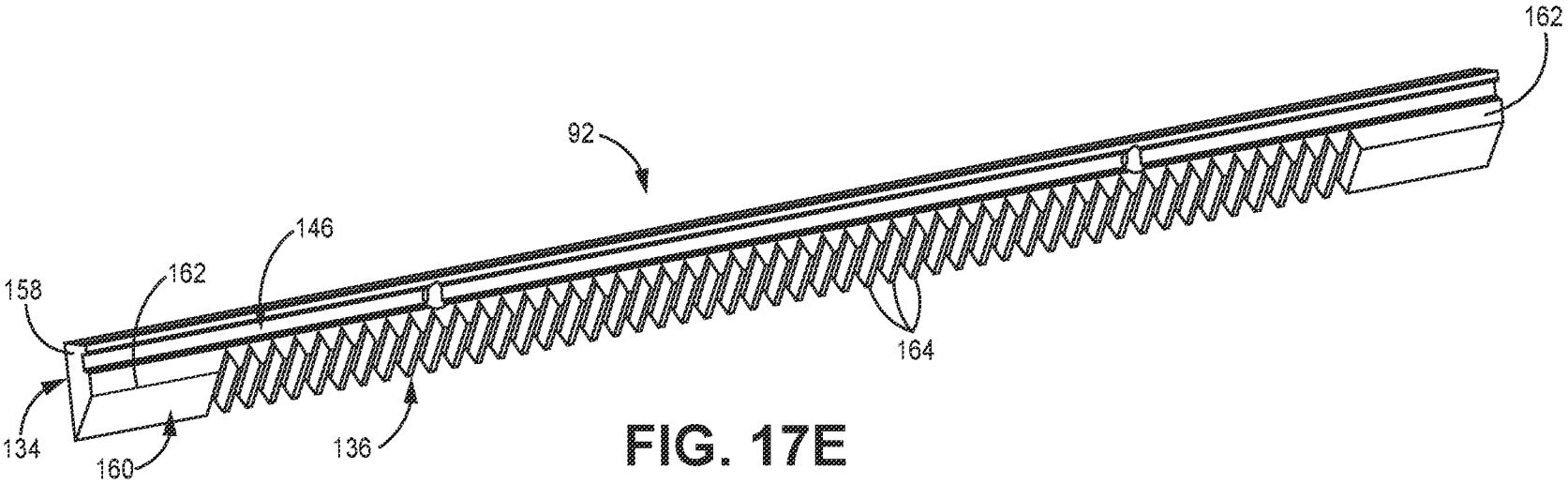
FIG. 17E is an isometric view of the blade.
Figure 17F:
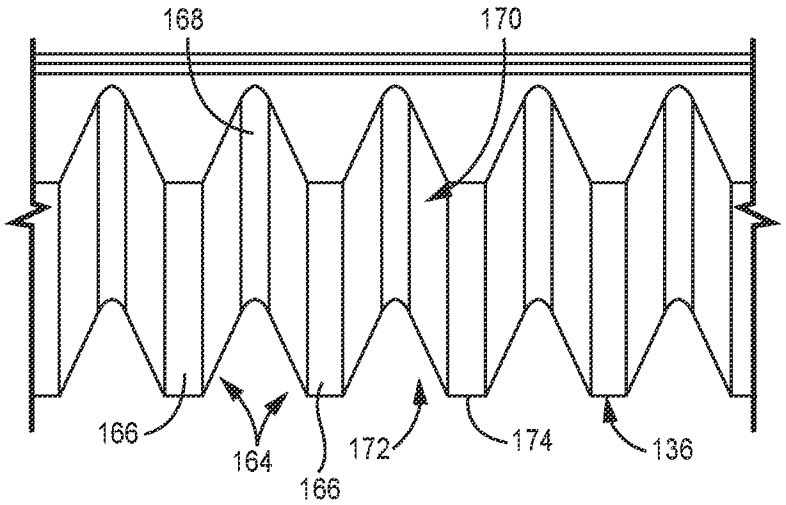
FIG. 17F is an enlarged view showing the cutting edge and teeth of the blade.

FIG. 17A is an overhead view of blade 92. FIG. 17B is an enlarged view of detail B in FIG. 17A. FIG. 17C is a rear view of blade 92 such that cutting edge 136 cannot be seen in the view of FIG. 17C. FIG. 17D is an enlarged view of detail D in FIG. 17C. FIG. 17E is an isometric view of blade 92. FIG. 17F is an enlarged view showing cutting edge 136 of blade 92. FIGS. 17A-17F will be discussed together. Blade 92 includes blade body 134 and cutting edge 136. Blade body 134 includes locating groove 146, main body portion 158, and ramped portion 160. Blade body 134 extends laterally between lateral blade ends 162. The tape engaging portion of blade 92 is formed by teeth 164. Each tooth 164 includes an apex 166 and troughs 168 are disposed between adjacent ones of the teeth 164. Teeth 164 are spaced from adjacent teeth 164 by body gaps 170 and edge gaps 172.

Teeth 164 project from main body portion 158 of blade 92. Teeth 164 can extend along the longitudinal length of ramped portion 160. A leading edge of each tooth 164 can form a portion of cutting edge 136. Teeth 164 are raised relative to and project from main body portion 158. Body gaps 170 are disposed between adjacent ones of the teeth 164. Body gaps 170 are formed on the top between adjacent ones of the teeth 164. Edge gaps 172 are formed at the front ends of each tooth 164 along the cutting edge 136. Each tooth 164 is sloped between its apex and the trough 168 between adjacent ones of the teeth 164. Each tooth 164 is configured to be laterally wider at a base of the tooth 164 proximate trough 168 than at the top of each tooth 164 at apex 166. In the example shown, each apex 166 is a flat end. As such, teeth 164 are not pointed at each apex 166. However, the leading edges 174 of the teeth 164 together form a pointed, sharp cutting edge 136 of blade 92.

The configurations of teeth 164 provide significant advantages. The flat apexes 166 facilitate quick, efficient, clean cutting of adhesive tape 38. Each tooth 164 forms multiple contact points for engaging with the adhesive tape 38. For example, each interface between the side wall of the tooth 164 and the flat apex 166 forms a sharp point. A sharp edge extends between those sharp points on each tooth 164. Each tooth 164 thereby forms a sub-blade that has a flat cutting edge between two cutting points. The multiple teeth 164 thereby form multiple sub-blades that together define the cutting edge. The multiple cutting points provide additional contact points with adhesive tape 38 to cut the adhesive tape 38 as compared to teeth 164 that terminate in a sharp apex.

The adhesive tape 38 can include reflective material and other grit on the top side such that the adhesive tape 38 is abrasive. The wide apexes 166, as compared to sharp points, provide larger surface area for engaging with the tape, which provides additional material in blade 92 contacting the adhesive tape 38. The larger surface area of blade 92 contacting adhesive tape 38 reduces wear along the cutting edge 136 as blade 92 contacts and cuts adhesive tape 38. The flat apexes 166 provide a robust cutting surfaces that has multiple direct contact points with the adhesive tape 38 to distribute the load amongst the teeth 164. The flat apexes 166 have multiple contact points along the width of the apex 166, which facilitates a reduced load at each point of contact with adhesive tape 38 as compared to sharp apexes 166 that each have only one point of contact.

Figure 18A:
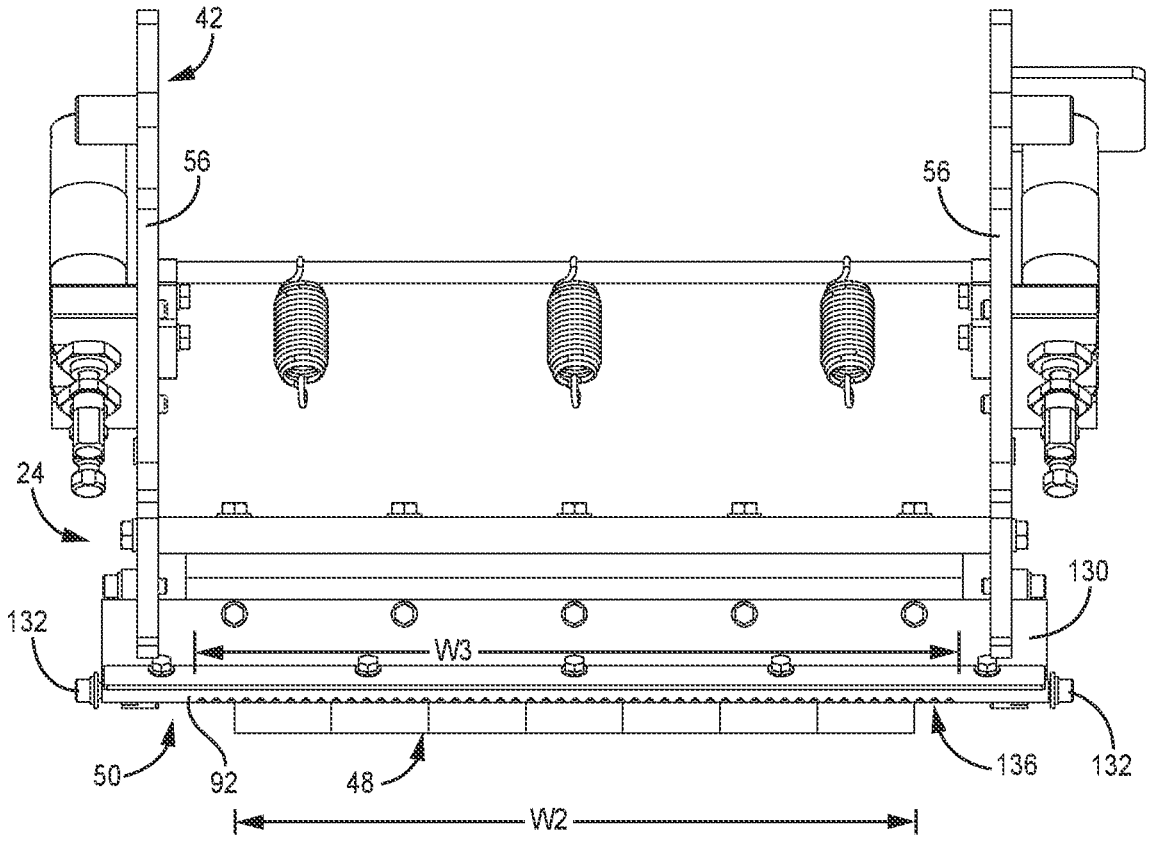
FIG. 18A is an end view of the applicator module with components removed to more easily see the cutter.
Figure 18B:
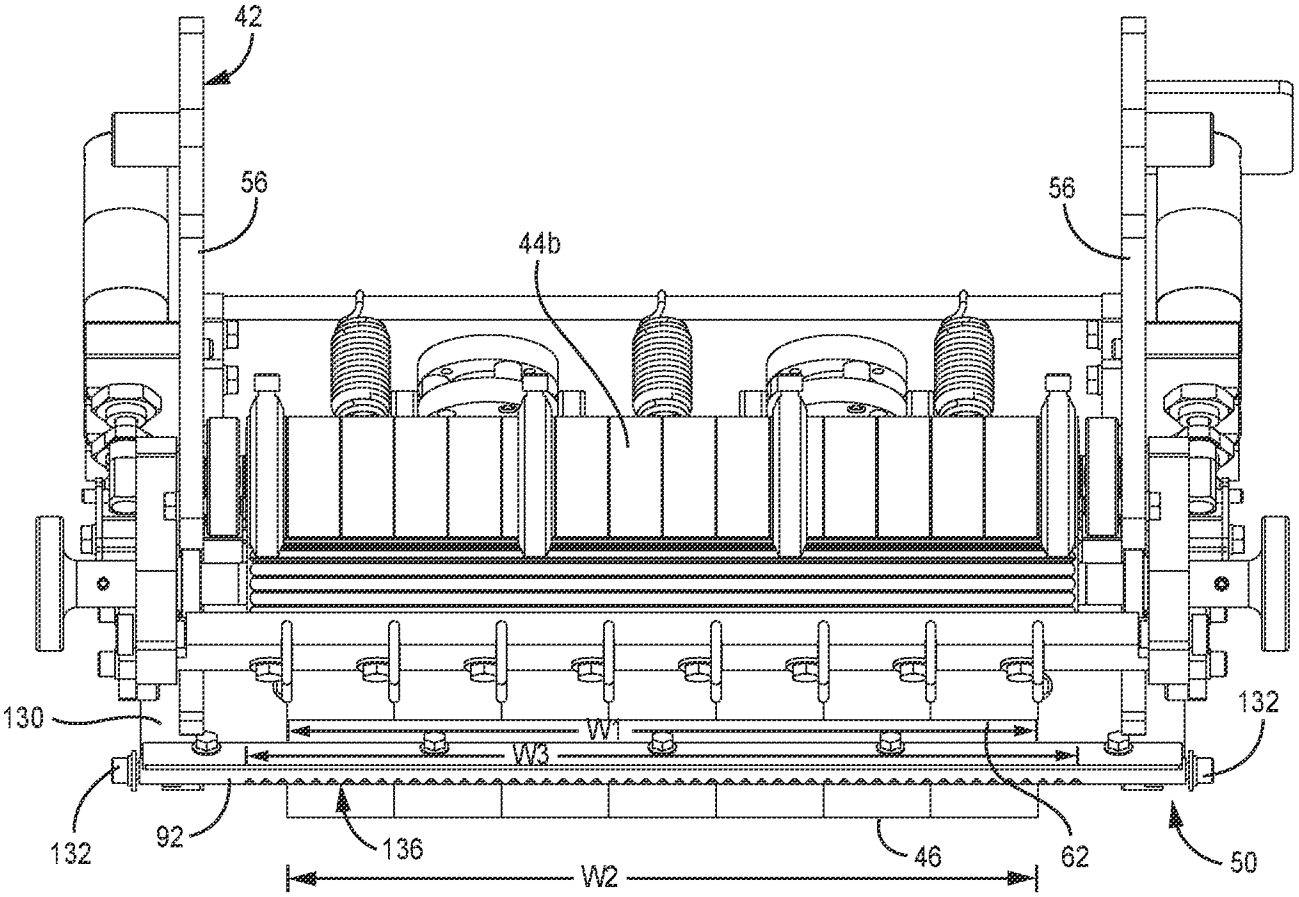
FIG. 18B is an end view of the applicator module.

FIG. 18A is an end view of applicator module 24 showing applicator module 24 with components removed to more easily see cutter 50. FIG. 18B is an end view of applicator module 24. FIGS. 18A and 18B will be discussed together. As shown, the blade 92 is wider than the lower module frame 42. In particular, the blade 92 extends laterally beyond both side plates 56 of the lower module frame 42. The blade 92, including the serrated portion, is wider than the guide rollers 44*a*, 44*b*. The serrated portion of blade 92 can be wider than applicator roller 62 and, in some examples, wider than tamping roller 48. Having a wide blade 92 relative to the module frame 42 means the blade 92 is easier to grasp and pull out from the applicator module 24 during disassembly and servicing. The serrated portion of blade 92 has a width W3. The width W3 can be larger than width W1 of applicator roller 62 and can be larger than width W2 of tamper roller 48. Having a wider serrated portion than the rollers ensures that the blade 92 is of a sufficient width to cut the tape 38, regardless of the width or number of the stripes of tape 38 being applied.

Figure 19A:
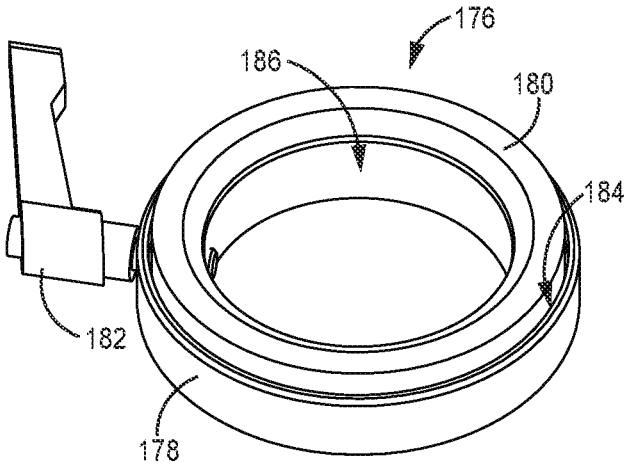
FIG. 19A is an isometric view of a spool damper.
Figure 19B:
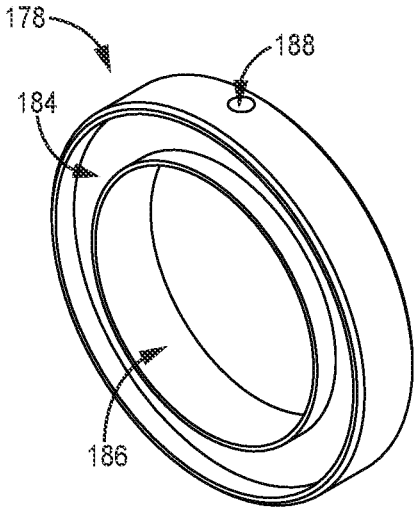
FIG. 19B is an isometric view of a base ring of a spool damper.

FIG. 19A is an isometric view of spool damper 176. FIG. 19B is an isometric view of base ring 178 of spool damper 176. FIGS. 19A and 19B will be discussed together. Spool damper 176 includes base ring 178, brake ring 180, and clamp 182. Base ring 178 includes brake groove 184, brake mount aperture 186, and clamp aperture 188.

Base ring 178 forms a main body portion of spool damper 176. Brake mount aperture 186 extends through base ring 178. Brake mount aperture 186 is sized to fit over the cylindrical spool support 22 such that spool support 22 extends through spool damper 176. Brake groove 184 is formed in a side of base ring 178. Brake groove 184 extends partially through the width of base ring 178. Brake ring 180 is configured to mount within brake groove 184. Brake ring 180 is formed from a braking material and is configured to directly engage with the side of tape spool 20. Brake ring 180 can be formed from rubber or another material that has increased grip and friction relative to metals or other materials. Base ring 178 can be formed from a metal, among other options.

Clamp 182 is configured to secure spool damper 176 at a desired position along the cylindrical spool support 22. In the example shown, clamp 182 includes a threaded shaft that extends through radial clamp aperture 188 formed in base ring 178. The clamp 182 can be rotated to cause the shaft to engage the tape spool support 22, thereby securing spool damper 176, and to disengage from tape spool support 22, thereby un-securing spool damper 176. Clamp 182 does not interface with brake ring 180 in the example shown. As such, brake ring 180 can float within brake groove 184 to allow for some relative movement between brake ring 180 and base ring 178 during operation. Such floating arrangement provides a dual frictional interface, a first interface between base ring 178 and brake ring 180 and a second interface between brake ring 180 and tape spool 20. Such dual frictional interface reduces wear on brake ring 180, increasing operational life and reducing costs.

Figure 20B:
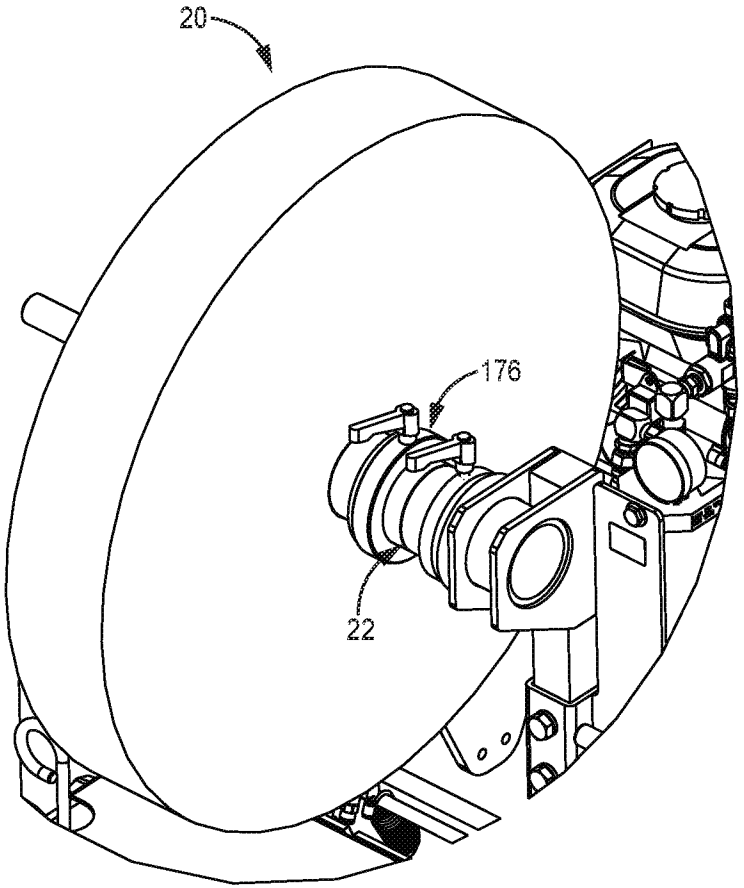
FIG. 20B is an isometric view of a portion of a ground tape applicator showing spool dampers mounted on a tape spool support and interfacing with a tape spool.
Figure 20A:
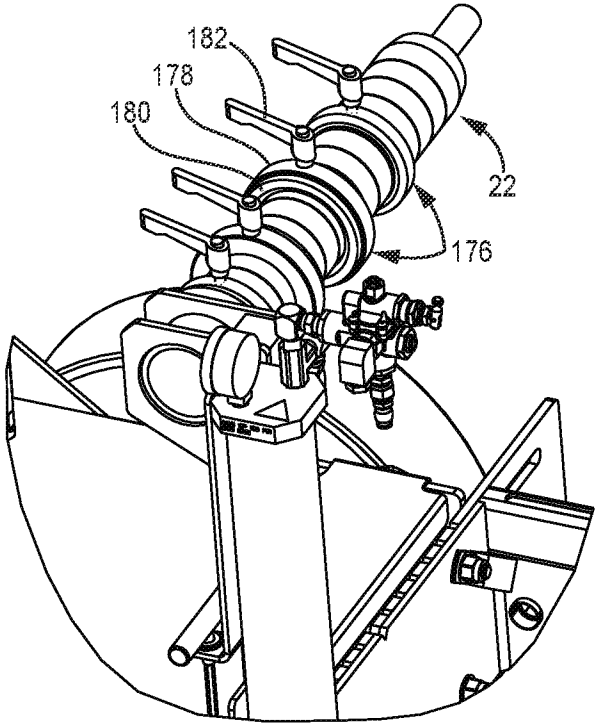
FIG. 20A is an isometric view of a portion of a ground tape applicator showing multiple spool dampers mounted on a tape spool support.

FIG. 20A is an isometric view of a portion of ground tape applicator 10 showing multiple spool dampers 176 mounted on tape spool support 22. FIG. 20B is an isometric view of a portion of ground tape applicator 10 showing spool damper 176 mounted on tape spool support 22 and interfacing with tape spool 20. FIGS. 20A and 20B will be discussed together. As shown, tape spool support 22 can be configured such that spool dampers 176 engage each lateral side of tape spool 20.

Spool damper 176 is configured to engage the side of tape spool 20 to introduce friction that resists rotation of tape spool 20. Spool damper 176 can be mounted to tape spool support 22 such that spool damper 176 remains generally stationary as tape spool 20 rotates relative to spool damper 176 as tape is pulled off of tape spool 20. For example, tape spool 20 can be configured to rotate relative to tape spool support 22 during application. The friction provided by spool damper 176 resists rotation of tape spool 20 relative to spool damper 176 and thus prevents tape spool 20 from continuing rotation on spool support 22 once tape 38 is no longer being actively pulled off of tape spool 20. The friction provided by spool damper 176 slows the rotation of the tape spool 20 during application of the tape 38 so that the momentum of the tape spool 20 is kept low and the rotation of the tape spool 20 comes to a stop when tape is no longer being dispensed. The friction further causes the tape to remain taut between tamper roller 48 and tape spool 20 to provide a clean, even stripe during application of the tape 38. Without the spool dampener 176, the tape spool 20 may continue to rotate even after application of tape 38 is complete for a particular stripe, which would cause unraveling of adhesive tape 38 from tape spool, which unraveled tape may get caught in the other components of the ground tape applicator 10 or cause other problems, such as by folding on itself prior to application of the next stripe.

Figure 21A:
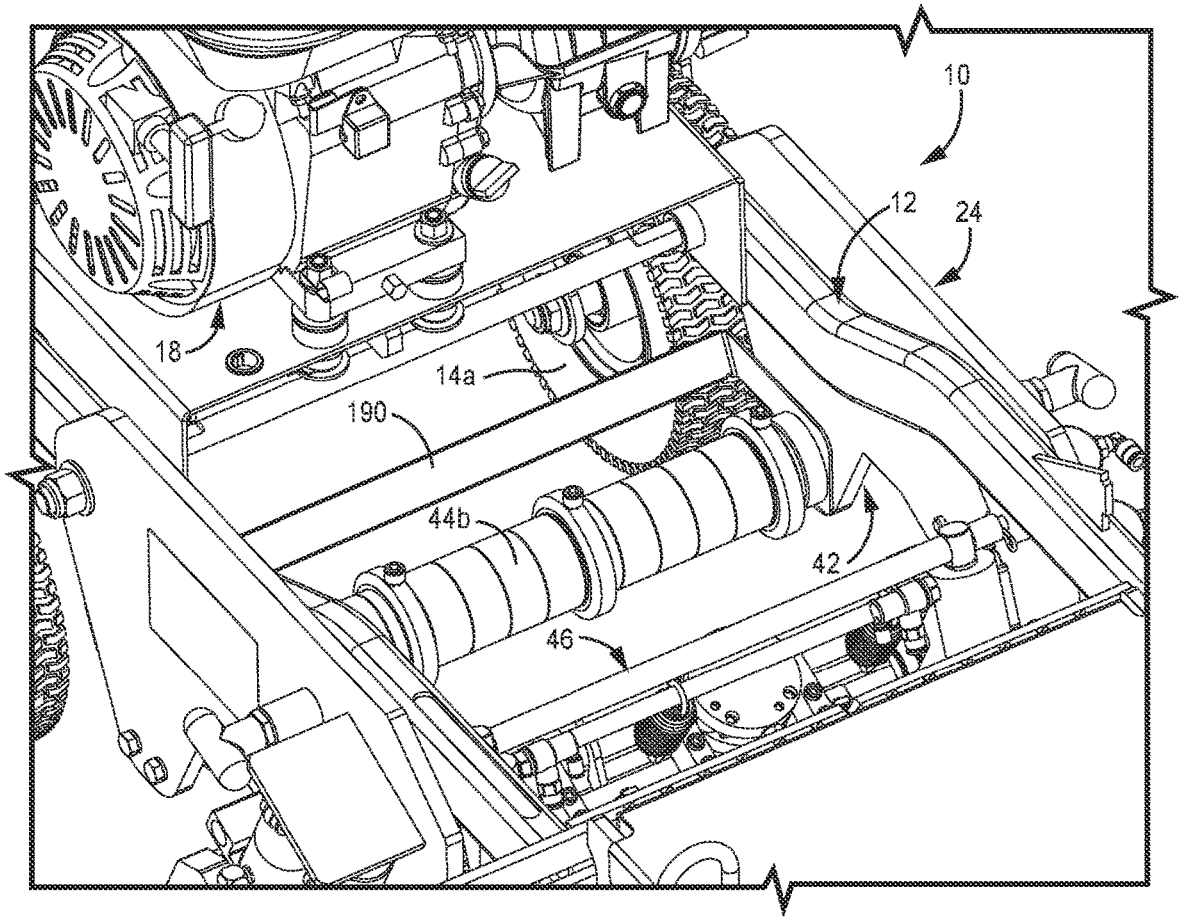
FIG. 21A is an enlarged isometric view of a portion of the ground tape applicator.
Figure 21B:
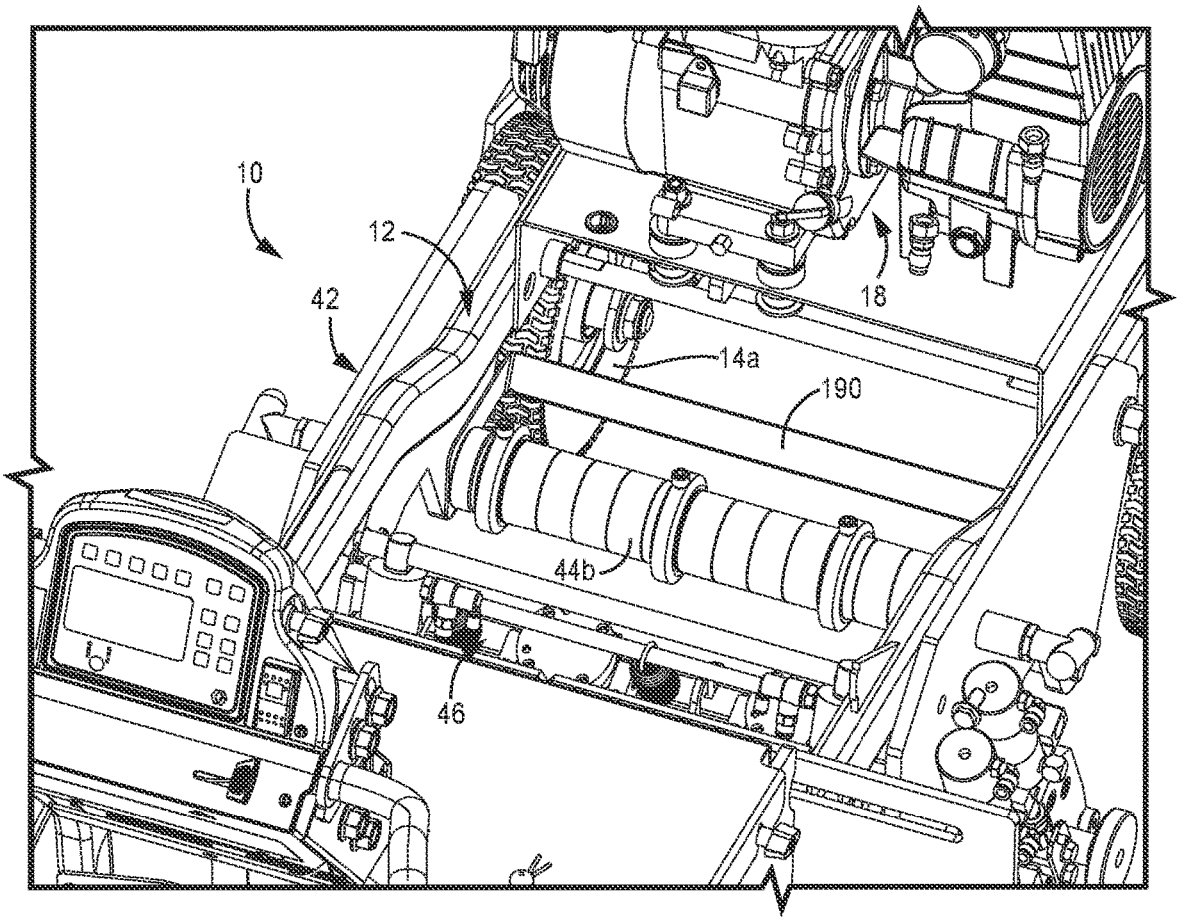
FIG. 21B is an enlarged isometric view of a portion of the ground tape applicator.

FIG. 21A is an enlarged isometric view of a portion of ground tape applicator 10. FIG. 21B is an enlarged isometric view of a portion of ground tape applicator 10. FIGS. 21A and 21B will be discussed together. Tape guard 190 is shown in FIGS. 21A and 21B.

Tape guard 190 is configured to block access to wheels 14*a* and other components by slacked or otherwise unrolled tape 38. Tape guard 190 blocks tape 38 from advancing past the tape guard 190. Tape guard 190 is mounted on the guide roller 44*b* (e.g., on the axle or studs on which the rotating barrel of the guide roller 44*b* rotates), however the tape guard 190 can be configured to not rotate with the guide roller 44*b*. The tape guard 190 does not rotate with the guide roller 44*b*. Instead, the tape guard 190 is disposed longitudinally between the guide roller 44*b* and wheels 14*a*. Tape guard 190 is spaced longitudinally forward of the location where the tape 38 changes direction around guide roller 44*b* and is fed to the ground engaging rollers. The tape guard 190 is positioned to block unraveling or slacked tape, which would move towards front wheels 14*a* due to momentum and the travel direction at that location, from moving past the tape guard 190 any closer to the wheels 14*a*. Tape guard 190 thereby prevents the tape 38 from becoming tangled in or otherwise clogging ground tape applicator 10.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. Also, while some options are shown, it is understood that those options do not need to be present, and some aspects could be removed or substituted.

The invention claimed is:

1. A ground tape applicator comprising:

an applicator frame;

a plurality of wheels configured to support the applicator frame on a ground surface;

a tape spool support configured to support a spool of an adhesive tape, the tape spool support supported by the applicator frame;

a cutter configured to interface with the adhesive tape to cut the adhesive tape;

a plurality of rollers, the plurality of rollers configured to interface with the adhesive tape and positioned to guide the adhesive tape to the ground surface, the plurality of rollers including a first roller and a second roller, wherein the adhesive tape interfaces with the first roller prior to interfacing with the second roller, and wherein the second roller is configured to press the adhesive tape onto the ground surface; and a roller actuator operably connected to the first roller to move the first roller vertically relative to the ground surface, wherein the first roller is movable relative to the ground surface and between an application position in which the first roller presses the adhesive tape onto the ground surface and a float position in which the first roller is spaced from the ground surface and floats above the ground surface such that the first roller guides the adhesive tape while the second roller presses the tape onto the ground surface;

an electronic controller configured to:

cause the roller actuator to displace the first roller to the application position to press the adhesive tape onto the ground surface during only an initial application phase of applying a full length stripe of the adhesive tape, the initial application phase corresponding to application of a leading end of the full length stripe;

cause the first roller to displace away from the ground surface after the initial application phase and from the application position to the float position such that the second roller and not the first roller rolls over and presses portions of the adhesive tape other than the leading end onto the ground surface; and maintain the first roller in the float position during application of a main body portion of the full length stripe of the adhesive tape, the main body portion between the leading end of the full length stripe and a trailing end of the full length stripe;

wherein, with the first roller in the float position, the first roller guides the adhesive tape such that a portion of the adhesive tape between the first roller and the second roller is disposed vertically between the ground surface and the cutter.

2. The ground tape applicator of claim 1, wherein the roller actuator is configured to position and maintain the first roller at a first position relative to the ground surface, the application position relative to the ground surface, and the float position relative to the ground surface, wherein the application position is disposed vertically below the first position, and wherein the float position is disposed vertically between the first position and the application position.

3. The ground tape applicator of claim 1, wherein the first roller is configured to pivot between the application position and the float position.

4. The ground tape applicator of claim 3, wherein at least one arm is connected to the first roller and to a frame to support the first roller relative to the frame, the at least one arm interfacing with the frame at a pivot point.

5. The ground tape applicator of claim 1, wherein the first roller is further movable to a cutting position disposed vertically above the float position, wherein the first roller is disposed vertically above the cutter with the first roller in the cutting position.

6. The ground tape applicator of claim 5, wherein at least a portion of the first roller is disposed vertically between the ground surface and the cutter with the first roller in the float position.

7. The ground tape applicator of claim 5, wherein the cutter is disposed longitudinally between the first roller and the second roller.

8. The ground tape applicator of claim 5, wherein only the second roller presses a trailing end of the full length stripe of the adhesive tape onto the ground surface, the trailing end formed by the cutter cutting the adhesive tape.

9. The ground tape applicator of claim 1, wherein the roller actuator includes a spring configured to bias the first roller away from the ground surface.

10. The ground tape applicator of claim 1, further comprising:

a brake configured to engage and hold the adhesive tape to tense the adhesive tape between the brake and the second roller.

11. The ground tape applicator of claim 10, wherein the brake clamps the adhesive tape between the brake and a third roller of the plurality of rollers, the adhesive tape interfacing with the third roller prior to interfacing with the first roller.

12. The ground tape applicator of claim 11, wherein the third roller is an adhesive side roller interfacing with an adhesive side of the adhesive tape.

13. The ground tape applicator of claim 1, wherein the roller actuator includes a first piston configured to shift linearly to move the first roller relative to the ground surface.

14. The ground tape applicator of claim 13, wherein the roller actuator includes a second piston configured to interface with a roller frame supporting the first roller, wherein the first piston interfaces with the roller frame such that the first piston can both drive the first roller towards the ground surface and away from the ground surface.

15. The ground tape applicator of claim 14, wherein the second piston is configured to interface with the roller frame such that the second piston is capable of driving the first roller towards the ground surface and is incapable of pulling the first roller away from the ground surface.

16. A ground tape applicator comprising:

an applicator frame;

a plurality of wheels configured to support the applicator frame on a ground surface;

a tape spool support configured to support a spool of an adhesive tape, the tape spool support supported by the applicator frame;

a cutter configured to interface with the adhesive tape to cut the adhesive tape;

a plurality of rollers, the plurality of rollers configured to interface with the adhesive tape and positioned to guide the adhesive tape to the ground surface, the plurality of rollers including a first roller and a second roller, wherein the adhesive tape interfaces with the first roller prior to interfacing with the second roller, and wherein the second roller is configured to press the adhesive tape onto the ground surface; and an electronic controller configured to:

cause the first roller to shift to a position associated with an initial application operating phase to press a leading end of a full length stripe of the adhesive tape onto the ground surface; and cause the first roller to shift vertically away from the ground surface to a position associated with a float phase such that the first roller is disengaged from the ground surface and spaced from the ground surface while the second roller rolls over the adhesive tape and presses the adhesive tape onto the ground surface;

maintain the first roller in the position associated with the float phase during application of a main body portion of the full length stripe of the adhesive tape, the main body portion between a leading end of the full length stripe and a trailing end of the full length stripe;

wherein the first roller maintains the adhesive tape vertically between the ground surface and the cutter with the first roller in the position associated with the float phase.

17. The ground tape applicator of claim 16, wherein the electronic controller is further configured to:

cause the first roller to shift vertically away from the ground surface and from the position associated with the float phase to a position associated with a cutting phase in which the adhesive tape is brought into contact with the cutter to cut the adhesive tape and form a trailing end of the full length stripe.

18. The ground tape applicator of claim 17, wherein the first roller is disposed at least partially vertically between the cutter and the ground surface with the first roller in the position associated with the float phase.

19. The ground tape applicator of claim 1, wherein the roller actuator is configured to hold and maintain the first roller in the float position during application of the main body portion of the full length stripe.

* * * * *